US009028224B2

(12) United States Patent
Headley et al.

(10) Patent No.: US 9,028,224 B2
(45) Date of Patent: May 12, 2015

(54) AIR OPERATED DOUBLE DIAPHRAGM PUMP

(75) Inventors: Thomas R. Headley, Roanoke, IN (US); Benjamin R. Freiburger, Fort Wayne, IN (US)

(73) Assignee: Tuthill Corporation, Fort Wayne, IN (US)

( * ) Notice: Subject to any disclaimer, the term of this patent is extended or adjusted under 35 U.S.C. 154(b) by 479 days.

(21) Appl. No.: 13/242,849

(22) Filed: Sep. 23, 2011

(65) Prior Publication Data

US 2013/0078125 A1 Mar. 28, 2013

(51) Int. Cl.

| | |
|---|---|
| ***F04B 45/053*** | (2006.01) |
| ***F16K 11/085*** | (2006.01) |
| ***F04B 43/06*** | (2006.01) |
| ***F04B 43/073*** | (2006.01) |

(52) U.S. Cl.

CPC ..... *F04B 43/06* (2013.01); *F04B 43/0736* (2013.01)

(58) Field of Classification Search

CPC ..... F04B 43/0736; F04B 43/026
USPC ..... 417/393–395; 137/625.25
See application file for complete search history.

(56) References Cited

U.S. PATENT DOCUMENTS

| | | | | |
|---|---|---|---|---|
| 5,055,007 | A * | 10/1991 | Geddings | 417/393 |
| 5,108,270 | A | 4/1992 | Kozumplik, Jr. | |
| D331,412 | S | 12/1992 | Wilden | |
| 5,368,452 | A | 11/1994 | Johnson et al. | |
| 5,527,160 | A | 6/1996 | Kozumplik, Jr. et al. | |
| 5,551,847 | A * | 9/1996 | Gardner et al. | 417/393 |
| 5,573,385 | A * | 11/1996 | Chevallier | 417/393 |
| 5,860,794 | A * | 1/1999 | Hand et al. | 417/393 |
| 6,901,961 | B2 | 6/2005 | Roberts et al. | |
| 7,063,516 | B2 * | 6/2006 | Bethel | 417/395 |
| 7,063,517 | B2 | 6/2006 | Towne et al. | |
| 7,134,849 | B1 * | 11/2006 | Steck et al. | 417/384 |
| 7,497,670 | B2 * | 3/2009 | Murata | 417/395 |
| 2007/0065305 | A1 * | 3/2007 | Budde et al. | 417/395 |
| 2010/0043895 | A1 | 2/2010 | Towne | |

* cited by examiner

*Primary Examiner* — Charles Freay
(74) *Attorney, Agent, or Firm* — Barnes & Thornburg LLP

(57) ABSTRACT

A double diaphragm pump is provided. The pump includes an inlet manifold, an outlet manifold, an air valve housing, first and second diaphragm housings, and a collar. The inlet manifold has at least one passageway configured to direct fluid from an inlet port on the inlet manifold. The outlet manifold has at least one passageway configured to direct fluid to an outlet port on the outlet manifold. Each of the housings is in selective fluid communication with the inlet and outlet manifolds. The collar is configured to be rotatably attached to the inlet manifold and the pump.

10 Claims, 60 Drawing Sheets

SECTION A-A

SECTION A-A

SECTION A-A
SCALE 1 : 2

FIG. 44 SECTION B-B

SECTION A-A
SCALE 1 : 1

SECTION A-A

AIR OPERATED DOUBLE DIAPHRAGM PUMP

TECHNICAL FIELD AND INTRODUCTION

The following disclosure relates to improved double diaphragm pumps with new design and improved operation.

Diaphragm pumps, like other pumps move pourable fluid from one place to another. A diaphragm pump employs a plunger-like membrane to pump the fluid. As the diaphragm moves back and forth, similar to a conventional toilet-bowl plunger, it draws fluid in and then pushes it out. This is known as positive displacement. Continually pushing and pulling the diaphragm creates a continuous flow of pumped fluid.

A "double" diaphragm pump operates similar to a conventional diaphragm pump except that it includes two plungers instead of one. Each diaphragm is located in its own chamber and each is attached to an end of a rod. The rod moves back and forth to move the plungers back and forth as well. As the rod pushes one diaphragm it pulls the other. Consequently, the diaphragm being pulled draws fluid into its chamber while at the same time pushing the second diaphragm which pushes fluid out of its chamber. Continuous reciprocal operation in this manner provides a greater flow rate.

An example of a prior art double diaphragm pump is shown in FIG. 60 of U.S. Patent Publication No. 20100043895. This figure depicts a perspective view of a pump PA2. Note that the original reference numerals from the drawings shown in U.S. Patent Publication No. 20100043895 that constitute Prior Art FIGS. 60 and 61 have been removed. The drawing has been re-annotated in order to demonstrate the illustrative operation of a conventional double diaphragm pump. It should, therefore, be understood that the following description is not intended to discuss the precise operation of the pump shown U.S. Patent Publication No. 20100043895. Instead, the following description uses Prior Art FIGS. 60 and 61 as a vehicle to discuss the general operation of conventional double diaphragm pumps common to this and other such pumps.

The view in Prior Art FIG. 60 shows double diaphragm pump PA2 that includes an inlet manifold PA4 on the bottom and outlet manifold PA14 on the top. As their names imply the inlet and outlet manifolds are where fluid is drawn and ejected into and out of the pump. As discussed further herein, pump PA 2 also includes fluid/air housings PA10 and PA20. These housings each contain a diaphragm that moves back and forth to draw and eject fluid. The other major structure of pump PA2 is its valve housing PA24. Unlike other pumps that employ electric motors to pump fluid, diaphragm pump simply use pressurized air. Air is directed to one diaphragm at a time, so that pushing one diagram pulls the second diaphragm.

A front-facing, cross-sectional view of Prior Art double diaphragm pump PA2 is shown in Prior Art FIG. 61. The components of pump PA2 include, first, inlet manifold PA4 with first inlet valve PA6 in selective fluid communication with first fluid chamber PA8 of fluid/air housing PA10, and outlet valve PA12 in selective communication with outlet manifold PA14. Second, inlet manifold PA4 is in selective communication with second inlet valve PA16 in fluid communication with fluid chamber PA18 of fluid/air housing PA20, and outlet valve PA22 in selective communication with outlet manifold PA14. Valve housing PA24 is located between fluid/air housings PA10 and PA20, and is configured to distribute pressurized air between first air chamber PA26 and second air chamber PA28 of housings PA10 and PA20, respectively.

Diaphragms PA30 and PA32 are located inside housings PA10 and PA20, respectively. Each housing PA10 and PA 20 has its own set of inlet valves PA6, PA16 and outlet valves PA12, PA22 in fluid communication with inlet and outlet manifolds PA4 and PA14, respectively. This allows a single inlet port PA34 to supply both inlet valves PA6, PA16 and a single outlet port PA36 to expel from both outlet valves PA12, PA22.

A shaft PA38 connects to each diaphragm PA30 and PA32 making them move back and forth. When diaphragm PA30 is pulled inside housing PA10, diaphragm PA32 is being pushed inside housing PA20. Fluid is, thus, drawn into inlet manifold PA4, up through inlet valve PA6, typically a ball valve configured to only let fluid pass through, and into first fluid chamber PA8. At the same time, shaft PA38 pushes diaphragm PA32 which is in turn pushes fluid (previously drawing into chamber PA18) out through outlet valve PA22, into outlet manifold PA14, and exits through outlet port PA36. Outlet valve is also a ball valve but configured to only allow fluid to escape chamber PA18 upon sufficient force supplied by diaphragm PA32. Thereafter, the reverse occurs. Fluid in chamber PA8 is pushed out via diaphragm PA30 while diaphragm PA32 pulls more fluid into chamber PA18 thereby replacing fluid previously expelled.

No electric motors move these diaphragms back and forth, and instead pressurized air. As shown in Prior Art FIG. 60, valve housing PA24 includes an air inlet port PA40 which receives a constant supply of pressurized air. Once the air is inside housing PA24 it is distributed to one of the two diaphragms. Each diaphragm splits its housing between a fluid chamber and an air chamber. Diaphragm PA30 and PA32 separates its respective housing PA20 and PA20 into chambers PA8/PA26 and PA18/PA28, respectively. Indeed the diaphragm works well in this capacity, as its flexible membrane serves as both a water/air tight barrier between the fluid and air chambers and force generator to move fluid.

Shaft PA38 extends through valve housing PA24. Air moves through a valve inside housing PA24 and fills one of the air chambers. Filling this chamber expands the size of that chamber by acting on the diaphragm (either PA30 or PA32), and hence, pushing the diaphragm to eject the fluid in its corresponding fluid chamber. This action also serves to move shaft PA38. As this happens it activates a valve to begin supplying air to the other air chamber and release air from the chamber that is being filled. This causes that filled air chamber to empty causing the pulling action that draws fluid into the fluid chamber that just previously ejected fluid. Shaft PA38 moving in the opposite direction activates the valve reversing the air flow again. This reciprocal movement continues so long as air is supplied to valve housing PA24 and there is fluid to be continually drawn into inlet manifold PA 4.

A portion of the subject matter of this disclosure includes a new air handling system to move dual diaphragms back and forth for continuously drawing in and expelling fluid from the pump. Pressurized air enters a valve block that includes a piston-like spool. Air passes around the spool into a passage to push one of the diaphragms. At the same time, air that had once pushed the other diaphragm is being expelled from the pump through another passage. Passages and conduits in the pump ensure the pressurized air travels to its intended destination. While air pushes one of the diaphragms expanding its air chamber a diaphragm rod connecting both diaphragms together begins pulling on the other diaphragm collapsing its air chamber. A trip rod inside the pump is illustratively shorter than the diaphragm rod so it will not begin moving until the diaphragm rod moves some distance. Before the trip rod moves a pilot D-valve allows air to pass though it and a D-valve plate allowing exhaust air to pass. Once the diaphragm rod moves far enough it begins moving the trip rod which begins moving the D-valve. The D-valve moves with respect to the D-valve plate closing the exhaust air flow path. At about the same time, a new air pathway opens allowing pressurized air to enter the diaphragm chamber of the other diaphragm that was just exhausting air a moment ago. Once this happens the pressurized air is also directed to the spool to move it and a major D-valve upward in an opposite direction. At this moment a passageway in the major D-valve is still connected with the passage that is exhausting air from the other diaphragm. But once enough pressurize air is available to move the spool it does so, which also moves the major D-valve. Once the major D-valve moves, the exhaust air from the other diaphragm is cut off. Instead, the major D-valve now opens the passageway to the one diaphragm chamber originally filling with pressurized air, to begin exhausting that air. This all begins moving pressurized air to the other diaphragm which moves the diaphragm rod in the opposite direction it was just moving. Like that previously discussed when the first diaphragm was being moved by the pressurized air, moving this second diaphragm with pressurized air moves the diaphragm rod a distance before it moves the trip rod in the opposite direction as well. Once the trip rod moves it moves the pilot D-valve. As before, but now with the second diaphragm, the pressurized air is cut off and begins to be exhausted. This change also allows air pressurized air that is pushing the spool upward to become exhausted air which begins lowering the spool and thus lowering the major D-valve. This places the components back where they started to begin the process all over again. It is appreciated that movement of the spool, major D-valve, trip rod, and the pilot D-valve do so in order to shift the pressurized air from one side of the pump to the other while at the same time exhausting the air once it fills an air chamber.

Another illustrative embodiment of the present disclosure includes a double diaphragm pump comprising an inlet manifold, an outlet manifold, an air valve housing, first and second diaphragm housings, and a boltless collar. The inlet manifold has at least one passageway configured to direct fluid from an inlet port on the inlet manifold. The outlet manifold has at least one passageway configured to direct fluid to an outlet port on the outlet manifold. Each of the housings is in selective fluid communication with the inlet and outlet manifolds. The boltless collar is configured to be rotatably attached to the inlet manifold and the pump. Boltless means no bolt or like fastener is necessary for the collar to secure structures together.

In the above and other illustrative embodiments, the double diaphragm may further comprise: the inlet manifold having a second passageway that directs fluid from the inlet manifold to one of the housings and wherein a second collar being configured to be rotatably attached to a periphery of the second passageway on the inlet manifold and the pump; another collar being configured to be rotatably attached to a periphery of the one passageway of the outlet manifold and the pump; the first and second housings each comprising first and second caps, respectively such that a diaphragm is located between the first and second caps of each of the first and second housings, respectively, wherein first and second diaphragm collars each having a threaded surface rotatably attach to corresponding threaded surfaces on at least one of the first and second caps of each of the first and second housings, respectively, to form the first and second housings, respectively.

Another characteristic of prior art double diaphragm pumps is their construction. In particular, pump PAZ shown in FIG. 60 is a conventionally constructed double diaphragm pump wherein housings PA10 and PA20 are each made from clamshell-like cap halves. In particular, housing PA10 is composed of cap halves PA44 and PA46. Similarly, housing PA20 is made up of cap halves PA48 and PA50. This form of construction creates a bifurcated chamber inside the housing via diaphragm PA30 and PA32 separating the fluid and air chambers. Each of these cap halves is coupled as shown in prior art FIG. 60 via bolts PA52. As shown, bolts PA52 are all typically identical to each other and are disposed through each cap half. These bolts are positioned concentrically around the housing. This keeps the inner air and fluid chambers airtight. One issue with this design, however, is that each bolt creates a localized force that requires another bolt to fasten the cap halves concentrically opposite to balance the forces. Furthermore, each pump may require up to 80 bolts and nuts to secure it together.

In similar fashion, manifolds PA4 and PA14 are attached to pump PA2 via fasteners PA54 as shown in Prior Art FIG. 60. This arrangement is useful from the point of view that the bolts can be loosened to remove either manifolds PA4 or PA14 from the pump. This attachment means, however, suffers from the same issues as the fluid/air housing cap halves. Each bolt creates only a localized force.

The subject matter of this disclosure includes new coupling mechanisms between the separable components of the double diaphragm pump. In one illustrative embodiment, threaded collars engage corresponding threads formed on the manifold openings and body openings at the vicinity of the check valves. These collars couple the manifolds to the pump body. As a consequence bolts are no longer needed. These collars apply a uniform coupling force to the manifold and body in contrast to the localized force produced by the individual bolts employed in the prior art.

An illustrative embodiment of the present disclosure includes a double diaphragm pump comprising an inlet manifold, an outlet manifold, first and second diaphragm housings; first and second diaphragms, an air valve housing, and an air management apparatus. The first diaphragm is located in the first diaphragm housing. The second diaphragm is located in the second diaphragm housing. The first diaphragm separates the first diaphragm housing into first fluid and air chambers. The second diaphragm separates the second diaphragm housing into second fluid and air chambers. The air valve housing is in selective fluid communication with each of the first and second air chambers. The air management apparatus moves the first and second diaphragms in a reciprocally linear manner to draw and expel fluid into and from the double diaphragm pump. The air management apparatus comprises: an air inlet configured to receive pressurized air; a spool in communication with the air inlet wherein the spool is configured to move in a linearly reciprocal manner, in response to the pressurized air; a plate includes first, second and third air passages wherein the first passage is in fluid communication with the first air chamber and configured such that as pressurized air fills the first air chamber in the first housing against the first diaphragm moves and expands the air chamber to push the fluid out of the first fluid chamber; a first block includes an air passage configured to selectively communicate with the second and third air passage in the plate to expel air from the second air chamber in the second housing which are in fluid communication with each other to reduce the size of the second air chamber in the second housing as the first air chamber expands; a trip rod located in the air valve housing is sized a length less than a distance between the first and second diaphragms so the first and second diaphragms are movable a second distance before the either the first or second diaphragms cause engagement with the trip rod to move the trip rod; wherein the trip rod is engageable with a second block having first and second passageways and is configured such that the first passageway of the second block is in selective fluid communication with fourth and fifth passageways in the plate to exhaust air from the second air chamber; wherein the trip rod is configured to be movable itself a third distance before engaging and moving the second block; wherein the trip rod is configured to move the second block when engaged to cut off the air exhaust from the second air chamber; wherein the second block is configured to be moved such that the second passageway in the second block selectively moves in fluid communication with the fourth passageway in the plate to cause pressurized air to enter the second passageway in the second block and the fourth passageway in the plate and be directed to the spool to move the spool and first block to selectively cut off pressurized air to the first passageway of the plate and selectively open the third passageway in the plate to receive pressurized air, and configured such that the pressurized air is exhausted from the first air chamber and through the first and second passageways in the plate configured to be in fluid communication with the passageway of the first block to expel that pressurized air, and configured such that the moved spool reveals the third passageway in the first block to supply pressurized air into the second air chamber of the second housing.

Additional features and advantages of the double diaphragm pump will become apparent to those skilled in the art upon consideration of the following detailed description of the illustrated embodiment exemplifying the best mode of carrying out the double diaphragm pump as presently perceived.

BRIEF DESCRIPTION OF DRAWINGS

The present disclosure will be described hereafter with reference to the attached drawings which are given as non-limiting examples only, in which.

Figure 1:
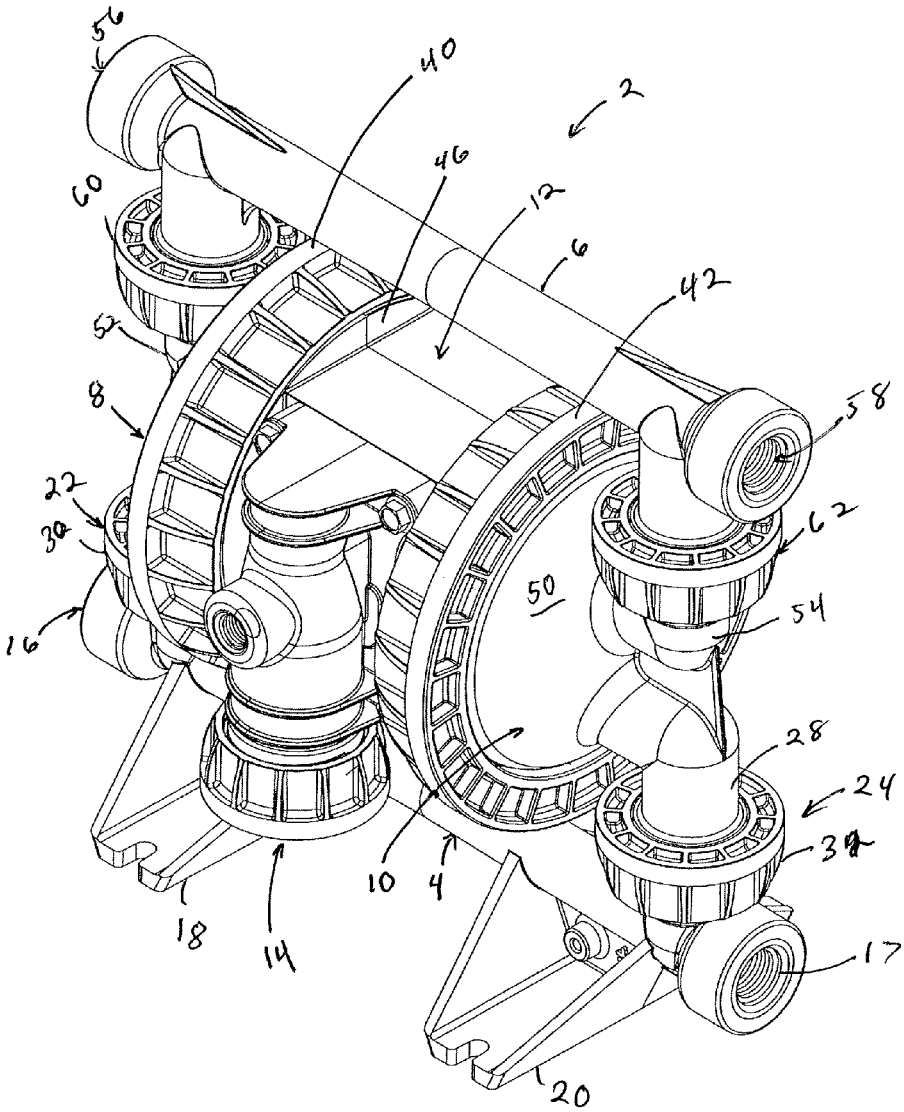
FIG. 1 is a perspective view of an illustrative embodiment of a double diaphragm pump according to the present disclosure.

Corresponding reference characters indicate corresponding parts throughout the several views. The exemplification set out herein illustrates embodiments of the double diaphragm pump assembly, and such exemplification is not to be construed as limiting the scope of the double diaphragm pump assembly in any manner.

DETAILED DESCRIPTION OF THE DRAWINGS

A perspective view of an illustrative embodiment of a double diaphragm pump assembly 2 is shown in FIG. 1. Pump assembly 2 as shown herein comprises an inlet manifold 4, an outlet manifold 6, and fluid/air housings 8, 10 bounding air valve assembly housing 12 and valve block assembly 14. Inlet manifold 4 illustratively includes inlet ports 16 and 17 on opposed sides. This allows fluid to be drawn up from either side of pump 2. It is contemplated that illustratively a cap or cover (not shown) may plug either port that is not receiving incoming fluid. Feet 18 and 20 are illustratively attached to inlet manifold 4 as shown. The shape and spacing apart of the feet assist keeping the pump stable and upright during operation. Extending upward from inlet manifold 4 are valve couplings 22 and 24. These couplings connect manifold 4 with tubes 26 (see FIG. 2) and 28 via threaded collars 30 and 32. As discussed further herein, a check valve, illustratively ball valves sit between manifold 4 at couplings 22 and 24 and tubes 26 and 28, respectively, so that fluid may selectively enter tubes 26 and 28 to ultimately deposit into housings 8 and 10, respectively without the fluid draining back out manifold 4. Threaded collars 30 and 32 are configured to provide a secure fluid-tight connection while making it convenient to assemble and disassemble these components by simply rotating them in one direction or the other. Tubes 26 and 28 are shown entering housings 8 and 10, respectively, which themselves include their own threaded collars 40 and 42, respectively.

Figure 60:
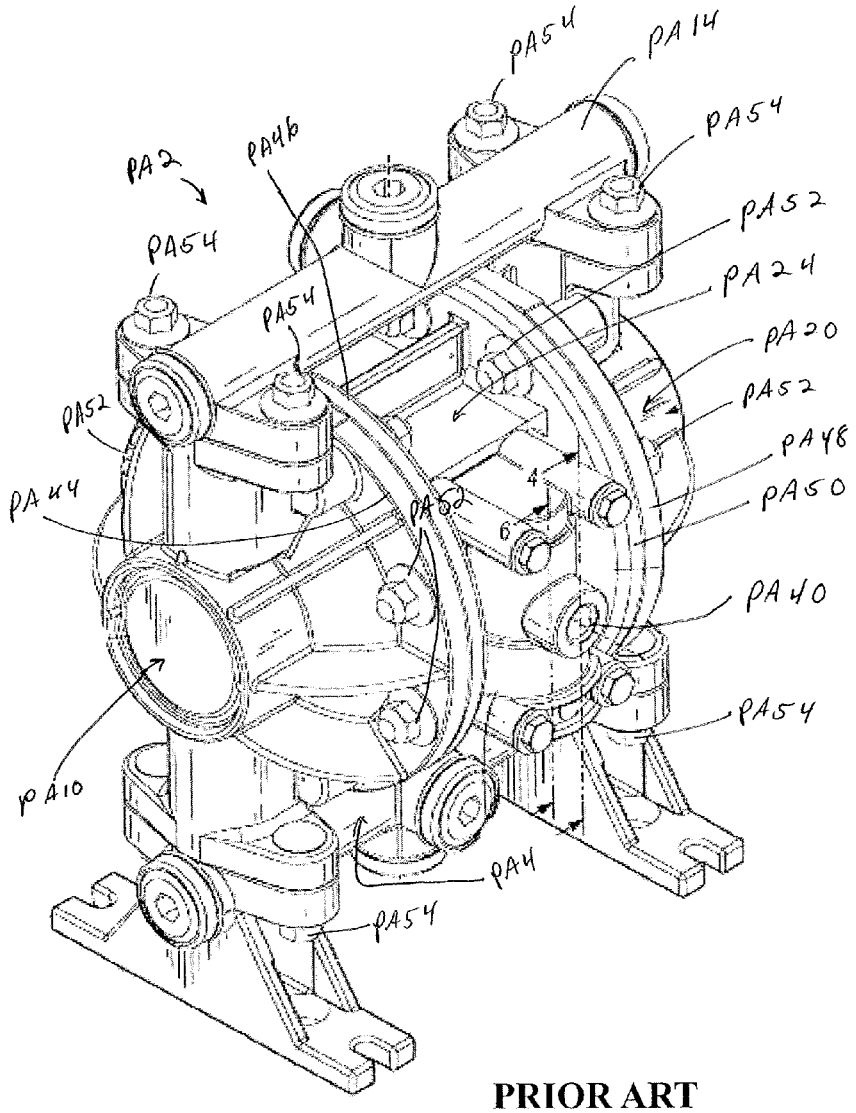
PRIOR ART FIG. 60
FIG. 60 is a perspective view of a PRIOR ART double diaphragm pump.
Figure 61:
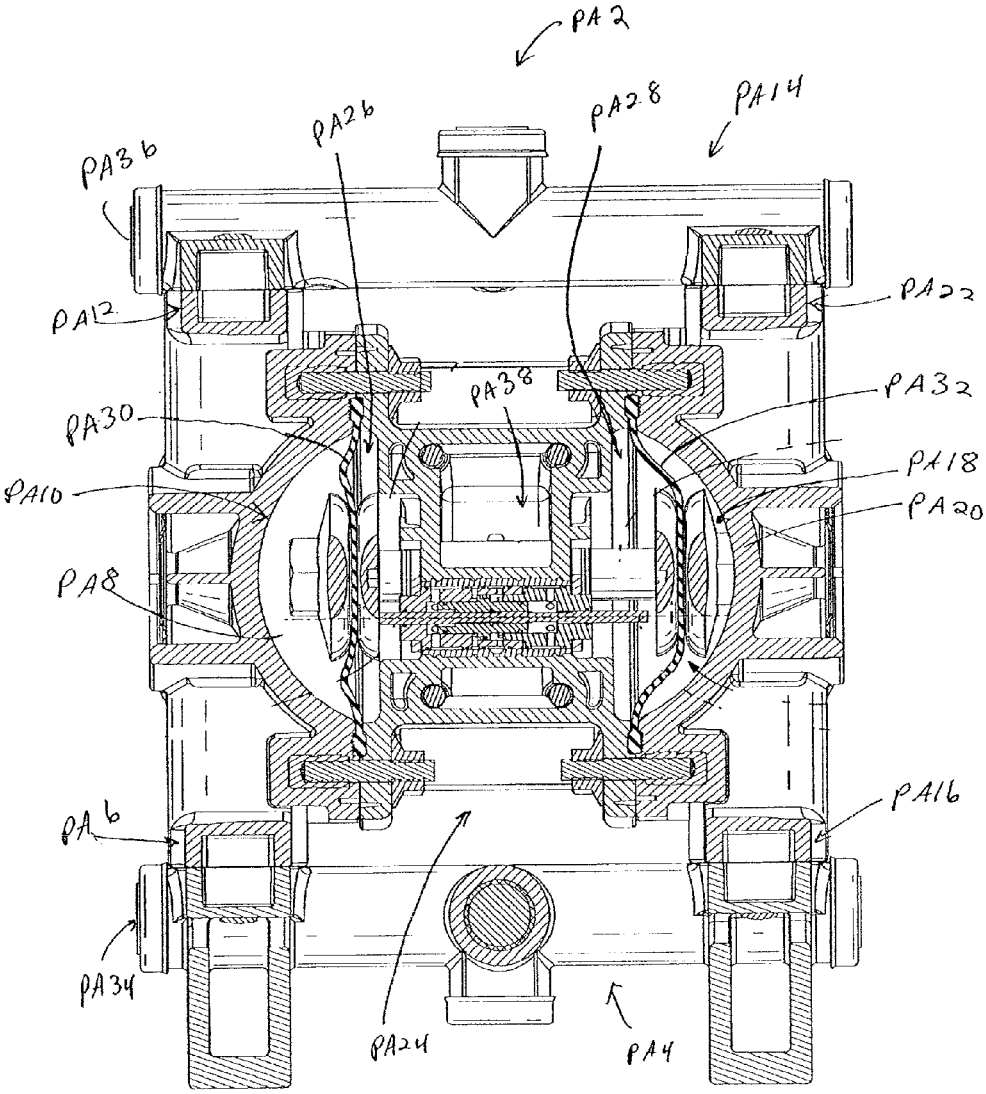
PRIOR ART FIG. 61
FIG. 61 is a front elevational cross-sectional view of the prior art double diaphragm pump of FIG. 60.

Similar to that discussed with respect to the prior art, fluid/air housings 8, 10 each contain a diaphragm separates the fluid chamber from the air chamber. Separate caps with a diaphragm located therebetween create the fluid and air chambers. Recall prior art caps PA44 and PA46, for example, were coupled together using bolts PA52. (See Prior Art, FIG. 60) Fluid/air housings 8, 10 each include fluid caps 44 (see FIG. 2)/air cap 46 and air cap 48 (see FIG. 9)/fluid cap 50, respectively. It is contemplated that in the embodiment shown in FIG. 1 and as discussed further herein, collars 40 and 42 threadingly couple fluid cap 44/air cap 46 and caps 48/50, respectively, together. Bolts are no longer necessary. Collars 40 and 42 (along with collars 30, 32 and 60, 62 for that matter) provide an even distribution of forces around the coupling in contrast to the localized force created at each bolt point. Indeed, these six threaded collars 30, 32, 40, 42, 60 and 62 take the place of possibly as many as 80 bolts and nuts employed in a conventional pump. Put another way, 80 bolts and nuts may be reduced to six collars. This translates into a substantial decrease in assembly time and cost.

Further shown in FIG. 1 are tubes 52 and 54 in fluid communication with fluid/air housing 8, 10, respectively, and outlet manifold 6. Tubes 52 and 54 are configured to receive fluid that is forced out of housings 8 and 10, respectively, and forced into manifold 6 and out of pump 2. As discussed further herein and similar to the configurations regarding manifold 4, valves 120, 122 (see FIG. 8) illustratively ball valves, sit between tube 52/54, and manifold 6, respectively, to allow fluid to pass from the tubes and into the manifold without that fluid washing back into either housings 8 or 10, respectively. Also similar to threaded collars 40, 42 are threaded collars 60 and 62 coupled to outlet manifold 6 as shown. Also similar to manifold 4 are outlet ports 56 and 58 that offer selective coupling to a hose or other conduit configured to receive the ejected fluid. It is again contemplated that a plug or a recirculation hose may be inserted into whichever outlet, either 56 or 58 that is intended to receive the hose.

Figure 2:
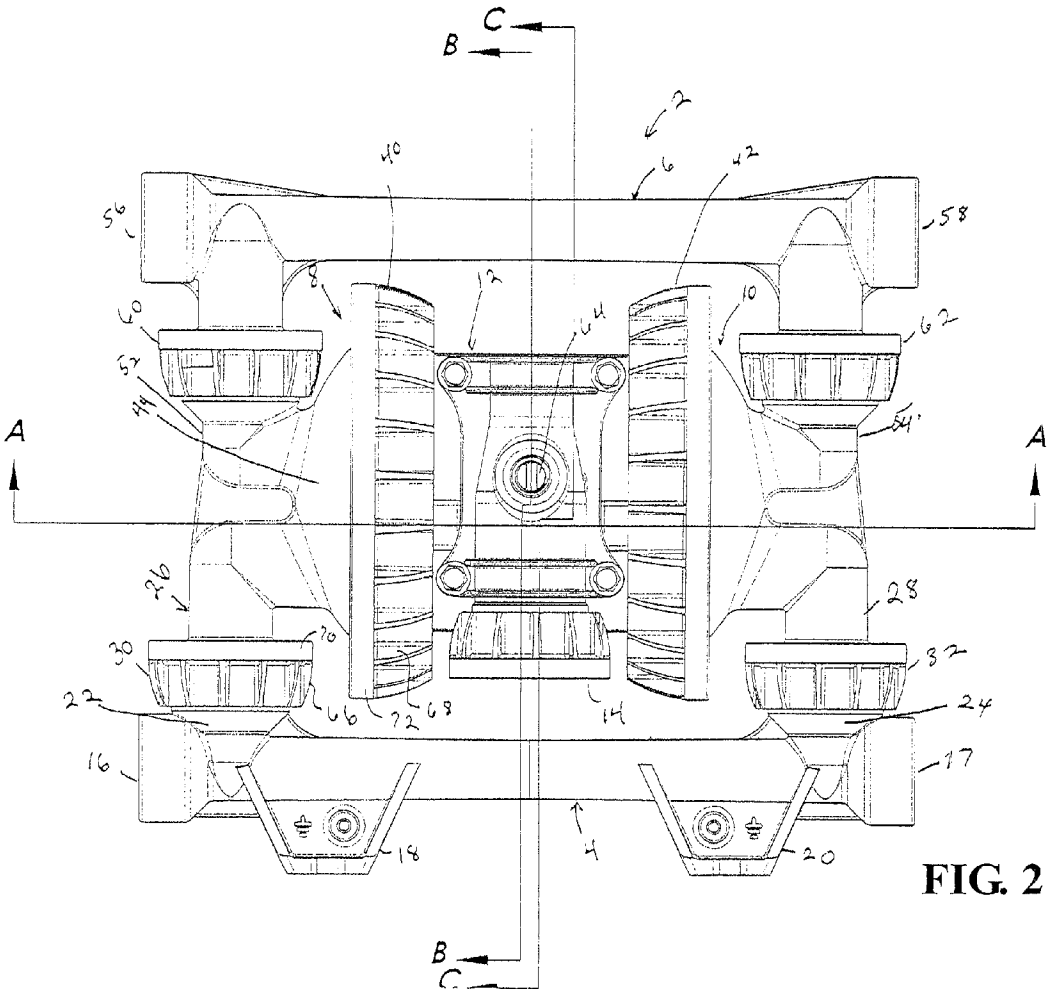
FIG. 2 is a front elevational view of the double diaphragm pump of FIG. 1.

A front elevational view of pump 2 is shown in FIG. 2. This view demonstrates the symmetry in the double diaphragm pump design and how each of housings 8 and 10 are used to draw fluid up from manifold 4 and in alternate fashion into tubes 26 and 28, then into housings 8 and 10, respectively, out through tubes 52 and 54, and ultimately into outlet manifold 6. This view further shows how primary components such as manifolds 4 and 6 and housings 8 and 10 all couple together by using threaded collars 30, 32, 40, 42, 60, and 62. Also shown are how collars 40 and 42 attach housings 8 and 10 to air valve assembly housing 12. Air inlet 64 is configured to couple to a pressurized air supply providing fluid into valve block assembly 14 and valve assembly 272 (see, e.g., FIG. 36) (excluding 148) inside air valve assembly housing 12 as discussed further herein. Each of the collars 30, 32, 40, 42, and 60 and 62 include a plurality of flanges, such as flange 66 shown on collar 32 (see also FIG. 11) and flange 68 on collar 42 (see also FIG. 10). These flanges partly provide a unique aesthetic with their curved profile and generally even spacing, as well as provide a gripping edge or surface to help rotate the collars to couple or decouple mating components. Flat surface 70 on collars 30 and 32 surrounds the valves provide a further aesthetic to the collar design.

Figure 3:
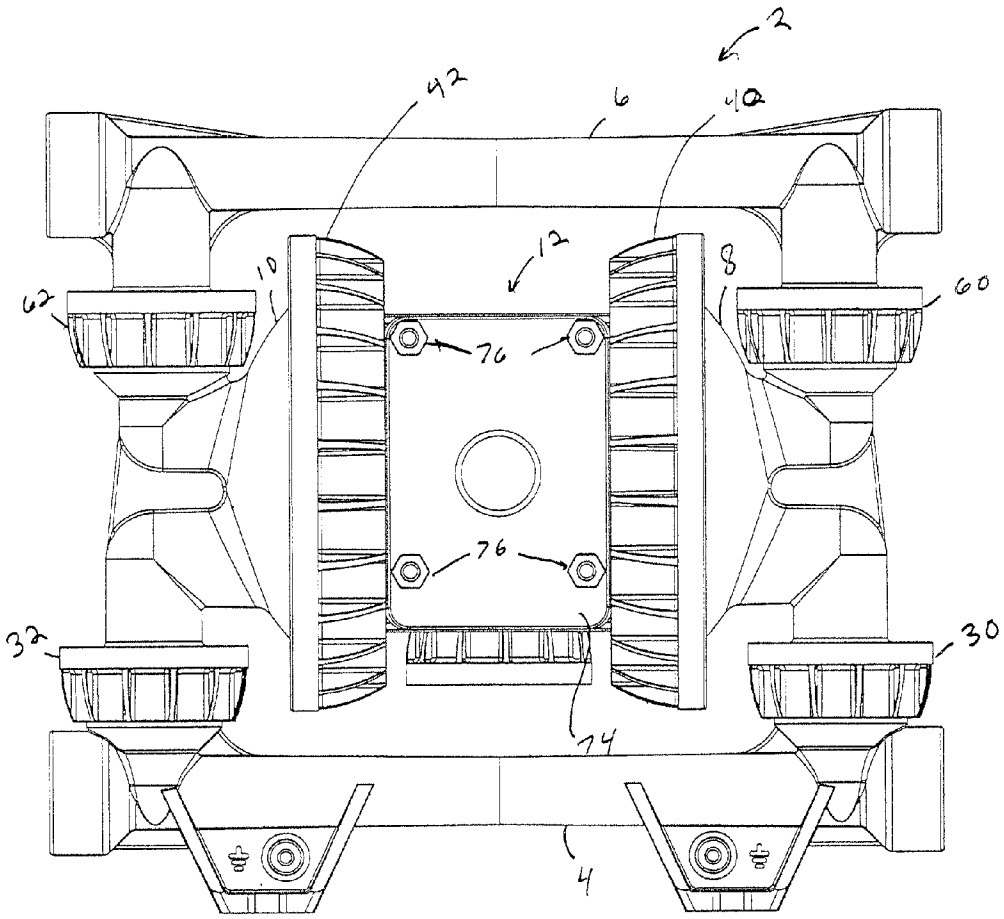
FIG. 3 is a rear elevational view of the double diaphragm pump of FIG. 1.

A rear elevational view of double diaphragm pump 2 is shown in FIG. 3. This view, like that of FIG. 2, depicts how threaded collars 30, 32, and 60 and 62 attach manifolds 4 and 6 to pump 2, respectively. Similarly, threaded collars 40 and 42 couple caps 8 and 10 to housing 12, respectively. Back plate 74 with fasteners 76 attach to housing 12.

Figure 4:
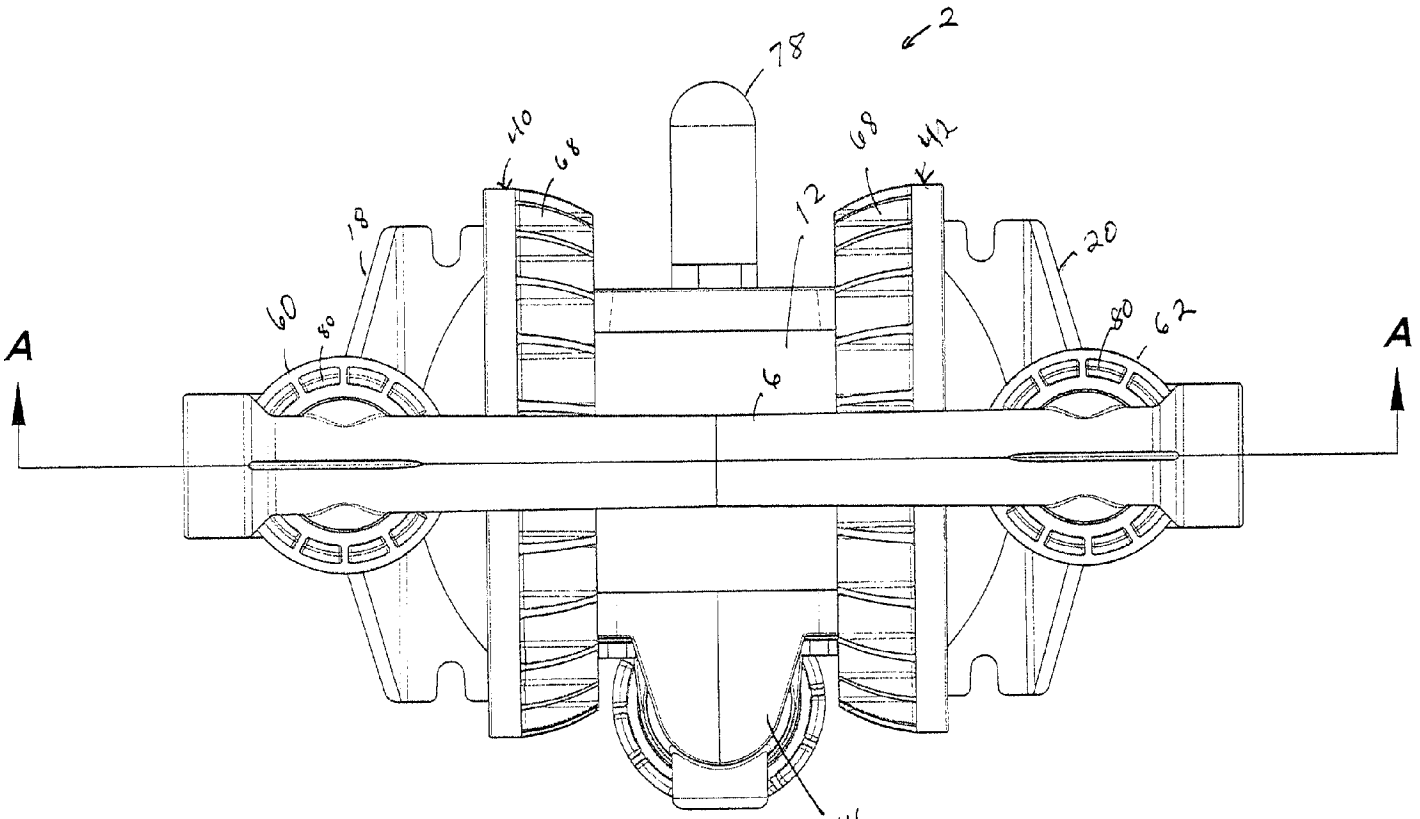
FIG. 4 is a top view of the double diaphragm pump of FIG. 1.

A top view of double diaphragm pump 2 is shown in FIG. 4. This view depicts outlet manifold 6 located above air valve assembly 12, collars 60 and 62, collars 40, 42, air valve assembly housing 12 and valve block assembly 14. Also shown in this view is muffler 78 that reduces the noise produced by air that exhausts from housing 12. Collars 60 and 62 illustratively include spaced recesses 80 formed at the top thereof. Recesses 80 save material on the construction of the collars. Flanges 68 form a portion of the periphery of threaded collars 40 and 42.

Figure 5:
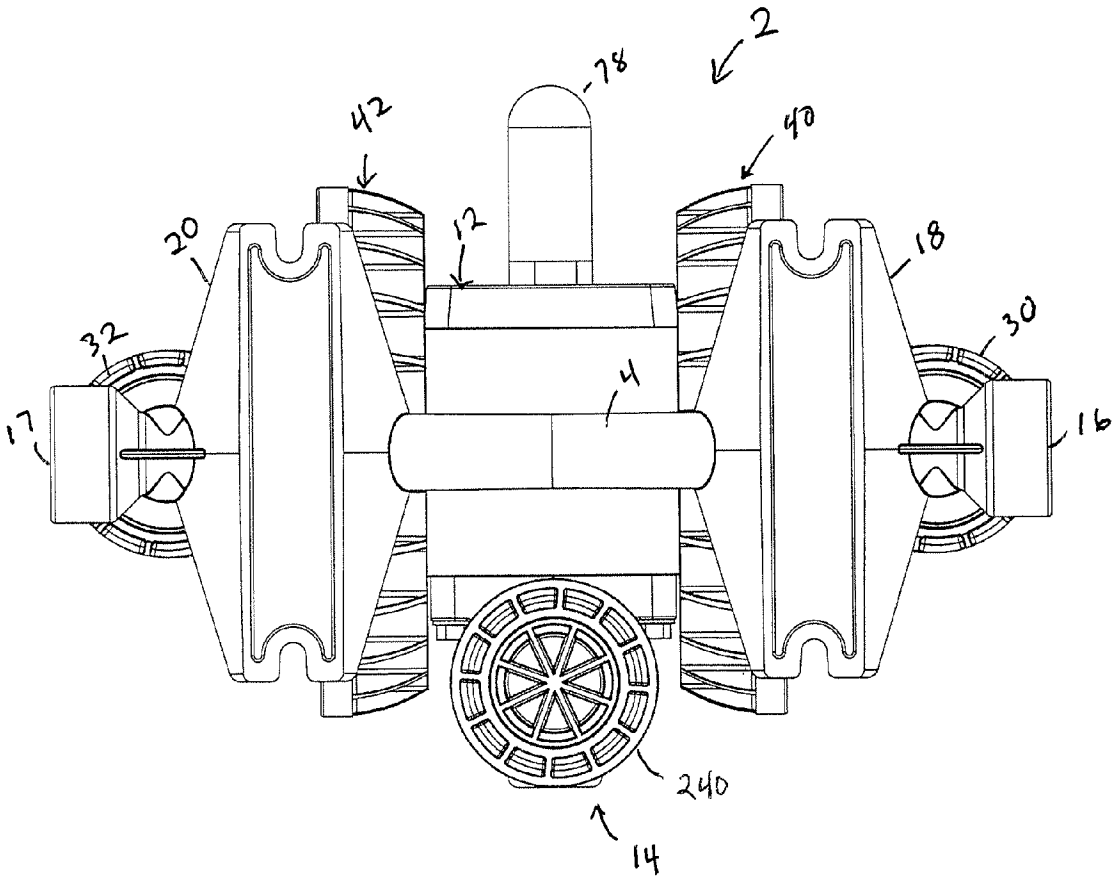
FIG. 5 is a bottom-upward looking view of the double diaphragm pump of FIG. 1.

A bottom-upward looking view of the double diaphragm pump 2 is shown in FIG. 5. Feet 18 and 20 are coupled to inlet manifold 4 to support pump 2. The underside of valve block 14 includes a valve cap 240. This view also shows the underside of threaded collars 40 and 42 and how in this illustrative embodiment their profile around their peripheries may be the same. Muffler 78 is also shown extending from the rear side of air valve assembly housing 12. The underside of threaded collars 30 and 32 are shown illustratively located above inlet ports 16 and 17.

Figure 6:
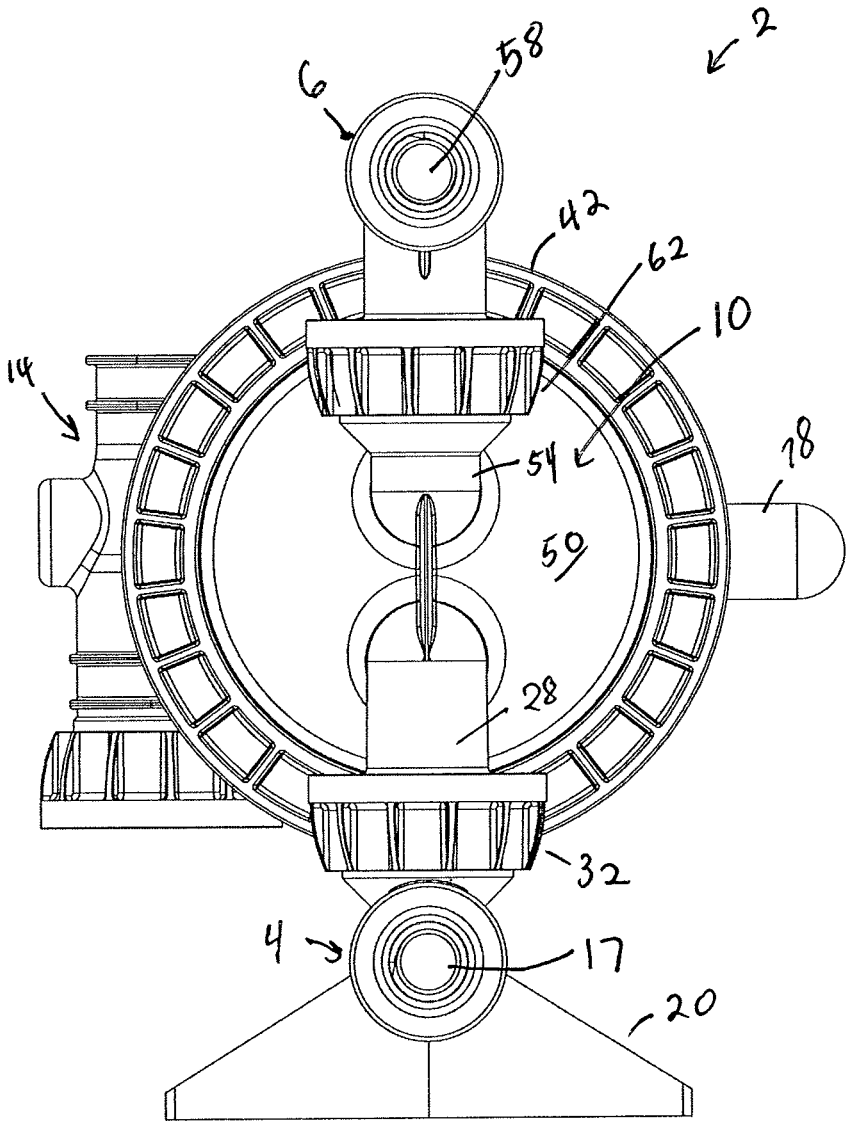
FIG. 6 is a right-side elevational view of the double diaphragm pump of FIG. 1.

A right-side elevational view of double diaphragm pump 2 is shown in FIG. 6. This view depicts how collar 42 concentrically surrounds cap 50. It is, thus, appreciable how collar 42 provides a distributed force around the entire periphery of fluid/air housing 10. Threaded collars 32 and 62 are also shown in this view demonstrating their relative positioning to each other and to collar 42. It is appreciated from this and other views how these threaded collars can be hand-tightened to assemble or disassemble the components of pump 2. This view further demonstrates how fluid may enter port 17 on inlet manifold 4, flow up through tube 28 and into the fluid chamber portion of housing 10 and then be ejected through tube 54 and out port 58 on outlet manifold 6. It is appreciated, however, that fluid can be supplied from either side of manifold 4 and still flow up into tube 28 (or 26 for that matter). The same is true for outlet manifold 6 where both tubes 52 and 54 may supply either outlet ports 56 or 58. This view also demonstrates how foot 20 supports the structures of pump 2. Lastly this view shows the positioning of valve block assembly 14 and muffler 78.

Figure 7:
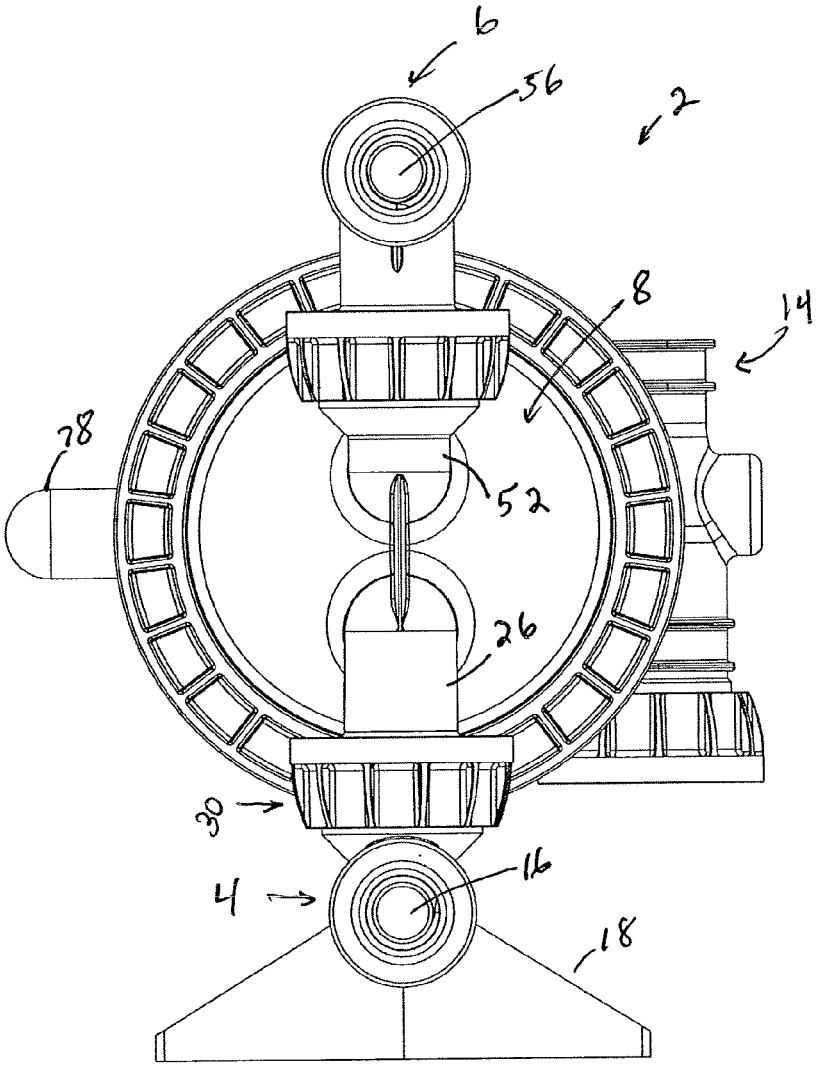
FIG. 7 is a left-side elevational view of the double diaphragm pump of FIG. 1.

A left-side elevational view of double diaphragm pump 2 is shown in FIG. 7. Like that shown in FIG. 6, foot 18 supports pump 2. Also similar to FIG. 6, a flow path starts from inlet port 16 of inlet manifold 4 in fluid communication with tube 26 and enters housing 8. Fluid may then be ejected from fluid chamber in housing 8 up through tube 52 and to outlet port 56 of outlet manifold 6. This view also shows the other side of valve block assembly 14 and muffler 78.

Figure 8:
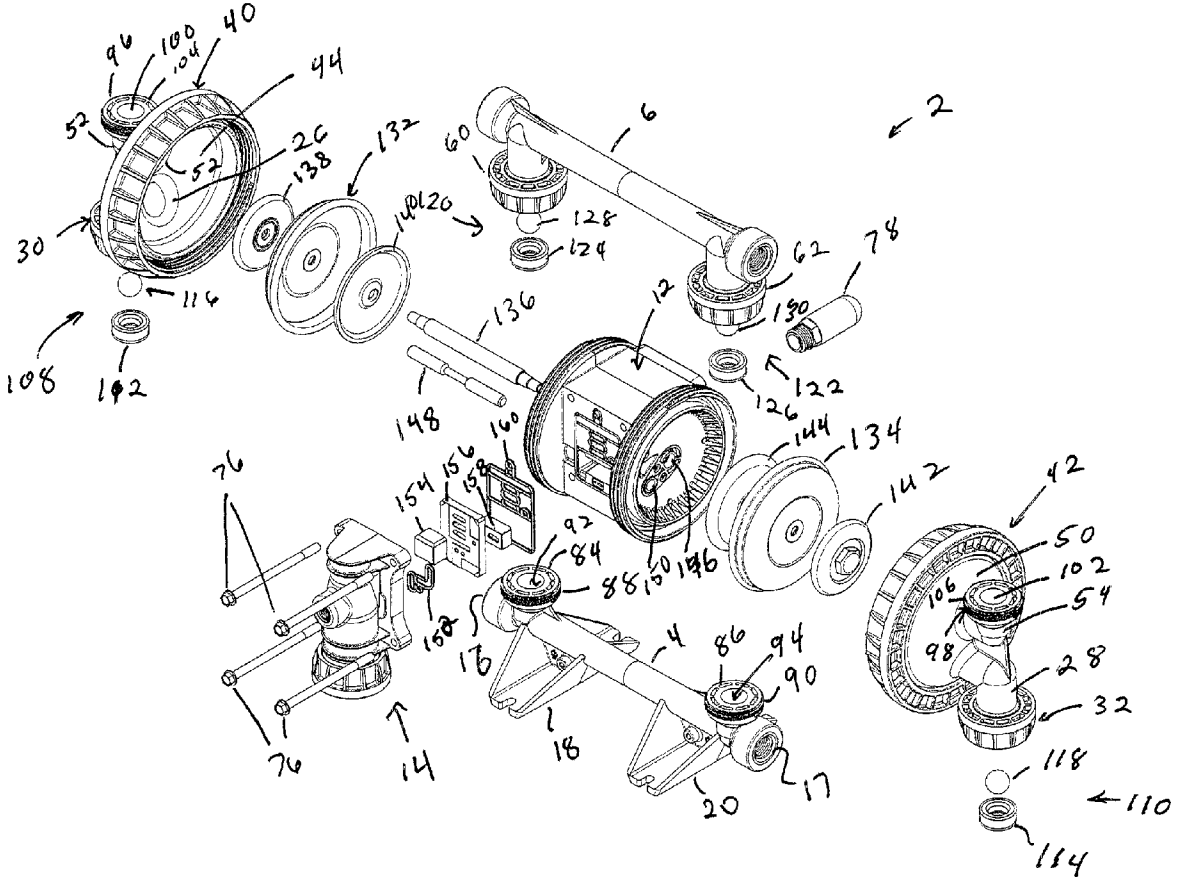
FIG. 8 is an exploded perspective view of the double diaphragm pump of FIG. 1.

An exploded perspective view of double diaphragm pump 2 is shown in FIG. 8. Manifold 4 supported by feet 18 and 20 include sealable inlet ports 16 and 17. Inlet couplings 84 and 86 illustratively extend upwardly from inlet manifold 4. Couplings 84 and 86 each illustratively includes threaded peripheries 88 and 90, respectively configured to engage threaded collars 30 and 32, respectively. Bores 92 and 94 are each in fluid communication with both the interior of manifold 4 and tubes 26 and 28, respectively. (See also FIG. 2.) Threaded collars 40 and 42 are rotatably coupled to fluid caps 44 and 50, respectively. In this illustrative embodiment, tubes 26 and 52 are formed in fluid cap 44 providing the fluid communication to manifolds 4 and 6, respectively. Likewise, tubes 28 and 54 are formed in fluid cap 50 for the same purpose. Tubes 26 and 28 illustratively include threaded collars 30 and 32, respectively, rotatably coupled thereon to engage inlet couplings 84 and 86, respectively. This means that instead of inserting bolts into flanges extending from tube 28 and coupling 90, for example, threaded collar 32 simply rotatably fastens the components together, not unlike a lid on a jar. This is the same with respect to threaded collar 30 and coupling 88. It is appreciated that the collars and couplings have complimentary threads to ensure proper engagement. It is further contemplated that the size of those threads may vary based on the particular requirements of the couplings. Tubes 52 and 54 include their own outlet couplings 96 and 98, respectively. These tubes also include respective outlet ports 100 and 102 to provide the fluid communication between the interior or chamber inside housings 8 and 10, respectively, and outlet manifold 6. Similar to the attachment previously described with respect to inlet manifold 4, couplings 96 and 98 include threaded peripheries that are complimentary to threads on outlet collars 60 and 62, respectively. And as previously discussed, collars 60 and 62 are rotatably coupled to manifold 6 and able to rotate themselves onto threaded peripheries 104 and 106, respectively, to attach manifold 6 to pump 2.

One of the reasons to removably attach manifolds 4 and 6 to pump 2 at the location shown is to access the check valves that selectively allow fluid to either enter or exit the pump. In this illustrative embodiment, the check valves are ball valves that, as discussed further herein, as well as previously, selectively allow fluid to pass. As shown in FIG. 8, check valve assemblies 108 and 110 each include seats 112 and 114 and balls 116 and 118, respectively. Seat 102 sits above inlet coupling 84 and about bore 92 to let fluid from inlet manifold 4 to enter and engage ball 116 pushing it out of the way so fluid can pass into tube 26 and ultimately into housing 8. The configuration of the cavity where ball 116 sits allows limited movement of ball 116 sitting from seat 112 and dictates the directional flow of fluid. In this case, fluid coming up through bore 92 pushes on ball 116 which has enough room in cavity 166 to push the ball out of the way allowing fluid to effectively pass through and into tube 26. Once fluid ceases traveling upward, however, ball 116 sits back onto seat 112 effectively plugging bore 92 so no fluid may escape back downward into manifold 4. Indeed the fluid pushes the ball further against seat 112 creating an even more effective seal. This is how fluid can be moved in one direction without it able to flow back from where it came. The same principle is applied to seat 114, ball 118, bore 94, and tube 28 with respect to housing 10. Furthermore, these valves also exist at the attachment points of outlet manifold 6. Check valve assemblies 120 and 122 include seats 124 and 126, respectively, as well as balls 128 and 130, respectively. The principles discussed with respect to check valve 108 and 110 apply to valves 120, 122 as well. For example, fluid is pumped out of housing 8 through tube 52 and out through bore 100. Seat 124 sits on top of outlet coupling 96 and about bore 100 so fluid may pass through and based on the configuration of cavity 186 that ball 128 sits in, the fluid pushes ball 128 out of the way and enters outlet manifold 6. But just as previously described, if any of that fluid was to try to wash back through bore 100 and tube 52, it would push downward on ball 128 against seat 124 effectively sealing off bore 100. Again, the more fluid pushing back against ball 128, means the tighter the seal between ball 128 and seat 124. It is appreciated that ball 130 and seat 126 of valve 122 operates in the same manner. This exploded view also introduces diaphragms 132 and 134 that are coupled together via diaphragm rod 36. Illustratively, a diaphragm nut 138 sandwiches diaphragm 132 between itself and a backup washer 140 and all secured together by an illustratively threaded end of diaphragm rod 136. Likewise, diaphragm nut 142 sandwiches diaphragm 134 between itself and backup washer 144 all secured by another illustratively threaded end of diaphragm rod 136. A bore 146 extends through air valve assembly housing 12 connecting the two diaphragms together. It is appreciated that diaphragm rod 136 is movable within bore 146 and it is the valving system, discussed further herein, that moves the diaphragms from one side to the other.

Diaphragms 132 and 134 are positioned inside fluid/air housing 8 and 10, respectively. Each housing, as discussed further herein, is split up into fluid and air chambers. The air chamber side is employed to move the diaphragm which simultaneously pushes out and draws in the fluid. The fluid chamber is the portion that the fluid is drawn into and pushed out of to create the "pumping" action. Threaded collars 40 and 42 surround the periphery of housings 8 and 10 to provide both easier assembly and access to this dual-chambered space. As further discussed herein, a trip rod 148, shorter in length than diaphragm rod 136, is movably located within a bore 150 of air valve assembly housing 12. Trip rod 148 is selectively engageable with the backup washers to affect the direction of air flow to either one air chamber or the other to, thus, move the diaphragms.

This view further shows valve block assembly 14 sandwiching pilot track gasket 152, D-valve insert 154, D-valve plate 156, pilot D-valve 158, and major valve track gasket 160 between itself and air valve assembly housing 12. Fasteners 76 secure the connection between valve block assembly 14 and air valve assembly 12. Also shown is muffler 78 with a threaded end that is removably attachable to housing 12 as well.

Figure 9:
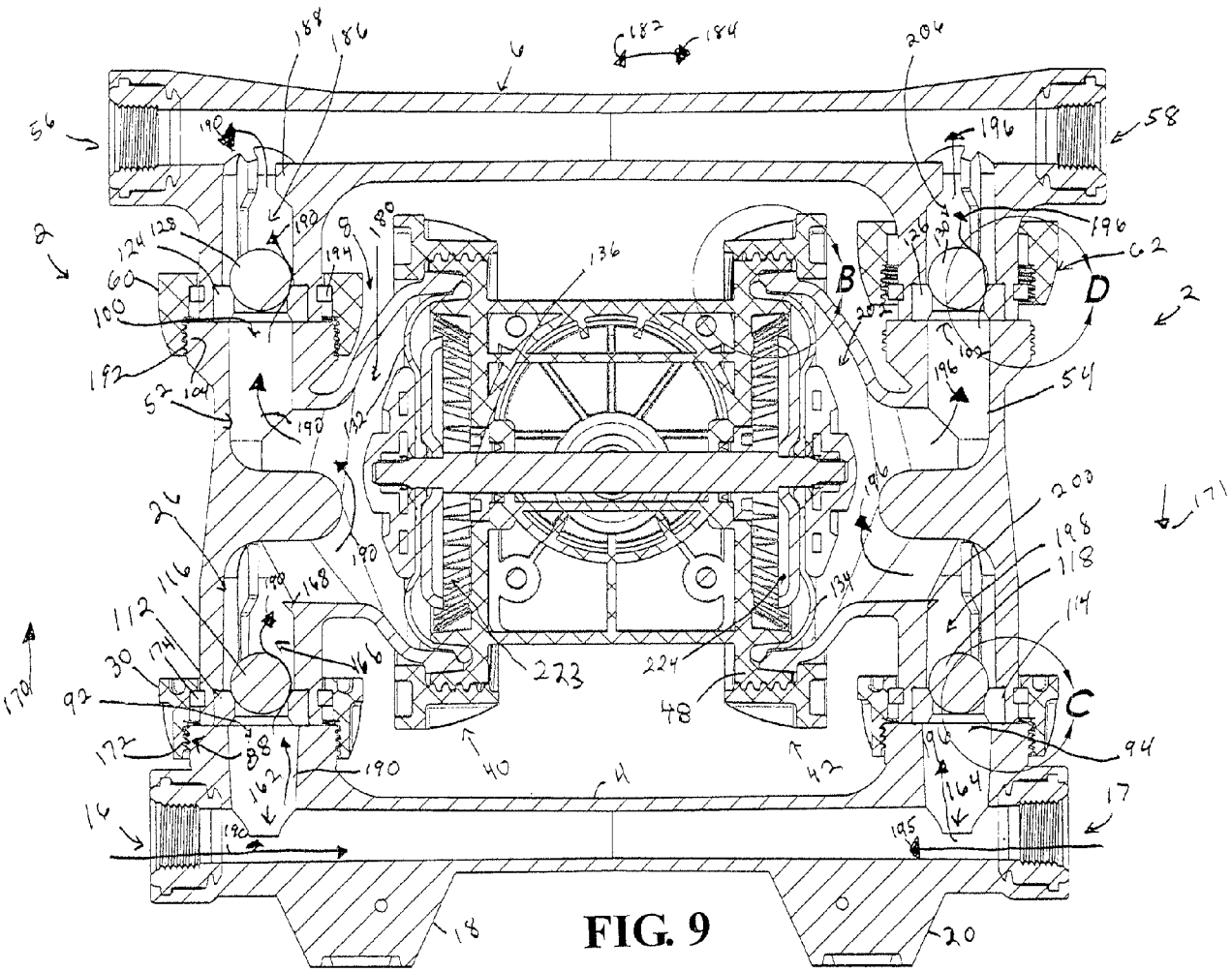
FIG. 9 is a front elevational cross-sectional view of the double diaphragm pump.

A front elevational cross-sectional view of double diaphragm pump 2 is shown in FIG. 9. This view shows the internal structures of the pump. Inlet ports 16 and 17 of inlet manifold 4 are illustratively threaded to accept either a hose or a plug. Feet 18 and 20 are shown supporting manifold 4 which is essentially a hollow tube with passage ways 162 and 164 disposed therein leading to bores 92 and 94, respectively. Seat 112 is shown supporting ball 116 and cavity 166 which is part of tube 26. Tab 168 is employed to limit movement of ball 116 in direction 170 to open up bore 190 with tube 26 allowing fluid to flow from manifold 4 up into tube 26. But as previously discussed, once fluid is in tube 26 it cannot escape back down into passage 162 because as shown in this view ball 116 blocks such a pathway. Threaded collar 30 is shown with threads 172 that mate with threaded periphery 88. A retaining ring 174 is configured to engage both the outer periphery of tube 26 and threaded collar 30 to retain threaded collar 30 on tube 26.

Tube 26 is in fluid communication with fluid chamber 180 inside housing 8. When diaphragm 132 is pulled in direction 184 it causes fluid to be drawn up from manifold 4, through passage 162, bore 92, and seat 112 past ball 116, and up through tube 26 and into fluid chamber 180. Conversely, when diaphragm 132 is pushed in direction 182, fluid is pushed out through tube 52, passage 100, seat 124, pushing ball 128 out of the way and entering passageway 186 and into outlet manifold 6 to exit through either outlet ports 56 or 58. This view also shows how the force of the fluid pushes ball 128 into passage 186 limited by illustrative tab 188 and then up into outlet manifold 6. As discussed previously, if any of the fluid attempts to wash backward, it pushes down on ball 128 into seat 124 forming a seal to prevent that from happening. At the same time, the reason the fluid pushes up against ball 128 to exit to outlet manifold 6 under the pressure of diaphragm 132 is, as previously discussed, ball 116 and tube 26 prevents any fluid from washing back into inlet manifold 4. In other words, upon the force of pressure, out past ball 128 is the only place the fluid may go. Directional arrows 190 demonstrate an illustrative flow path of the fluid pumping through this side of pump 2. Similar to threaded collar 30, collar 60 includes threads 192 that correspond to threaded periphery 104. In addition, a retaining ring 194 engages both collar 60 and manifold 6 to illustratively rotatably retain collar 60 thereon. On the other side of pump 2, fluid can enter either from inlet port 16 or 17 identified by directional arrows 190 or 196 up through passage 164, passageway 94, through seat 114 pushing ball 118 out of the way to pass through cavity 198 where the ball is stopped via tab 200 (like tab 168), and flow into fluid chamber 202. This occurs when diaphragm 134 is being pulled in direction 182 (like a plunger sucking up fluid). Then, when diaphragm 134 is pushed into direction 184, fluid moving in directional arrow 196 is pushed up through tube 54 and bore 102, through seat 126 pushing ball 130 out of the way, through passageway 206 and out into manifold 6 to exit the same through either outlet ports 56 or 58. It is appreciated how the pump operates where one of the diaphragms is pushed in direction 182 to push fluid up and out into outlet manifold 6, while the other diaphragm is being pulled in that same direction drawing fluid up from the inlet manifold and into the fluid chamber.

Then the reverse occurs where the diaphragm moves in the opposite direction 184 which pushes the previously pulled diaphragm forcing that fluid just drawn in to exit up into outlet manifold 6 where the other diaphragm that had just pushed fluid out is now being pulled in direction 184 drawing more fluid up from inlet manifold 4. In other words, moving the diaphragm rod back and forth alternatively pushes and pulls the diaphragms to draw fluid in then push it out while the other diaphragm pushing fluid out and then drawing fluid in, as previously discussed.

Figure 10:
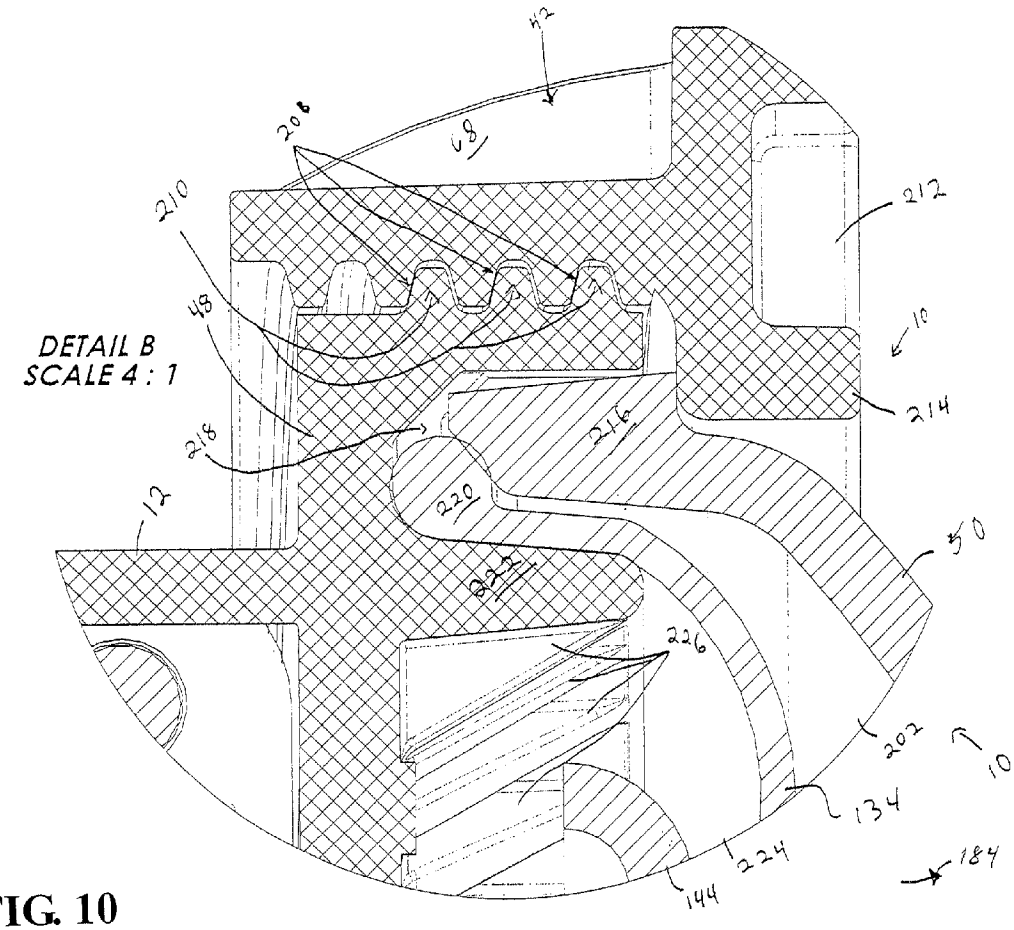
FIG. 10 is a cross-sectional detailed view of section B of the double diaphragm pump shown in FIG. 9.

A cross-sectional detailed view of section b of double diaphragm pump 2 is shown in FIG. 10. This view demonstrates how threaded collar 42 (and 40 for that matter) engages pump 2 to hold housing 10 together. As shown, collar 42 includes thread 208 that correspond to threads 210 illustratively formed on cap 48. As shown in this embodiment, air cap 48 (as well as air cap 46 on the other side) is part of housing 12. Collar 42 also includes flange 68 and recess 212 formed in collar head 214. Fluid cap 50 includes its own flange 216 configured to fit into cavity 218 and held in place by collar head 214 of collar 42. Diaphragm 134 is held into place by its periphery 220, flange 216 and edge 222 as illustratively shown. This effectively separates the interior of housing 10 into fluid chamber 202 and air chamber 224. Also shown in this view is the edge of backup washer 144. As part of air chamber 224 (as well as air chamber 223) a plurality of ribs 226 illustratively located as shown strengthens the tie between edge 222 and the base of this chamber and against diaphragm 134 to push it in direction 184.

Figure 11:
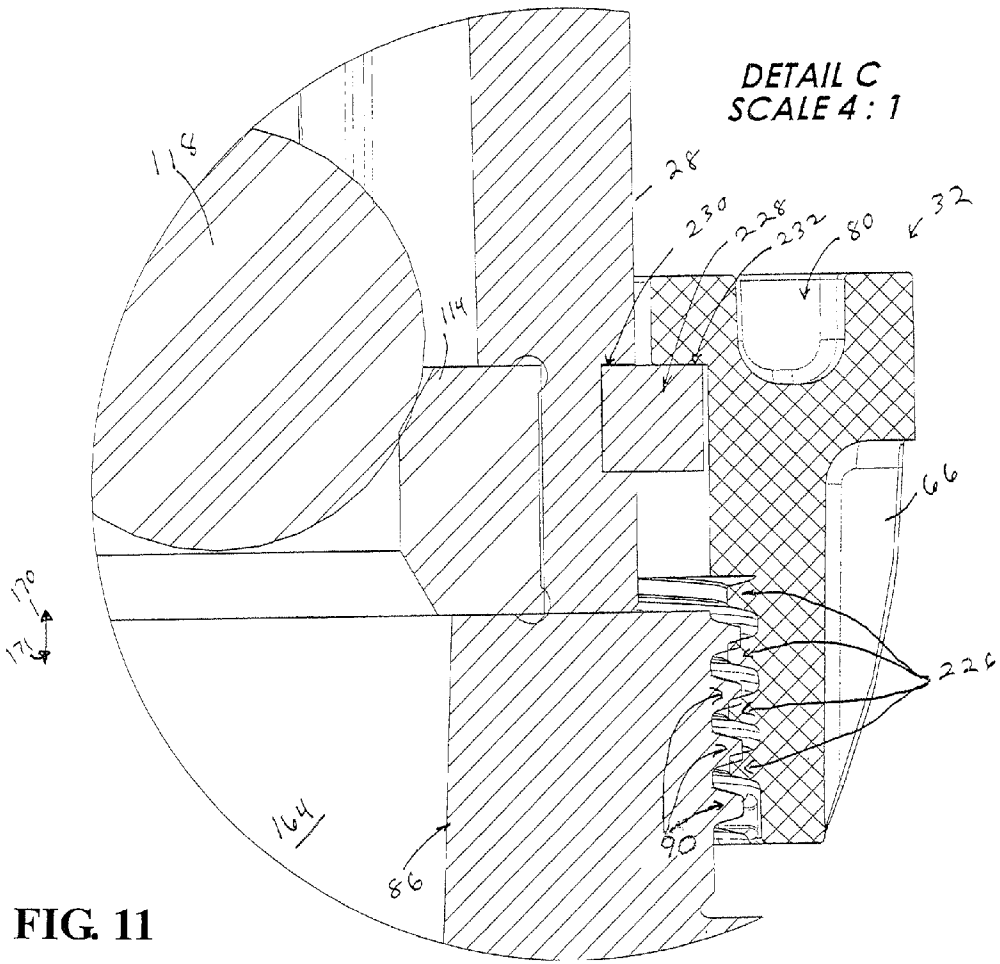
FIG. 11 is a cross-sectional detailed view of detail C shown in FIG. 9.

A cross-sectional detailed view of a portion of tube 28, threaded collar 32 and inlet coupling 86 is shown in FIG. 11. Threaded collar 32 (as well as threaded collar 30 for that matter) attaches manifold 4 onto pump 2. As shown, collar 32 includes threads 226 (similar to threads 172 on collar 30) that engage corresponding threaded periphery 90 on inlet coupling 86. As previously discussed with respect to FIGS. 8 and 9, collar 32 is configured to rotate to engage and hold threaded periphery 90 and hence inlet manifold 4. In an illustrative embodiment, a retaining ring 228 (similar to retaining ring 174 with respect to collar 30) fits into a recess 230 formed in tube 28. Retaining ring 228 is engageable with edge 232 of collar 32 to prevent the same from sliding off of tube 28 when not coupled to cap 10. Recess 80 is similar to that shown on collars 60 and 62 (see also FIG. 4) and flange 66 on collar 30 (see also FIG. 4). Ball 118 provides a seal about seat 114 that allows any fluid coming up from passageway 164 depositing into tube 28 cannot flow backwards. As previously discussed, fluid attempting to move back in direction 171 pushes ball 18 against seat 114 preventing any fluid from flowing back into inlet manifold 4.

Figure 12:
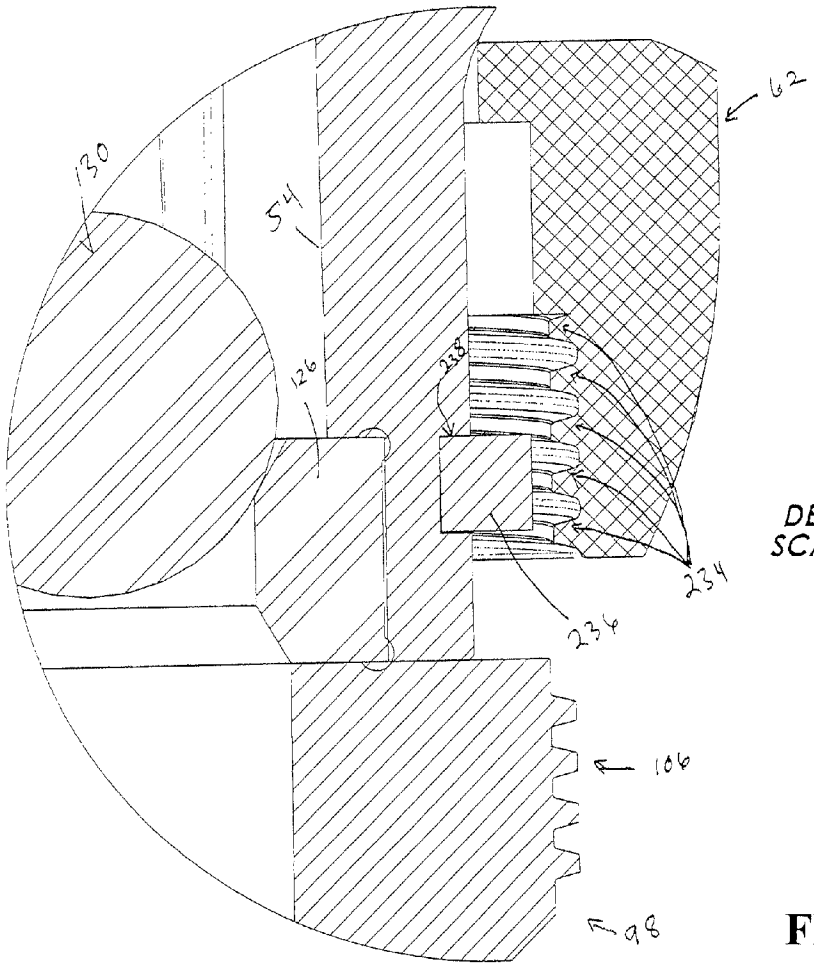
FIG. 12 is a detailed cross-sectional view of detail D shown in FIG. 9.

Another detailed cross-sectional view of threaded collar 62 is shown in FIG. 12. Though describing a collar similar as collars 30 and 32, this view shows threaded collar 62 unscrewed from threaded periphery 106 on outlet coupling 98. Threaded collar 62 includes threads 234 formed therein as illustratively shown raised and separated from threaded periphery 106. A retaining ring 236, like ring 228, is illustratively placed in recess 238 to keep collar 62 from sliding downward from tube 54. This view is similar to the view in FIG. 11 which includes ball 130 seated in seat 126. In contrast to the valves located between pump 2 and inlet manifold 4, these valves allow fluid to escape to outlet manifold 6 but not drain back down. It is also appreciated how the threaded coupling between the manifold and the pump allows convenient and relatively quick connect or disconnect and an even distribution of coupling force in contrast to threaded bolts periodically disposed through the manifold.

Figure 13:
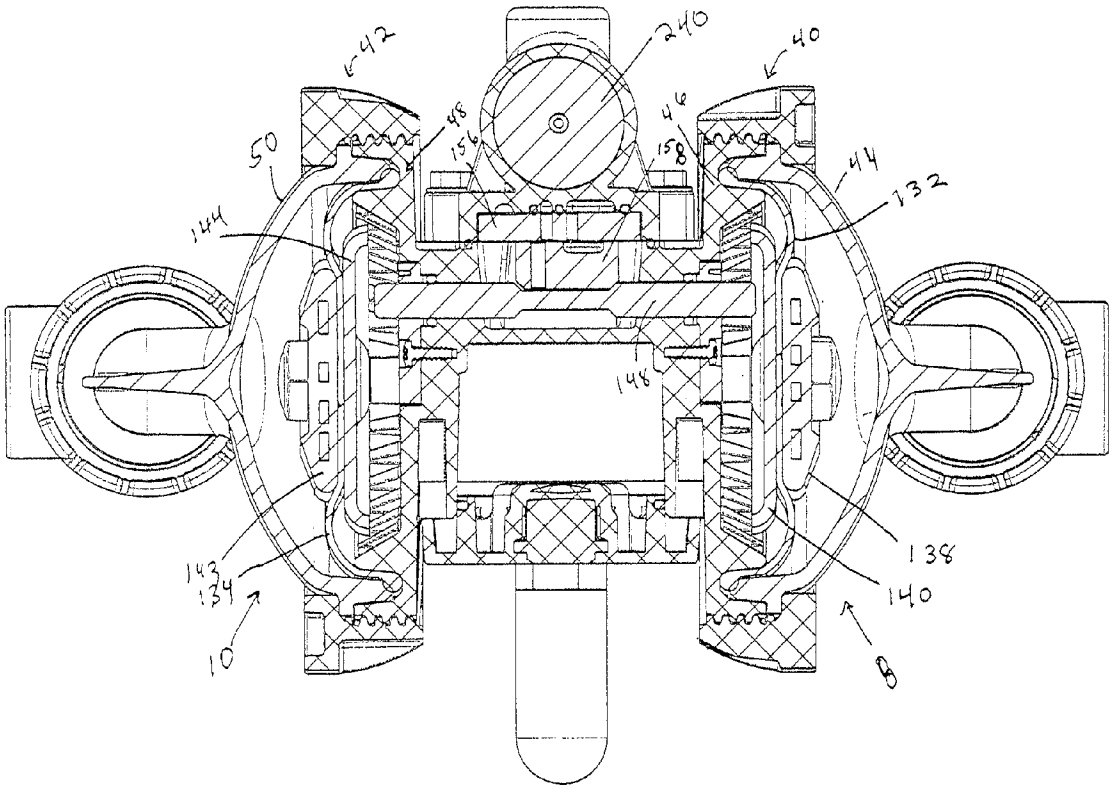
FIG. 13 is a underside cross-sectional view of the double diaphragm pump taken along lines A-A of FIG. 4.
Figure 14:
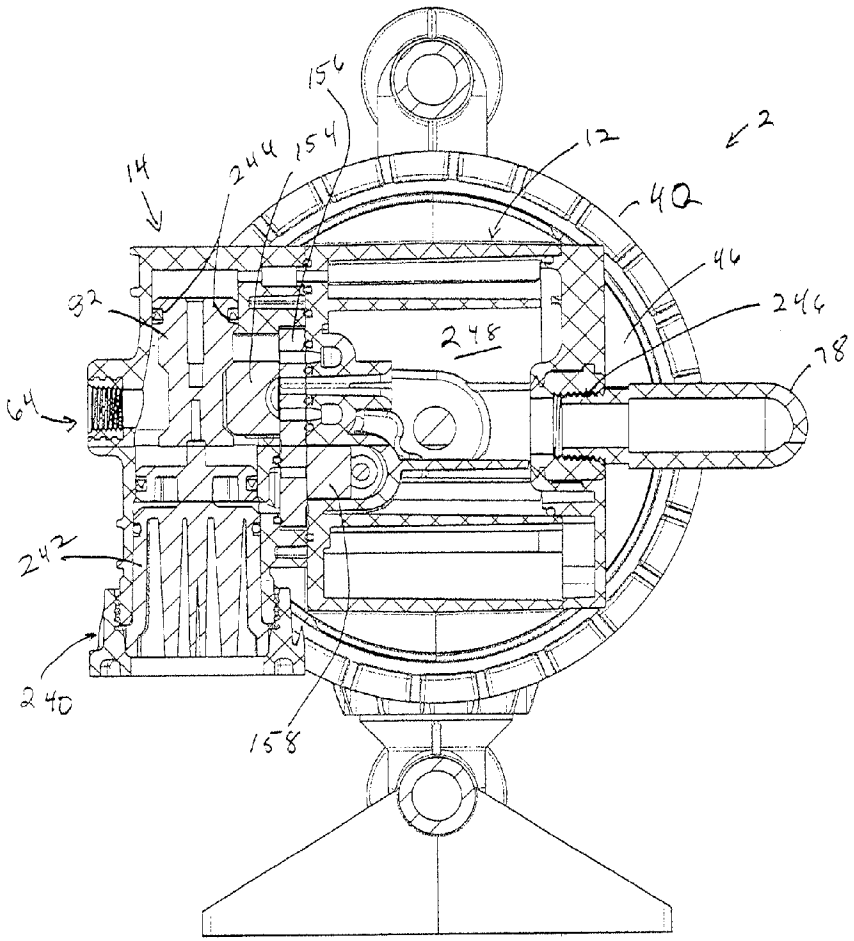
FIG. 14 is a side cross-sectional view of the double diaphragm pump taken along lines B-B of FIG. 4.
Figure 15:
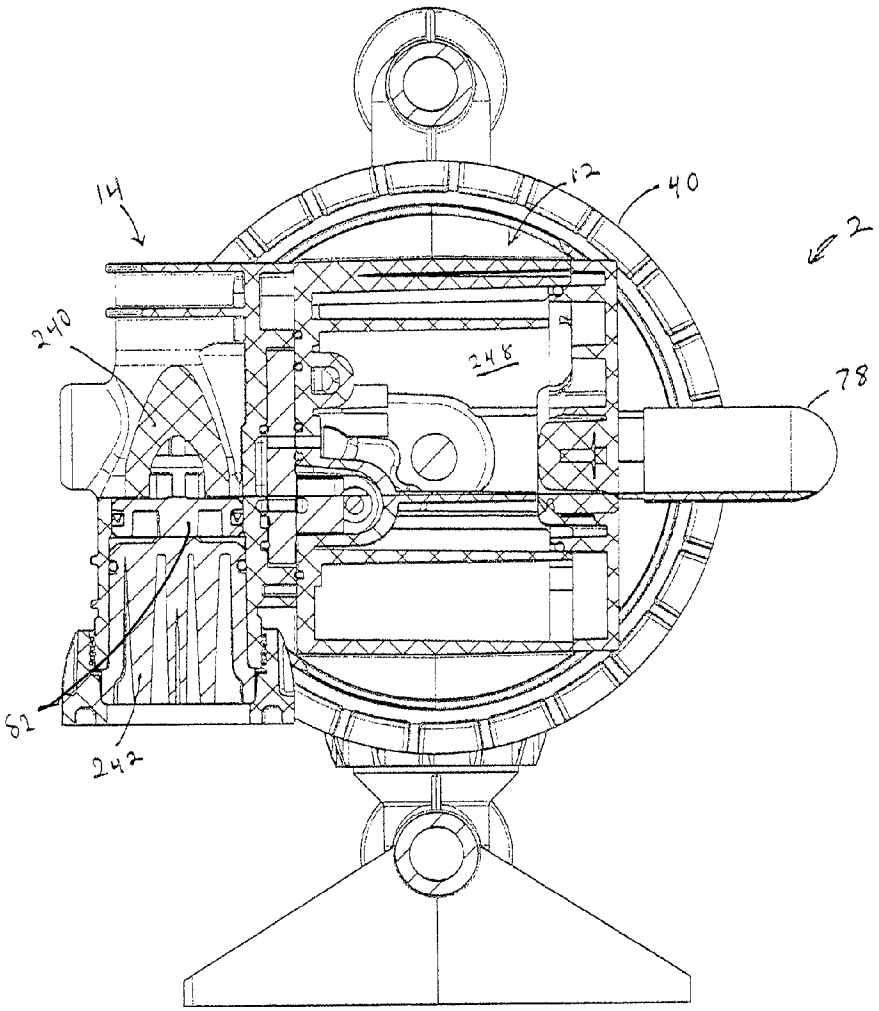
FIG. 15 is another side cross-sectional view of the taken along lines C-C of FIG. 4.

FIGS. 13 through 15 are various cross-sectional views taken along various lines from FIG. 2 showing several of the internal components of pump 2. For example, a top cross-sectional view along lines A-A of FIG. 2 in FIG. 13 further illustrates how threaded collars 40 and 42 couple to fluid caps 44, air cap 46, and 48, 50, respectively. It is appreciated that collar 40 couples fluid cap 44 and air cap 46 together to form housing 8 and collar 42 couple air cap 48 and fluid cap 50 to form housing 10. The view in FIG. 13 further demonstrates how collars 40 and 42 rotate to provide an even threaded attachment force around the cap portions to secure the housings together. Several of the internal components including diaphragms 132 and 134, diaphragm nuts 138 and 142, backup washers 140 and 144, valve block 240, pilot D-valve 158, D-valve plate 156, and trip rod 148 are also shown.

The side cross-sectional view taken along lines B-B of FIG. 2 shown in FIG. 14 further demonstrate how collar 40 encircles air caps 46 and 44. This view also shows several the internal structures of valve block assembly 14 and air valve assembly housing 12. For example, in valve block assembly 14, spool 82 is illustratively shown located above major valve plug 242 and valve cap 240. Seals 244 cordon off certain air chambers from others, the further descriptions of which shall be discussed further herein. Air inlet 64 is configured to receive pressurized fluid from an outside source pass through assembly 14 and housing 12 to make pump 2 function. That air is then exhausted to outlet 246 coupled to muffler 78. Illustratively, exhaust may be vented to the atmosphere or routed elsewhere via plumbing. Also shown in this view is D-valve insert 154, D-valve plate 156 and pilot D-valve 158. Air chamber 248 receives air before exhausted through outlet 246 and muffler 78.

Another cross-sectional view of pump 2 similar to that shown in FIG. 14 is taken along line c-c of FIG. 2 shown in FIG. 15. This view depicts a portion of valve block 240 and valve block assembly 14 with major valve plug 242 and major valve spool 82.

Figure 16:
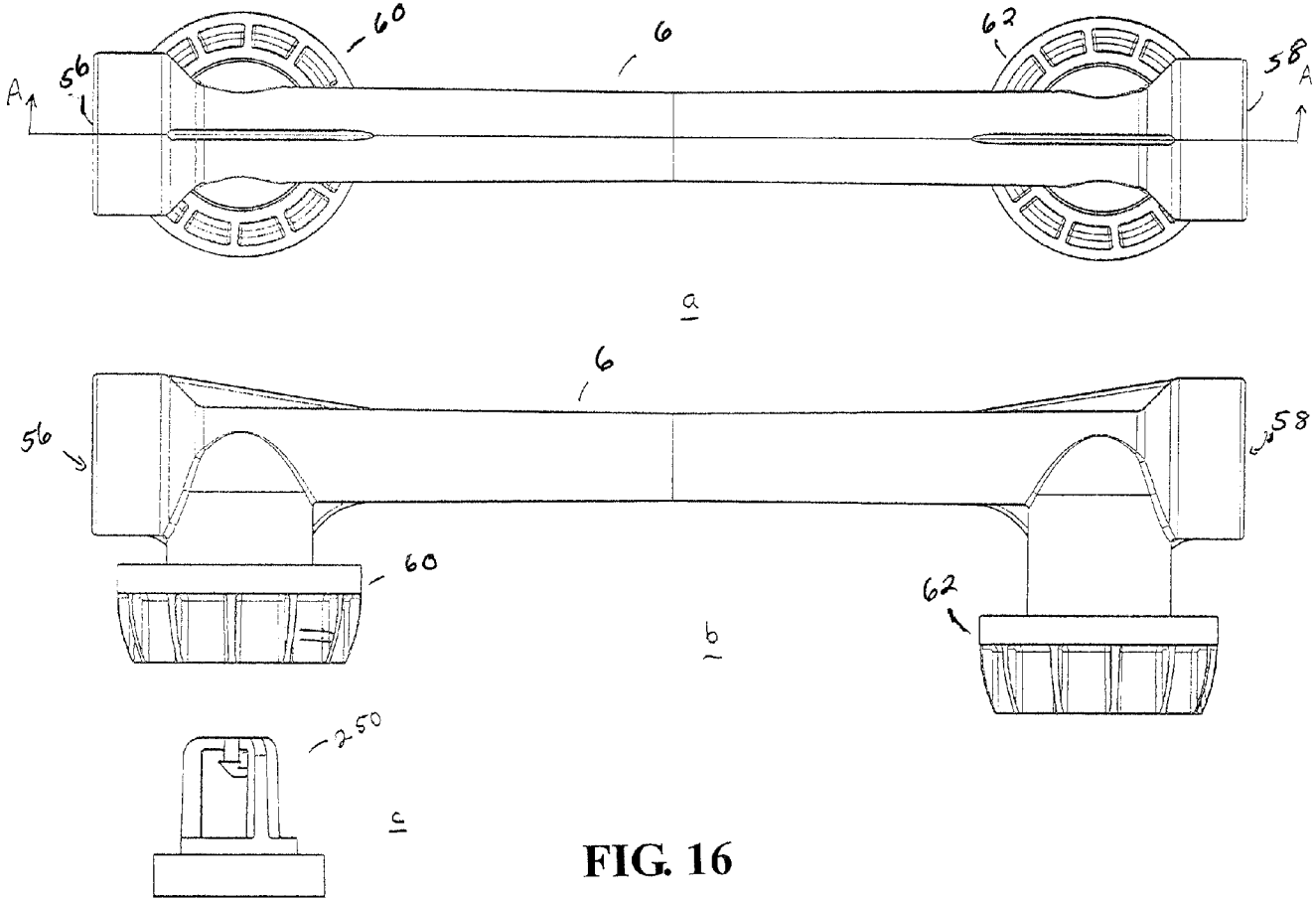
FIGS. 16*a-c* include top and side views of an outlet manifold; and c being a side view of a base and ball cage portion of a valve.

Top and side views of outlet manifold 4 are shown in FIGS. 16*a* and *b*, and a ball cage seat 250 is shown in FIG. 16*c*. As previously discussed, outlet manifold 6 includes inlet ports 56 and 58 with threaded collars 60 and 62 rotatably coupled thereto. This manifold, however, includes another embodiment of a coupling system between the manifold and a rotatable collar. Ball cage seat 250 is another illustrative component of the valving structures located at the connection between the manifolds and the rest of the pump. In this case ball cage seat 250 is designed to hold a ball and allow limited movement, therein.

A front elevational cross-sectional view of outlet manifold 6 is shown in FIG. 17*a* and a cross-sectional view of ball cage seat 250 is shown in FIG. 17*b*. The view in FIG. 17*a* depicts the interior of manifold 6. Cavity 252 is configured to receive at least a portion of cage seat 250. A cage portion 254, base portion 256 and channel 258 make up ball cage seat 250. This configuration an end flange 260 depending from outlet manifold 6 engages channel 258 to allow collar 62 (or collar 60 for that matter) to rotatably couple to manifold 6. This prevents the collars 60 and 62 from falling off outlet manifold 6 even if not yet threadably attached to tubes 52 and 54, respectively.

Figure 17:
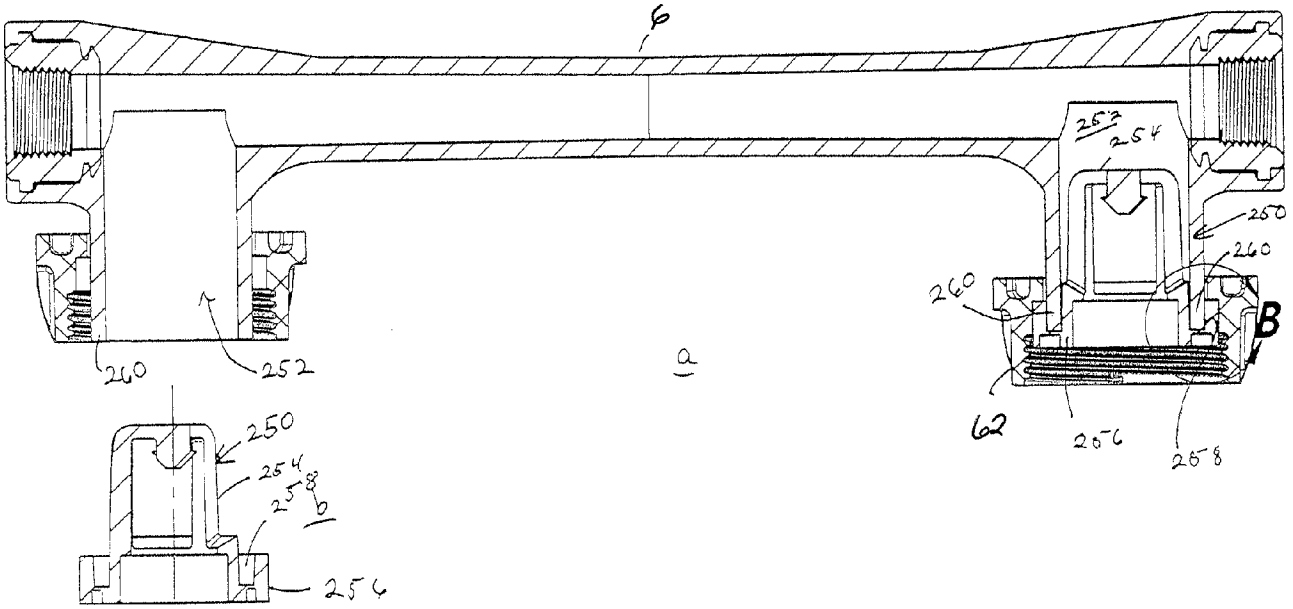
FIGS. 17*a-b* is a front elevational cross-sectional view of the outlet manifold taken along lines A-A of FIG. 16*a*, and b is a cross-sectional view of the base and ball cage portion of a valve of FIG. 18*c;*
Figure 18:
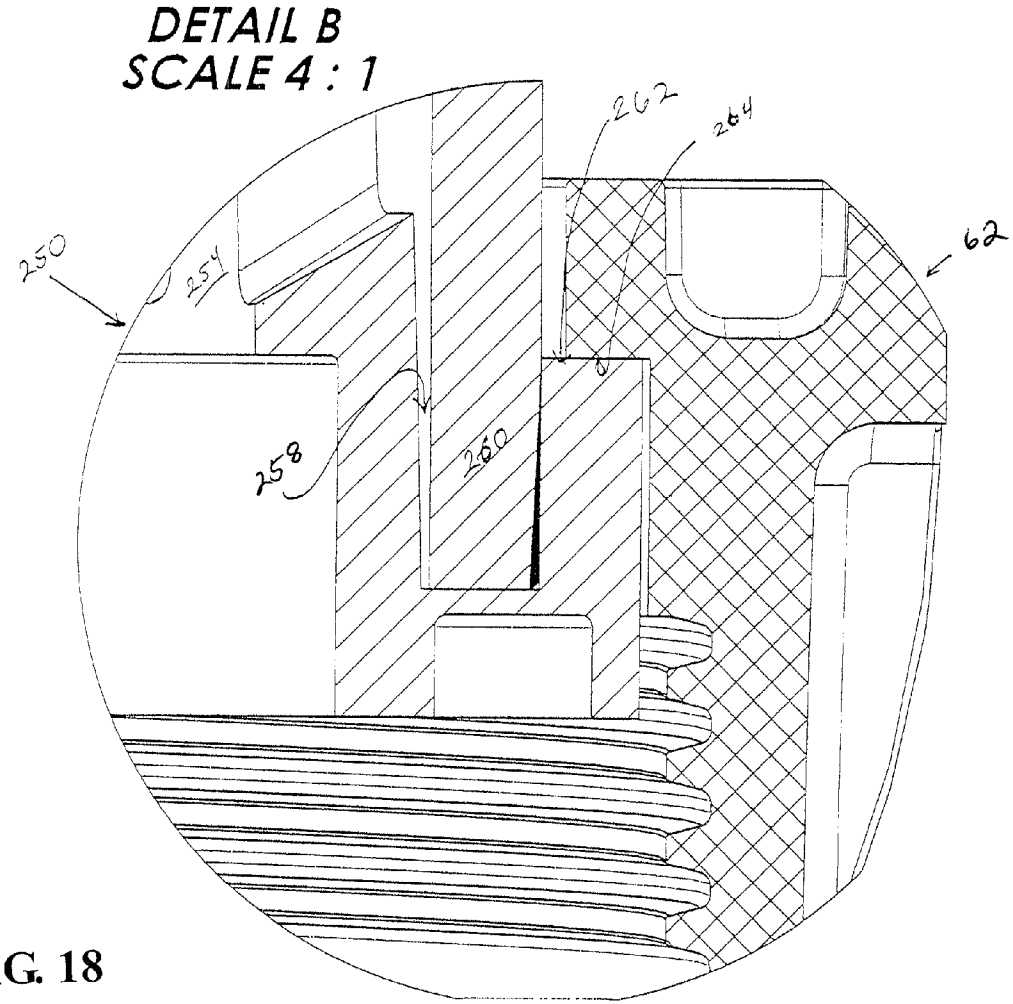
FIG. 18 is a detailed cross-sectional view of detail B from FIG. 17*a;*

A cross-sectional view of detail B of FIG. 17 is shown in FIG. 18. This view better demonstrates how flange 260 fits into channel 258 securing ball cage seat 250 to manifold 6 while at the same time retaining collar 62. Flange 260 may be fastened via ultrasonically or spin welding, glue, mechanical fastener or other like means. Ledge 262 of ball cage seat 250 supports retaining ledge 264 of collar 62. Because retaining ledge 264 illustratively sits on ledge 262, collar 62 is rotatable with respect to manifold 6. It is appreciated that collars 30, 60 and 32 may be modified the same manner as that described with respect to collar 62.

Figure 19:
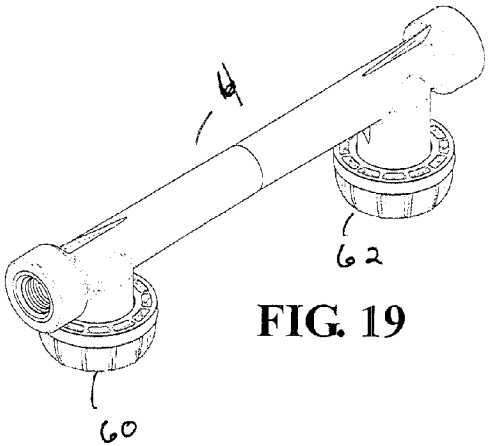
FIG. 19 is a perspective view of an outlet manifold.
Figure 20:
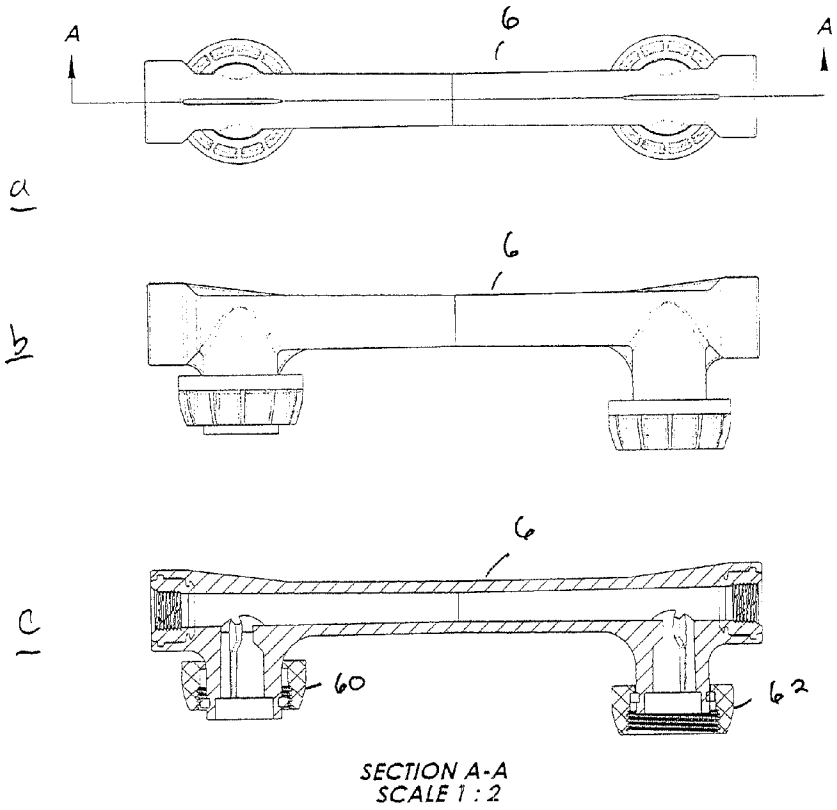
FIGS. 20*a-c* include top, front, and front cross-sectional views (taken along lines A-A of FIG. 20*a*) of the outlet manifold of FIG. 19.

A perspective view of an outlet manifold 6 is shown in FIG. 19. This view depicts collars 60 and 62 suspended from manifold 6. It is appreciated that collars 60 and 62 on inlet manifold 4 may operate in the same fashion. The top and side views of FIGS. 20*a* and *b* further depict the illustrative embodiment of manifold 6. The cross-sectional view depicts collars 60 and 62 retained using retaining ring 228 as discussed with respect to FIG. 11 (as well as retaining ring 236 shown in FIG. 12).

Figure 41:
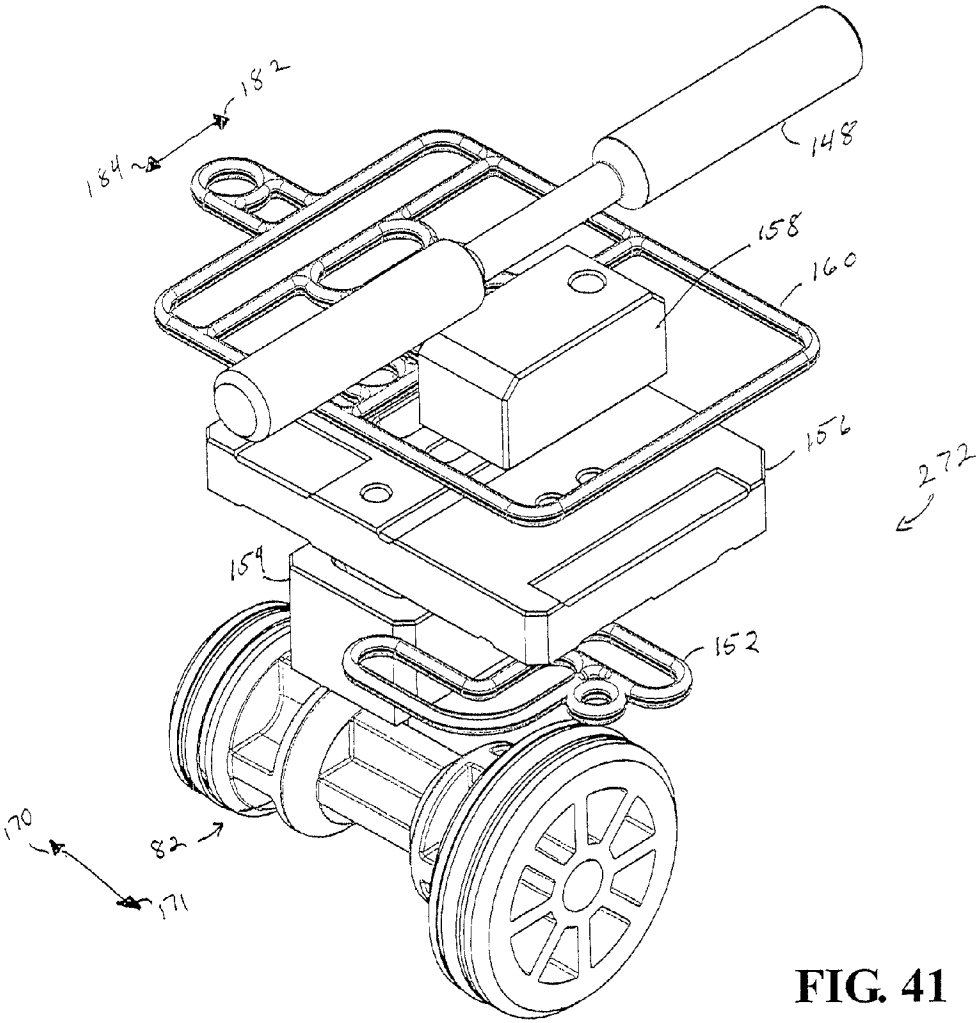
FIG. 41 is a rear perspective exploded view of the valve assembly of FIG. 36.

Another illustrative embodiment of this present disclosure is directed to how diaphragms 132 and 134 are caused to move back and forth. Diaphragm pumps do not pump fluid using traditional electric motors. As previously discussed, pressurized air is employed to move the diaphragms back and forth which in turn draw in and pump out fluid. The valve block assembly 14 and air valve assembly housing 12 include the components that direct pressurized air entering inlet 64 alternately into either air chambers 223 or 224 to create the pushing or pulling on the diaphragms as previously discussed. When chamber 224 is filled with air, it pushes diaphragm 134 in direction 184 pushing fluid out to outlet manifold 6. (See, also, FIG. 9). At the same time, because of diaphragm rod 136, diaphragm 132 is pulled away from its fluid chamber 180 which causes fluid to be drawn up from inlet manifold 4. Of course, the reverse is true as well. Once air is directed to fill chamber 223, diaphragm 132 is pushed in direction 182 thereby pushing fluid up and out to outlet manifold 6. (See, also, FIG. 9). Valve assembly 272 shown in FIG. 41 and housed in valve block assembly 14 and air valve assembly housing 12 is a collection of structures that direct air alternately against one diaphragm or the other to make pump 2 run. As shown in FIG. 41, valve assembly 272 includes differential spool 82, pilot track gasket 152, D-valve insert 154, D-valve plate 156, major valve track gasket 160, pilot D-valve 158, and trip rod 148. As will be demonstrated herein, it will be appreciated that spool 82 and D-valve insert 154 move in directions 170 and 171 with respect to D-valve plate 156. In contrast, trip rod 148 and pilot D-valve 158 will respond to that movement by moving in either direction 182 or 184 by virtue of passages in D-valve 158, discussed further herein.

Figure 21:
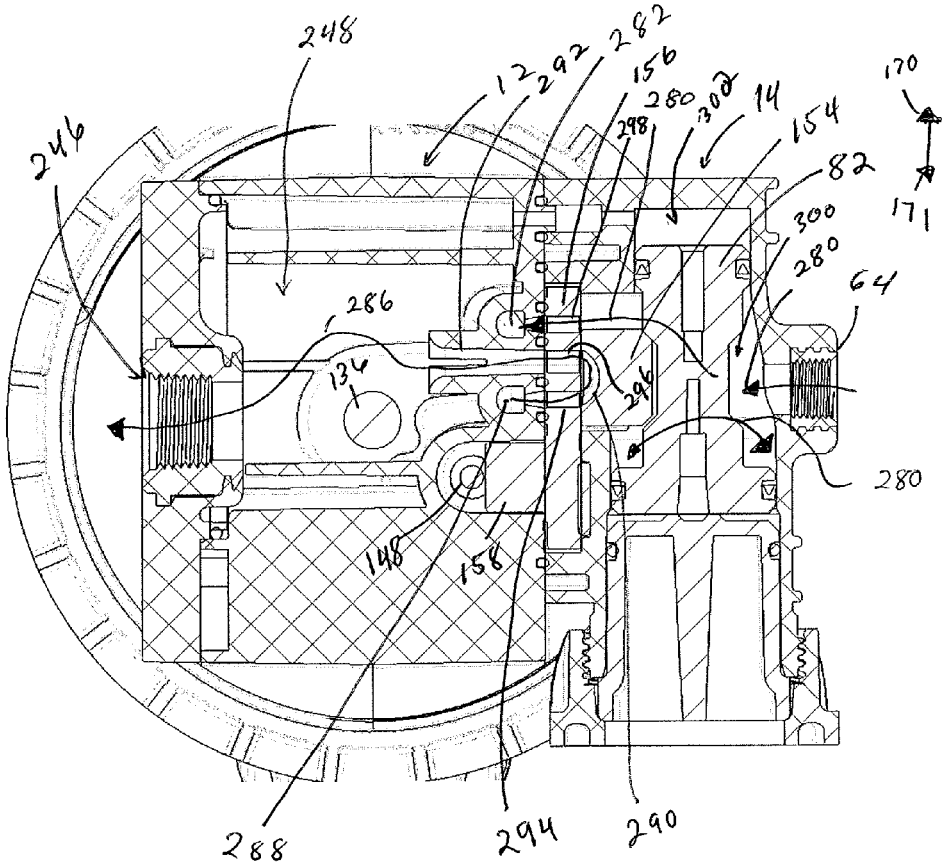
FIG. 21 is a side sectional view of an air valve portion of the double diaphragm pump where air is directed toward the right diaphragm.

The views in FIGS. 21-35 are progression views demonstrating how pressurized air moves diaphragms 132 and 134 back and forth in directions 182 and 184. A side-sectional view of air valve assembly housing 12 and valve block assembly 14 is shown in FIG. 21. Air flow-in 280 enters valve block assembly 14 through air inlet 64. In this state, major D-valve spool 82 is moved downward in direction 171. Air flow-in moves around spool 82 and into diaphragm delivery port 282. At the same time out-flow air 286 exits from diaphragm delivery port 288. In this illustrative embodiment, port 282 feeds and pushes diaphragm 134 while port 288 feeds diaphragm 132. Because, as discussed before, when air force is applied to one diaphragm to push fluid out, the air adjacent the other diaphragm is pushed out to draw fluid in. As shown in FIG. 21, air flow 280 is delivered through port 282 in order to push diaphragm 134 whereas the air having already pushed diaphragm 132 is now exhausted as shown by out-flow air 286. A cavity 290 in D-valve insert 154 provides fluid communication between port 288 and exhaust 292 and out into air chamber 248 to be exhausted to air outlet 246. Further, air passages 294 and 296 in D-valve plate 156 complete the fluid circuit from port 288 to exhaust 292. Similarly, a passage 298 in D-valve plate 156 provides fluid communication between chamber 300 and port 282. Also shown in this view are diaphragm rod 136, pilot D-valve 158 and trip rod 148.

Figure 22:
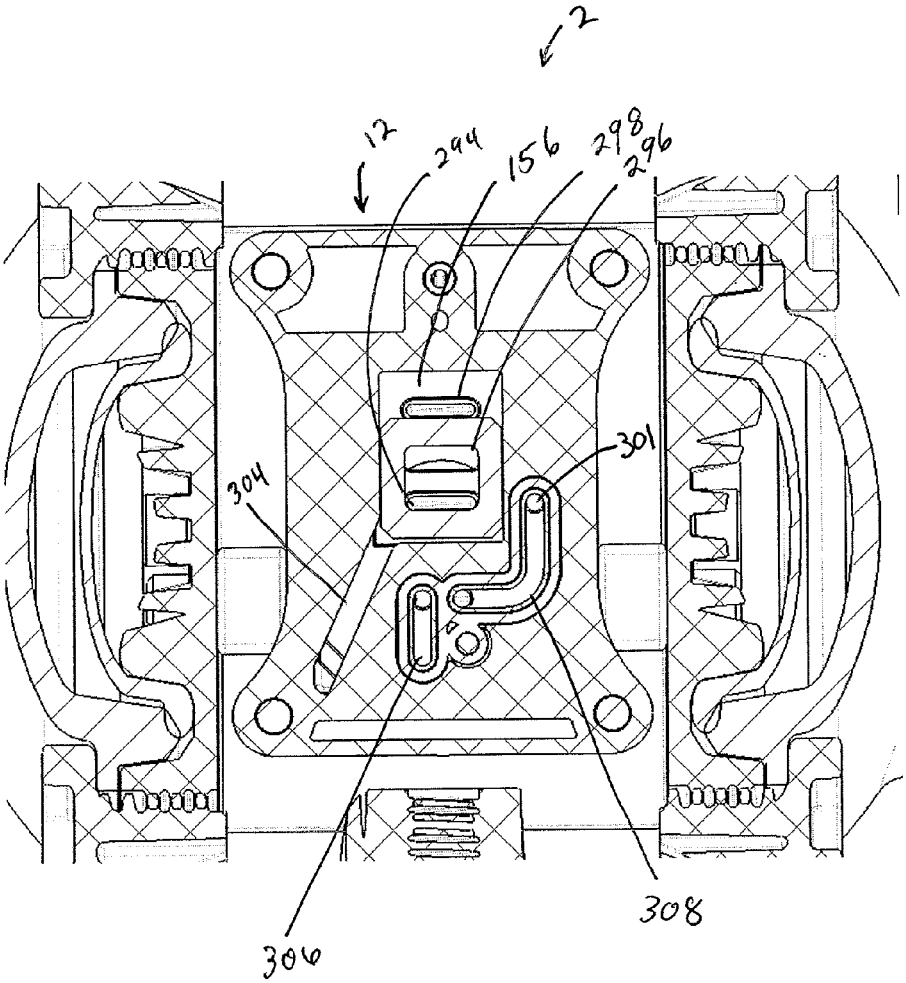
FIG. 22 is a forward facing cross-sectional view of the double diaphragm pump demonstrating air traveling within the air valve assembly.

A forward-facing cross-sectional view of air valve assembly housing 12 of pump 2 is shown in FIG. 22. This view shows passages 294, 296 and 298 in D-valve plate 156. Conduit path 304 illustratively extends from chamber 300 to supply air to pilot chamber 301. Connective path 306 is configured to create fluid communication between major valve pilot chamber 326 and pilot D-valve 158. Exhaust path 308 provides fluid communication between pilot D-valve 158 and chamber 248.

Figure 23:
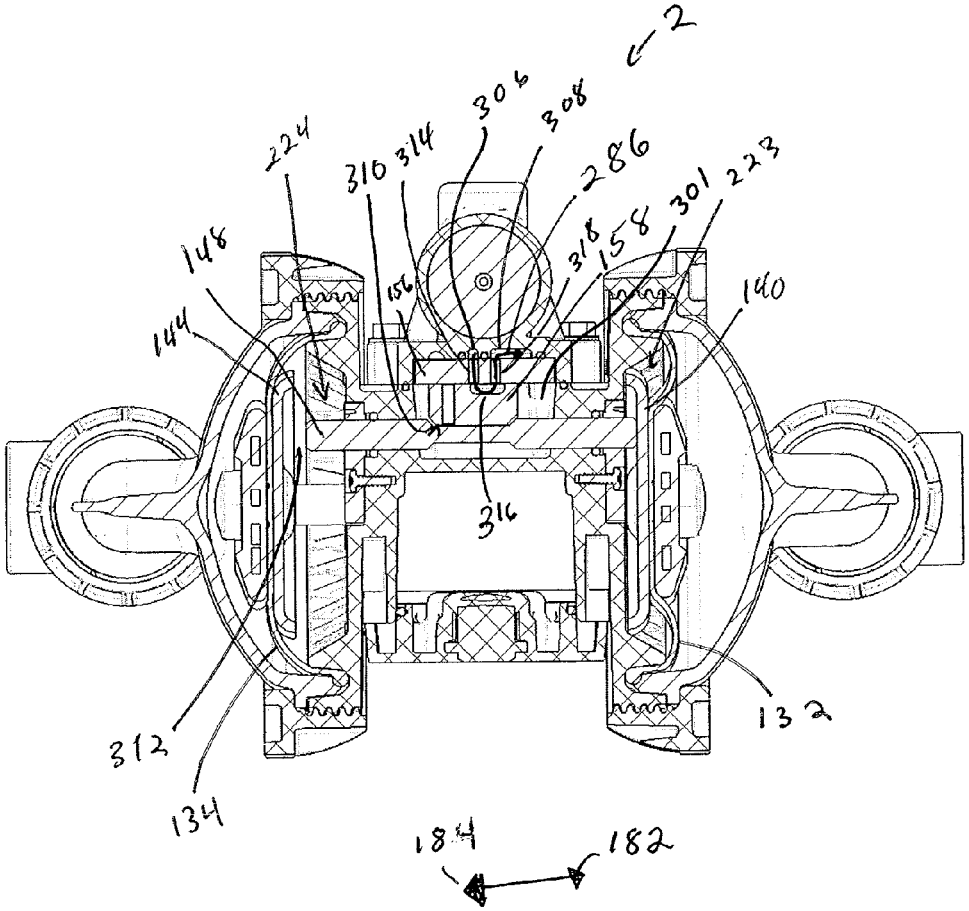
FIG. 23 is an underside cross-sectional view with a loss motion gap on one side of a pilot trip rod and no gap on the other side demonstrating how the pilot trip rod can move with the diaphragm but only after the diaphragm has already begun moving first.

An underside, cross-sectional view of pump 2 is shown in FIG. 23. Here trip rod 148 includes a recess 310 configured to receive pilot D-valve 158 and move the same in either directions 182 or 184. As shown in this illustrative embodiment, the length of trip rod 248 is shorter than the distance between backup washers 140 and 144 to create lost motion indicated by space 312. This means that the diaphragms can move a certain distance without yet moving trip rod 148. This allows the movement of trip rod 148 to be specifically timed. In this case it will move pilot D-block 158 as discussed further herein. In this position, however, passageway 314 in plate 156 connects passage 306 with passage 308 to exhaust fluid indicated by outlet air flow 286. Passage 316 and 318 as shown further provides such communication.

At this point air is filling air chamber 223 against diaphragm 132 pushing the same in direction 182, while moving diaphragm 134 in direction 182 as well. Air is also pushing out of chamber 224 creating the outlet air 286 previously discussed.

Figure 24:
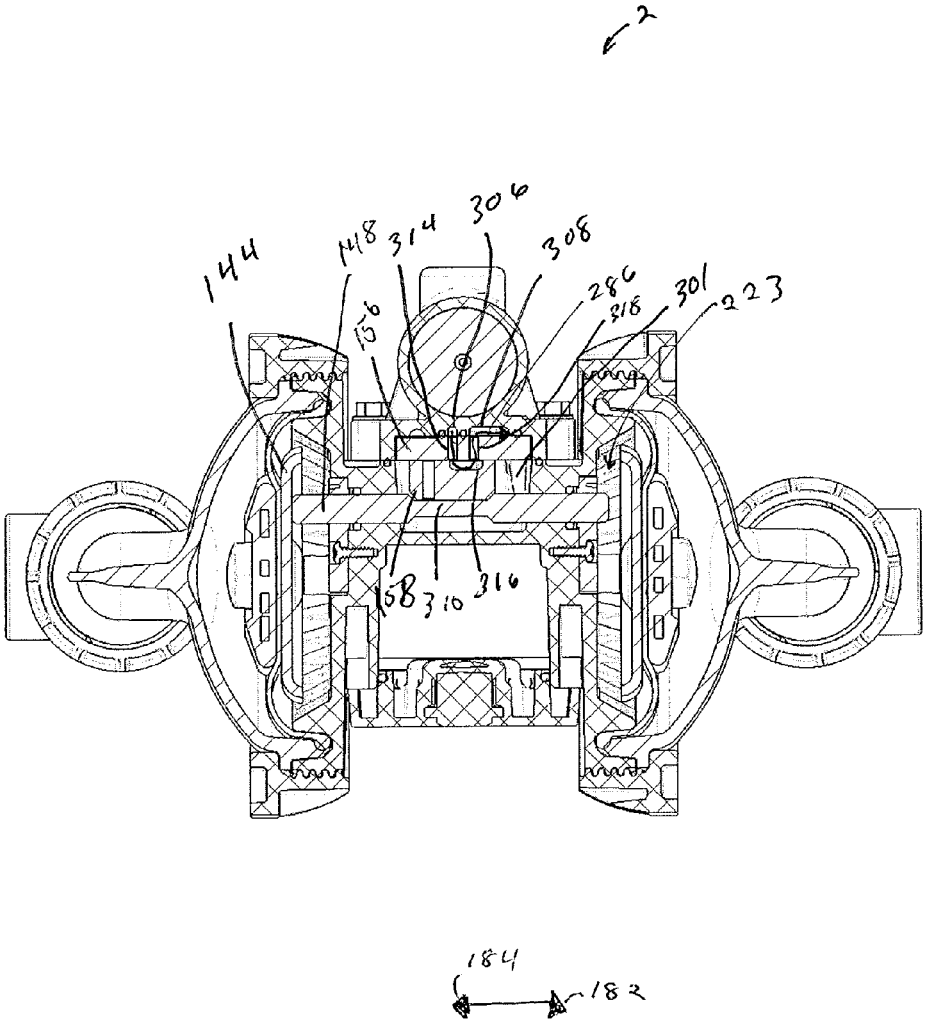
FIG. 24 is another underside cross-sectional view of the double diaphragm pump demonstrating how the trip rod begins moving after the diaphragm already moves some distance.

The cross-sectional view in FIG. 24 depicts how air is supplied to chamber 223 moving the same in direction 182 causing backup washer 144 to eventually engage trip rod 148 pushing the same in direction 182 as well. At this point recess 310 and trip rod 148 have yet to move pilot D-valve 158. They only contact it as shown. Exhaust air 286 is still flowing out through passages 306, 314, 316, 318, and 308 to be expelled from pump 2.

Figure 25:
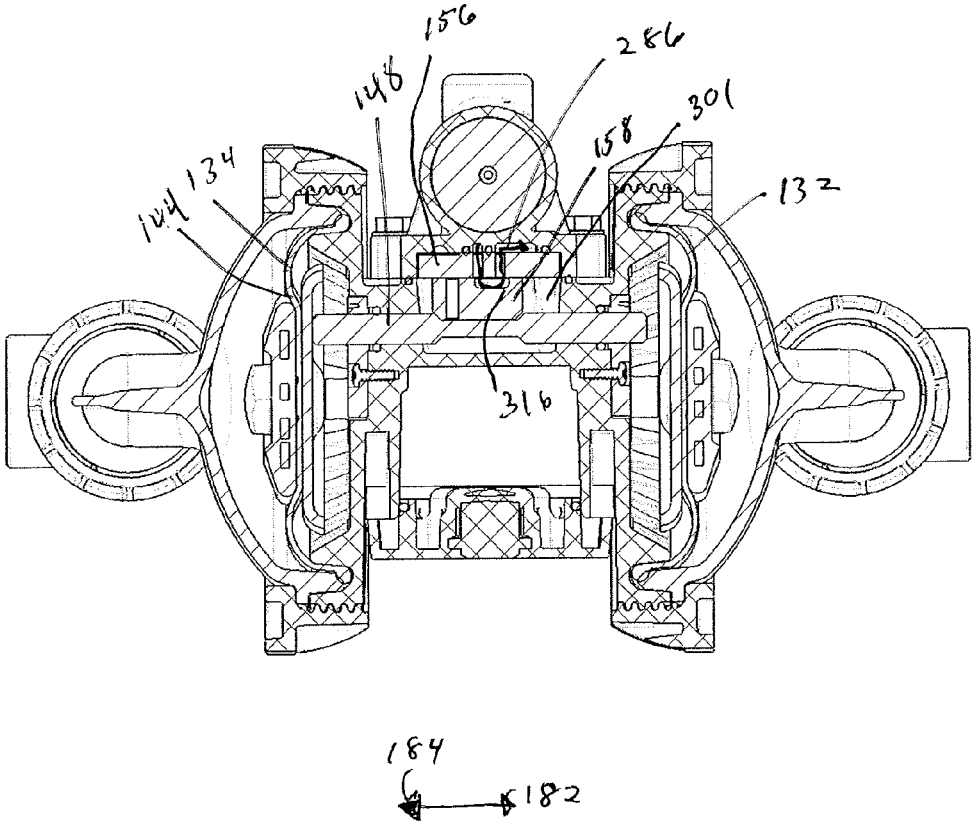
FIG. 25 is another underside cross-sectional view of the double diaphragm pump now demonstrating the diaphragm connecting rod and trip rod moving concurrently.

In FIG. 25, a similar view to FIGS. 23 and 24, diaphragms 132 and 134 are both still moving in direction 182 but now doing it so much that backup washer 144 is pushing on trip rod 148 moving pilot D-valve 158 in direction 182 as well. Exhaust air 286 exits through the same passages as discussed with respect to FIG. 24 but with pilot D-valve 158 now moving in direction 182 passage 316 begins to move to close off the exhaust path. All the while, the in-flow 280 air discussed with respect to FIG. 21 is pushing diaphragm 132 in direction 182.

Figure 26:
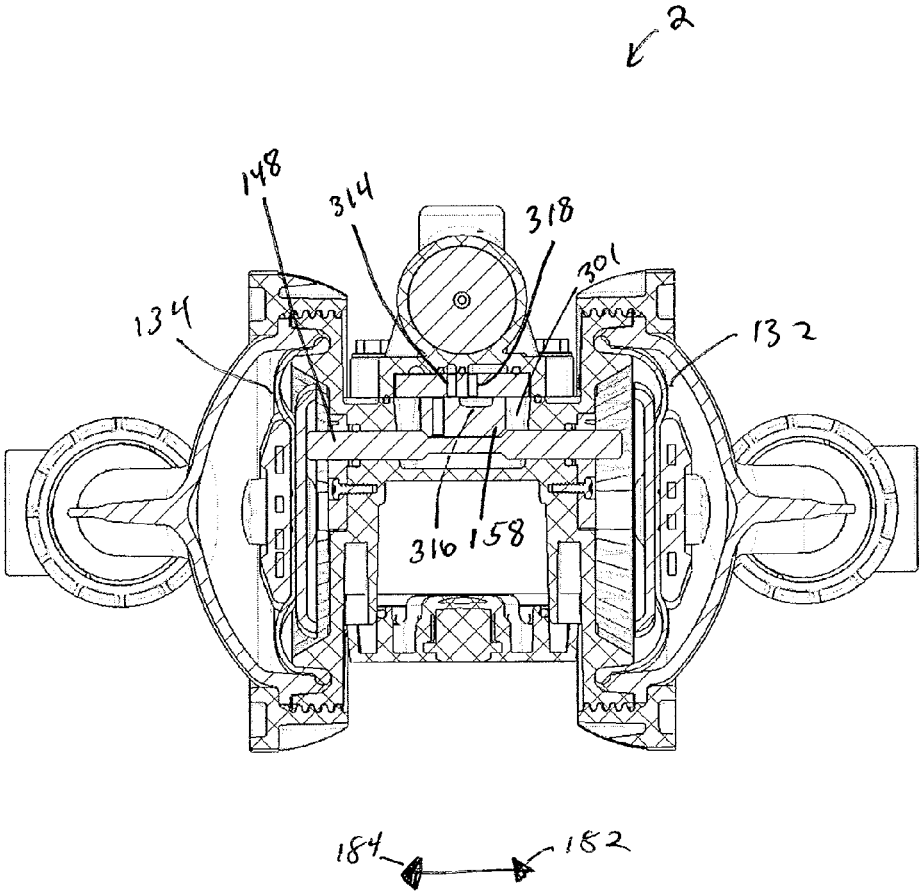
FIG. 26 is another underside cross-sectional view of the double diaphragm pump demonstrating how the pilot rod moves a pilot D-valve to change flow paths.

The same view of pump 2 shown in FIG. 26 now depicts trip rod 148 pushing pilot D-valve 158 further in direction 182. This causes passage 316 to offset from both passages 314 and 318. This closes the exhaust path preventing air from exiting through that pathway. Continued movement of pilot D-valve 158 by trip rod 148 in direction 182 eventually mates passageway 324 located in pilot D-valve 158 in fluid communication with passageway 314.

Figure 27:
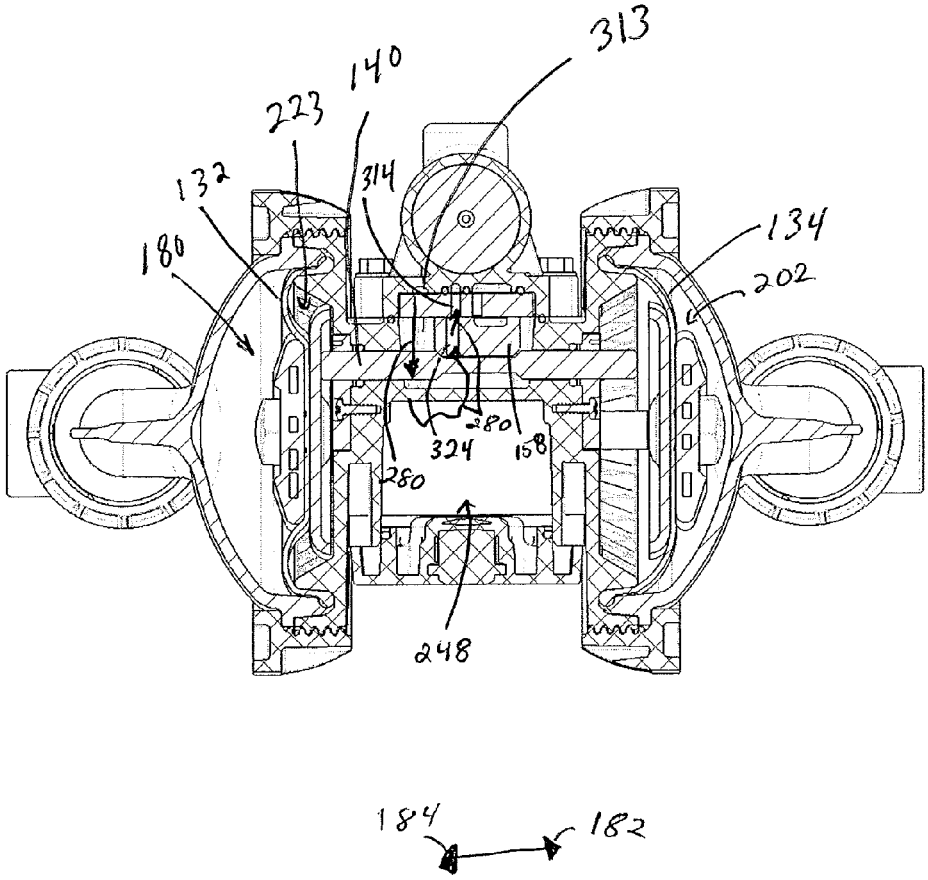
FIG. 27 is another underside cross-sectional view of the double diaphragm pump demonstrating how the pilot trip rod moving the pilot D-valve changes air flow.

The view shown in FIG. 27 depicts how air 280 from conduit 304 entering pilot valve chamber 301 may now enter passageway 324 and up through passageway 314. This represents the end of the stroke that moves diaphragm 134 in direction 182 pushing fluid out of fluid chamber 202 and out through outlet manifold 6 as previously discussed. On the other side diaphragm 132 is drawing inward in direction 182 collapsing air chamber 223 and increasing the volume of fluid chamber 180 which draws the fluid up through inlet manifold 4.

Figure 28:
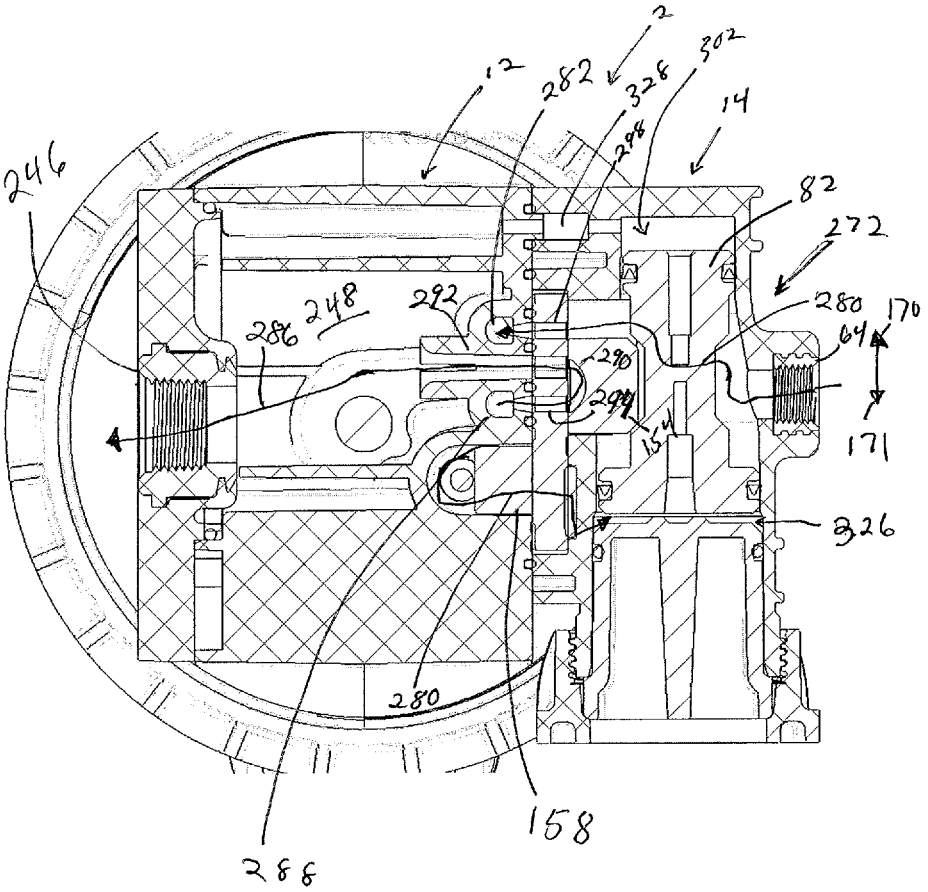
FIG. 28 is a side cross-sectional view of the air valve assembly of the double diaphragm pump demonstrating how the differential spool moves to move the major D-valve to again change the air flow entering the assembly.

The side cross-sectional view shown in FIG. 28 depicts how valve assembly 272 operates to switch air flow to the opposite diaphragm. First, air from pilot D-valve 158 flows back to chamber 326 which is on the underside of spool 82. This causes spool 82 to move in the direction 170, opposite from that shown in FIG. 21. At the same, inlet flow air 280 is continues flowing through inlet 64 and up to passage 282 while spool 82 moves in direction 170. It is appreciated that chamber 302 is vented through passage 328 to chamber 248 and ultimately to outlet 246. In addition, outlet flow air is exiting from passages 288, 294, 290 and 292. It is released through chamber 248 and out exit 246.

Figure 29:
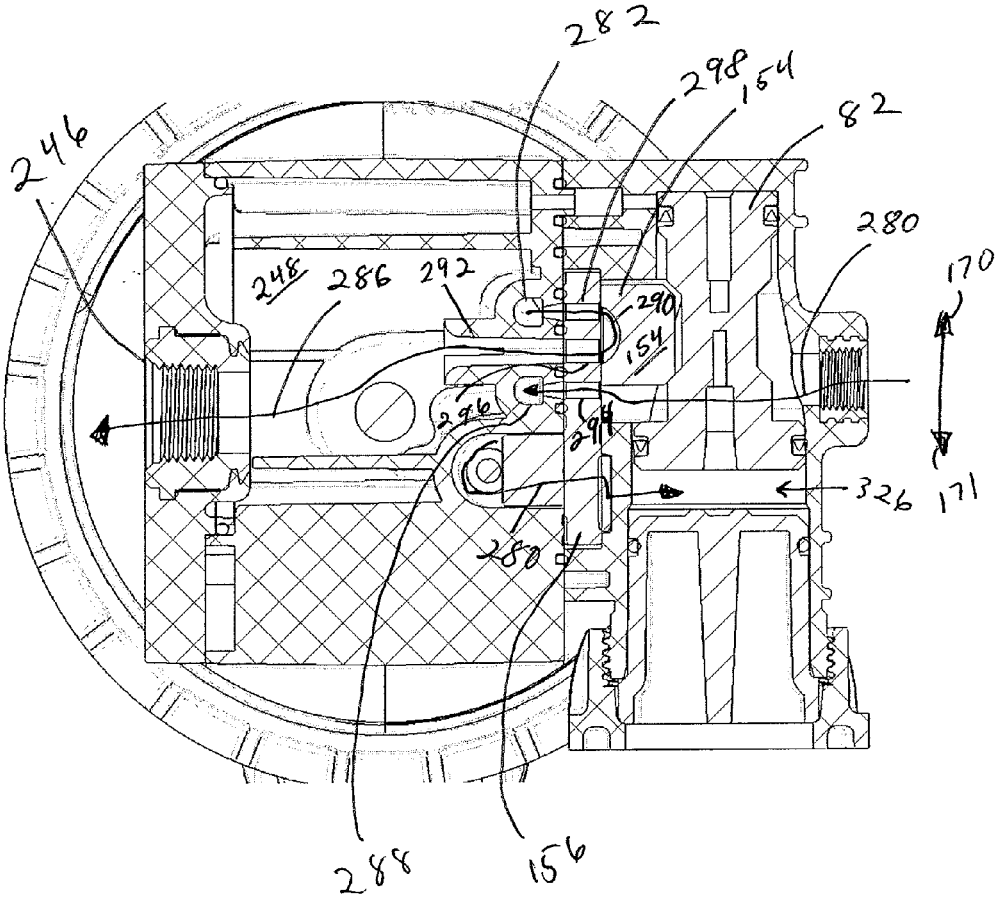
FIG. 29 is another side cross-sectional view of the air valve assembly demonstrating how further movement of the differential spool moves the major D-valve to affect air flow entering the assembly.

The view in FIG. 29, similar to that of FIGS. 29 and 21 show spool 82 moving upward in direction 170 via continued fluid flow from inlet air 280 to chamber 326. At this point, air is being exhausted from chamber 223. This is causing exhaust air 286 to exit from passage 282 through passage 298 in plate 156, passage 290 in D-valve 154, through passages 296 and 292, into chamber 248 and out exhaust passage 246. Conversely, inflow air 280 is now allowed to enter passage 294 in D-valve plate 156 and into diaphragm port 288 to energize or push the other diaphragm 134.

Figure 30:
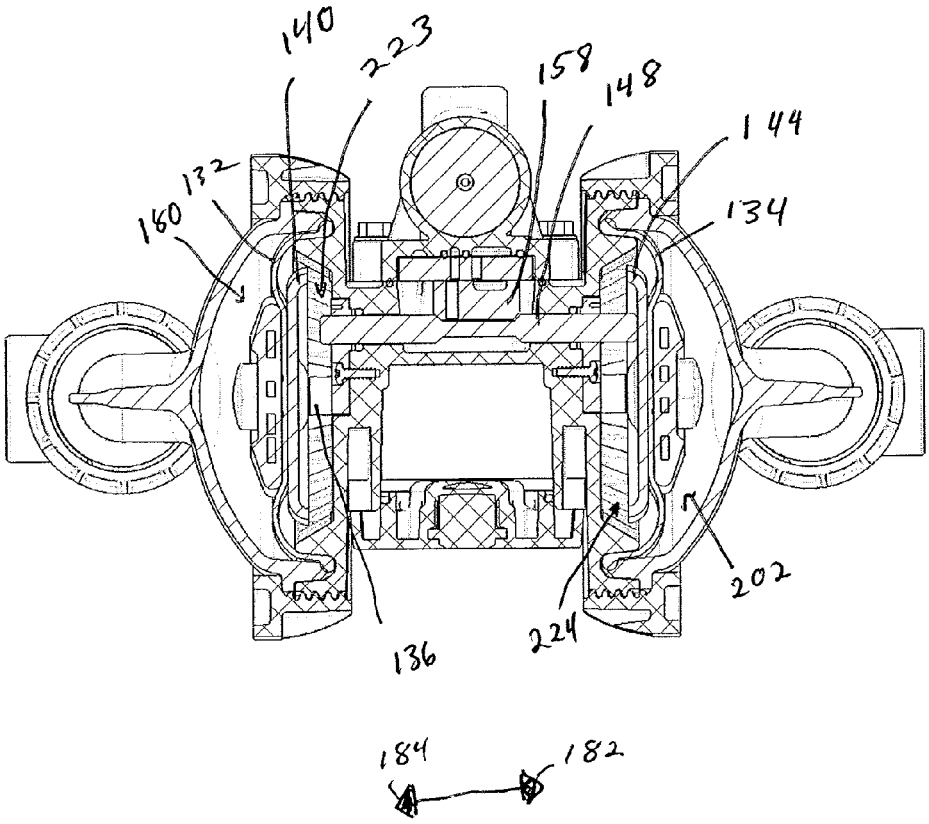
FIG. 30 is an underside cross-sectional view of the double diaphragm pump demonstrating how air is directed to fill the left air chamber opposite to that shown in FIG. 23.

The view in FIG. 30 depicts the reverse stroke of diaphragms 132 and 134 now moving in direction 184. With diaphragm rod 136 moving in direction 184 because inlet air 280 is entering air chamber 223, backup washer 144 is now pushing trip rod 148 in direction 184. It is appreciated that because the length of rod 148 is less than the distance between backup washers 140 and 144, these backup washers 140 and 144 will move some distance prior to moving rod 148. In this view backup washer 144 is just at the point when it engages rod 148 but has not yet moved pilot D-valve 158. Nonetheless, air 280 (as shown in FIG. 29) is filling chamber 223 causing that chamber to expand while causing the corresponding chamber 224 to contract. As previously discussed, this causes fluid chamber 202 to expand drawing fluid up in from inlet manifold 4 while fluid chamber 180 is contracting pushing fluid out and up into outlet manifold 6.

Figure 31:
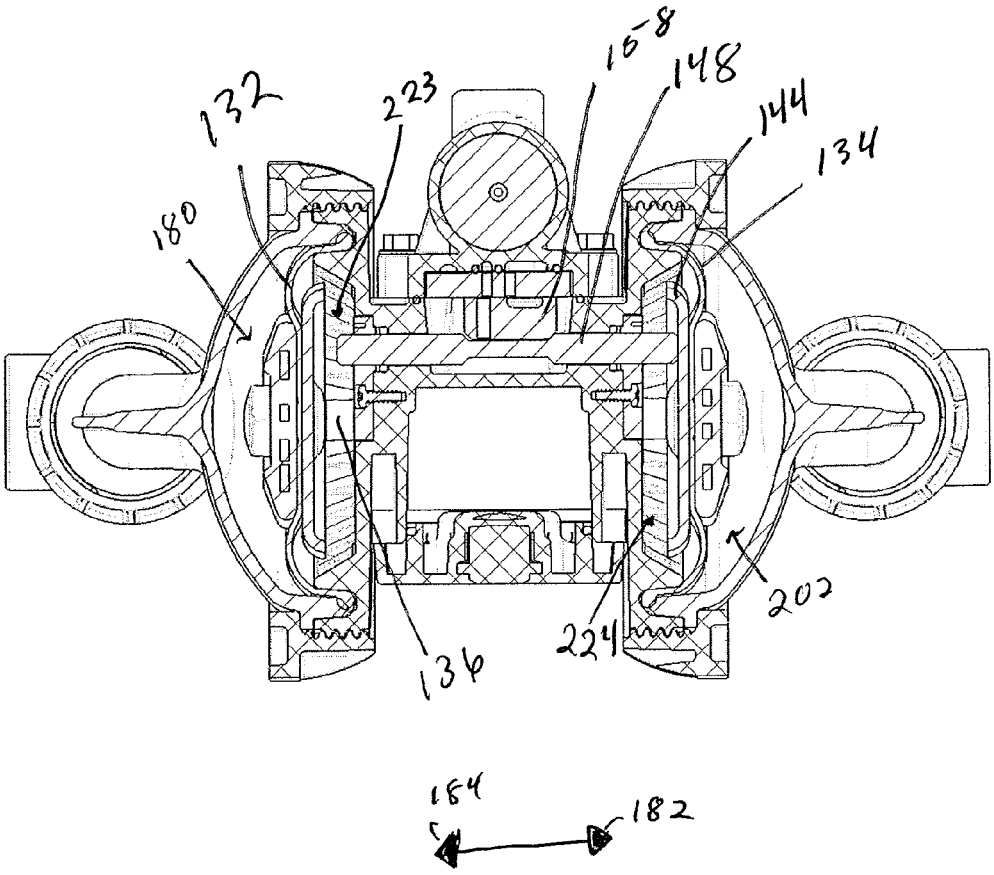
FIG. 31 is another underside cross-sectional view of the double diaphragm pump demonstrating movement of the pilot D-valve and diaphragm connecting rod moving to the left opposite of that shown in FIG. 24.

The view in FIG. 31, similar to that of FIG. 30 depicts trip rod 148 engaging pilot D-valve 158 moving it in direction 184 as well. Because of the lost motion, however, air chamber 223 continues to be filled with air 280 thereby continuing to expand causing diaphragm 132 to continue moving in direction 184 while pilot D-valve 158 has not yet moved. Air is also continuing to exhaust from air chamber 224 further assisting diaphragms 132 and 134 to move in direction 184 which, as previously discussed, allows backup washer 144 to engage trip rod 148.

Figure 32:
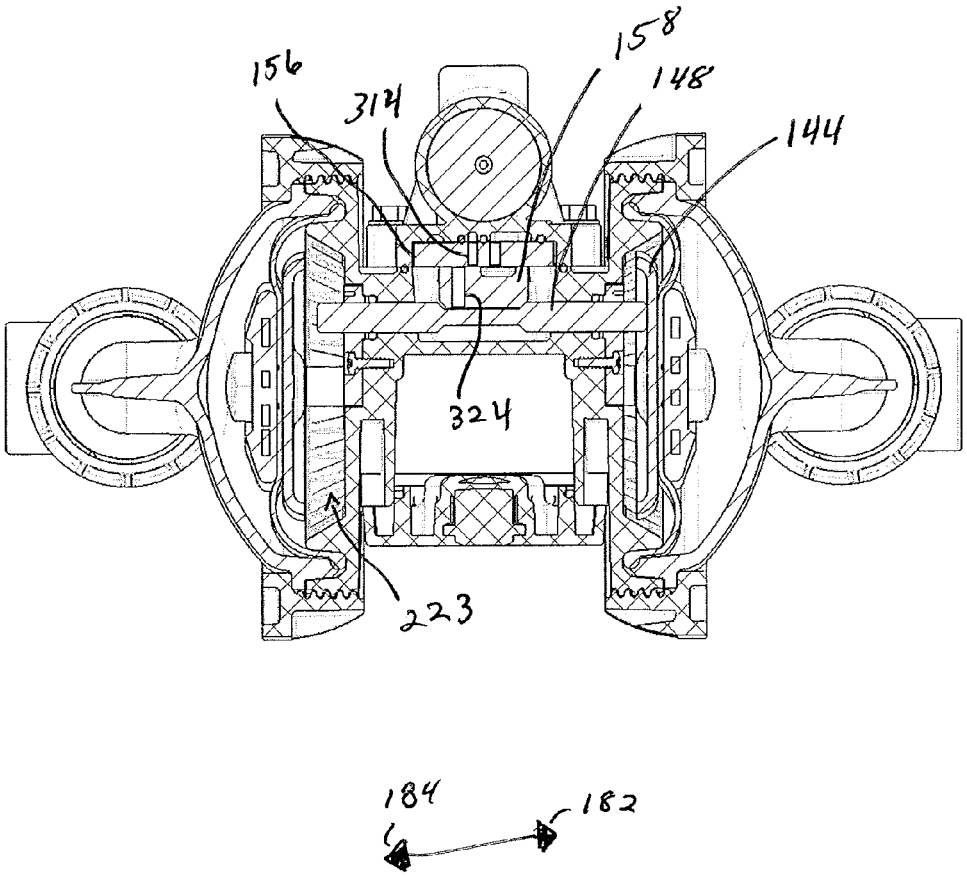
FIG. 32 is another underside cross-sectional view of the double diaphragm pump demonstrating continued movement of valve components to the left.
Figure 33:
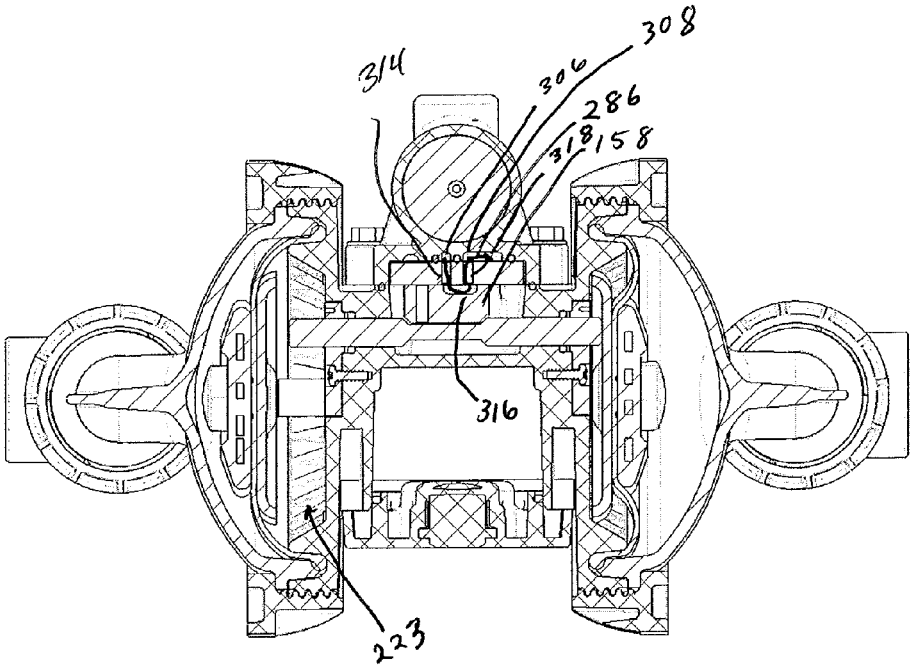
FIG. 33 is another underside cross-sectional view of the double diaphragm pump demonstrating continued movement of components to the left to change air flow direction.

The view in FIG. 32 continues from that of FIG. 31 wherein trip rod 148 is now being pushed in direction 184 by backup washer 144 and is moving pilot D-valve 158 in direction 184 as well. Pilot D-valve moves further in direction 184, causing passageway 324 in pilot D-valve 158 to cut off from passageway 314 in D-valve plate 156, which, as first shown in FIG. 27, cuts off the inlet fluid 280 meaning air is cut off from air chamber 326. Despite severing passages 324 and 314, pilot D-valve 158 moves such that passage 316 now aligns or is in fluid communication with passages 314 and 318 causing the air on that once filled air chamber 326 is now being exhausted out from port 306 through passages 314, 316, 318 and out passage 308.

The lost motion function is further useful because it prevents stalling. If, by chance, an air section has made a commitment to shift at the same time the fluid outlet is shut-off, a rebounding pressure pulse may push back the trip rod if it were in close proximity to the back-up washer. This in turn could push the pilot D-valve into a position mid-point between air inlet and exhaust, thus severing any communication from the pilot and major valves. If this occurs, the major valve may have seen just enough air or exhaust to leave the D-valve on dead center in travel between the pilot on and pilot off positions. This position would put the major D-valve into a position which would not supply air or exhaust ports to either side of the pump. With all pressures balanced in the major valve, any further movement would be prohibited. The pump stalls until something changes to un-balance the pressure such as de-coupling the air supply. The lost motion feature allows for a pressure rebound without altering the commitment of the pilot valve. Furthermore, the D-valve in this disclosure utilizes an angled contact surface between the trip rod and the pilot D-valve as well as the major spool and major D-valve. This is being done so that the vectored resultant force from the actuator (trip rod or major spool) will always seat the D-valve to the valve plate. In conventional designs the spool or actuator will engage the D-valve at one or both ends in the same direction as the actuator. Air pressure holds the D-valve down, but with low air or fast acceleration the D-valve may be dislodged or tipped from the sealing surface leading to leaks or a stalled motor.

Figure 34:
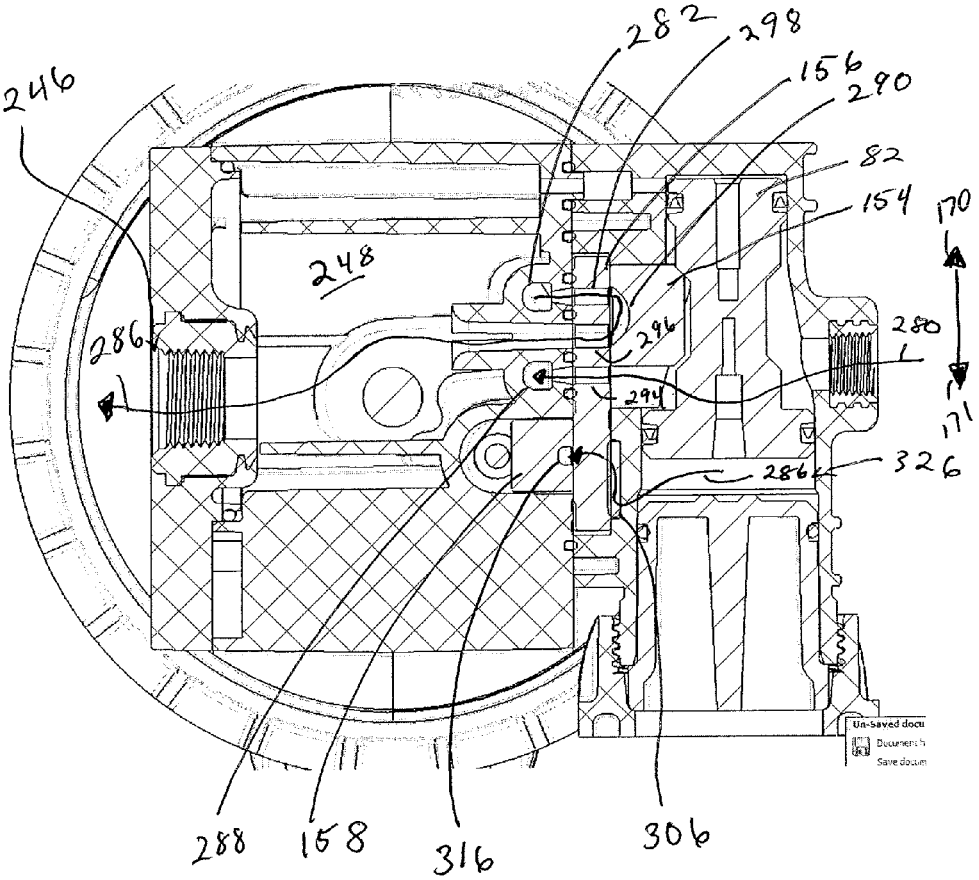
FIG. 34 is another side cross-sectional view of the air valve assembly demonstrating downward movement of the differential spool.

The side, cross-sectional view of FIG. 34, similar to FIGS. 29 and 21, for example, shows air flow 286 exhausting from port 282 through passages 298 and 296 on D-valve plate 156, passage 290 on D-valve insert 154 and escaping through chamber 248 and outlet 246. In addition, exhaust air 286 exits chamber 326 and out through port 306 and passage 316 of pilot D-valve 158. When this happens while inlet air 280 is still supplying air to port 288 differential spool 82 moves downward in direction 171 and takes D-valve insert 154 with it.

Figure 35:
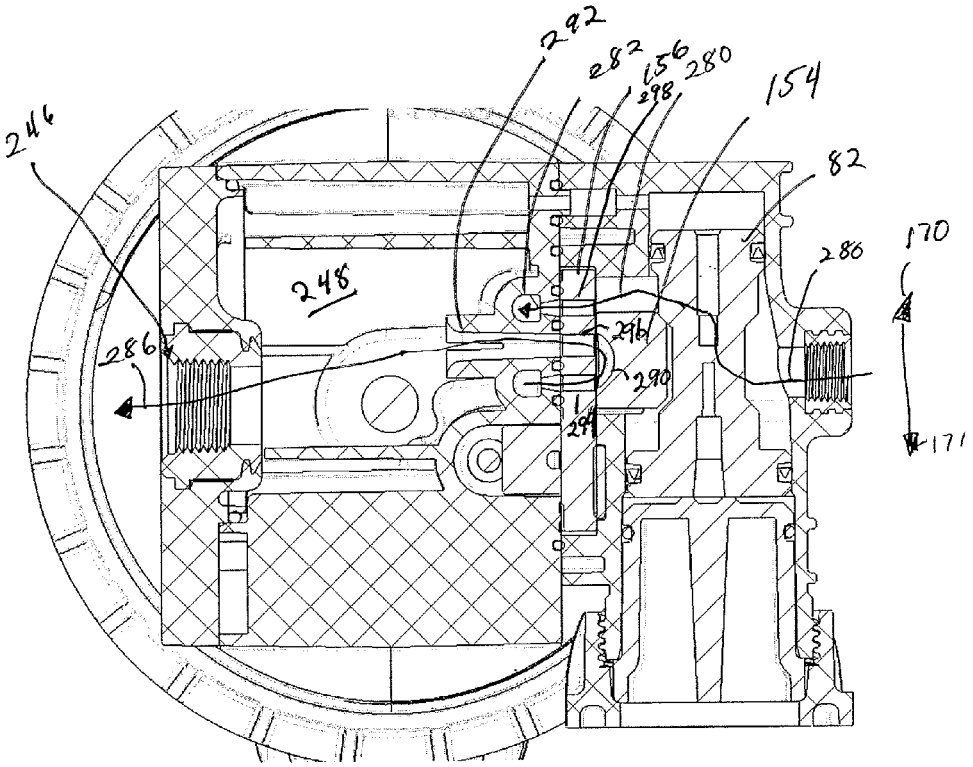
FIG. 35 is another side cross-sectional view of the air valve assembly demonstrating further movement of the differential spool placing it back in the position shown in FIG. 21 to complete a full cycle of the dual diaphragms moving back and forth.

As shown in FIG. 35, while differential spool 82 moves downward in direction 171, D-valve insert 154 is drawn downward as well. This aligns passageway 290 with passageways 296 and 294 on D-valve plate 156. Air passage for exhaust air 286 is now available through passage 292 into chamber 248 and out exhaust port 246. At the same time, passage 298 and D-valve plate 156 aligns with port 282 allowing inlet air 280 to enter and re-energize the right side of pump 2 as discussed with respect to FIG. 21. This represents a full cycle of the double diaphragm pump 2. It is appreciated that this afore-described movement of valve assembly 272 (see FIG. 41) continues in a reciprocal fashion to alternately inflate and then deflate air chambers 223 and 224, respectively. And as previously discussed, when this happens, the deflating side draws fluid into the adjacent fluid chamber from inlet manifold 4 while the other diaphragm pushes fluid out and up toward outlet manifold 6 creating the pump action.

Figure 36:
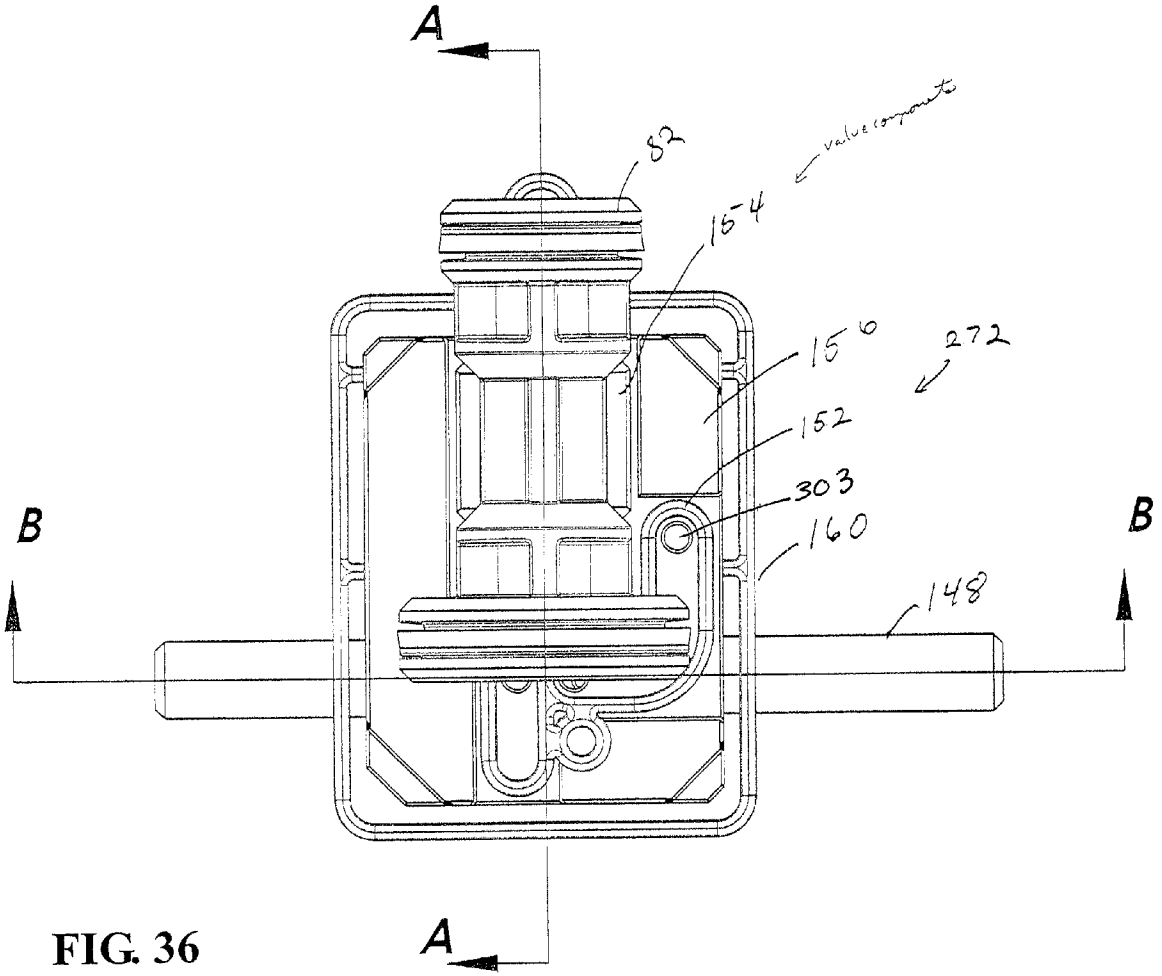
FIG. 36 is a front isolated view of the valve assembly from the valve block and air valve assembly housing.

Various views of valve assembly 272 are shown in FIGS. 36-44. These are the internal structures of valve block assembly 14 and air valve assembly housing 12 that direct the air into one air chamber or another (i.e., air chambers 223, 224) for moving diaphragms 132 and 134 back and forth. For example, a front isolated view of valve assembly 272 is shown in FIG. 36. This view shows the front orientation and relative positioning of spool 82, D-valve insert 154, pilot track gasket 152, D-valve plate 156 and major valve track gasket 160. Trip rod 148 is also shown in this view.

Figure 37:
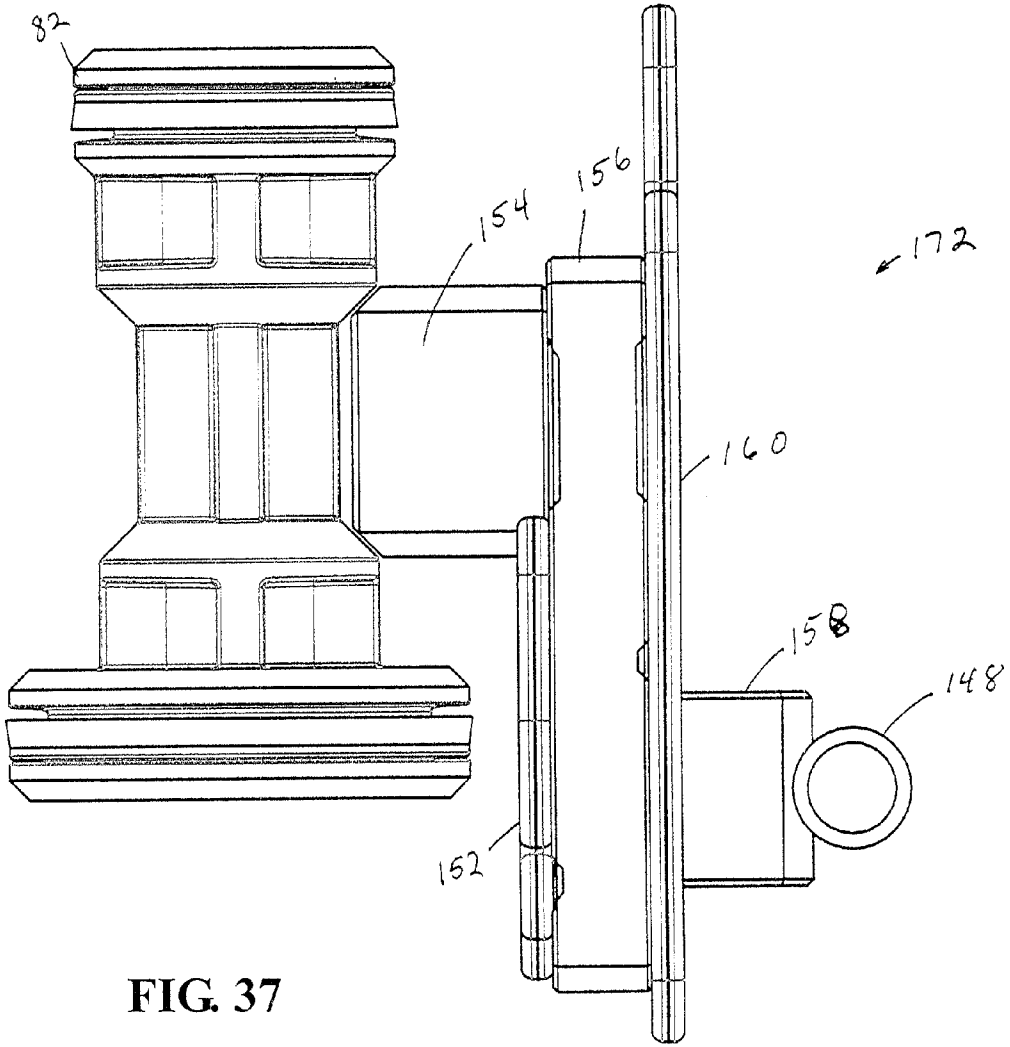
FIG. 37 is a side view of the valve assembly of FIG. 36.
Figure 38:
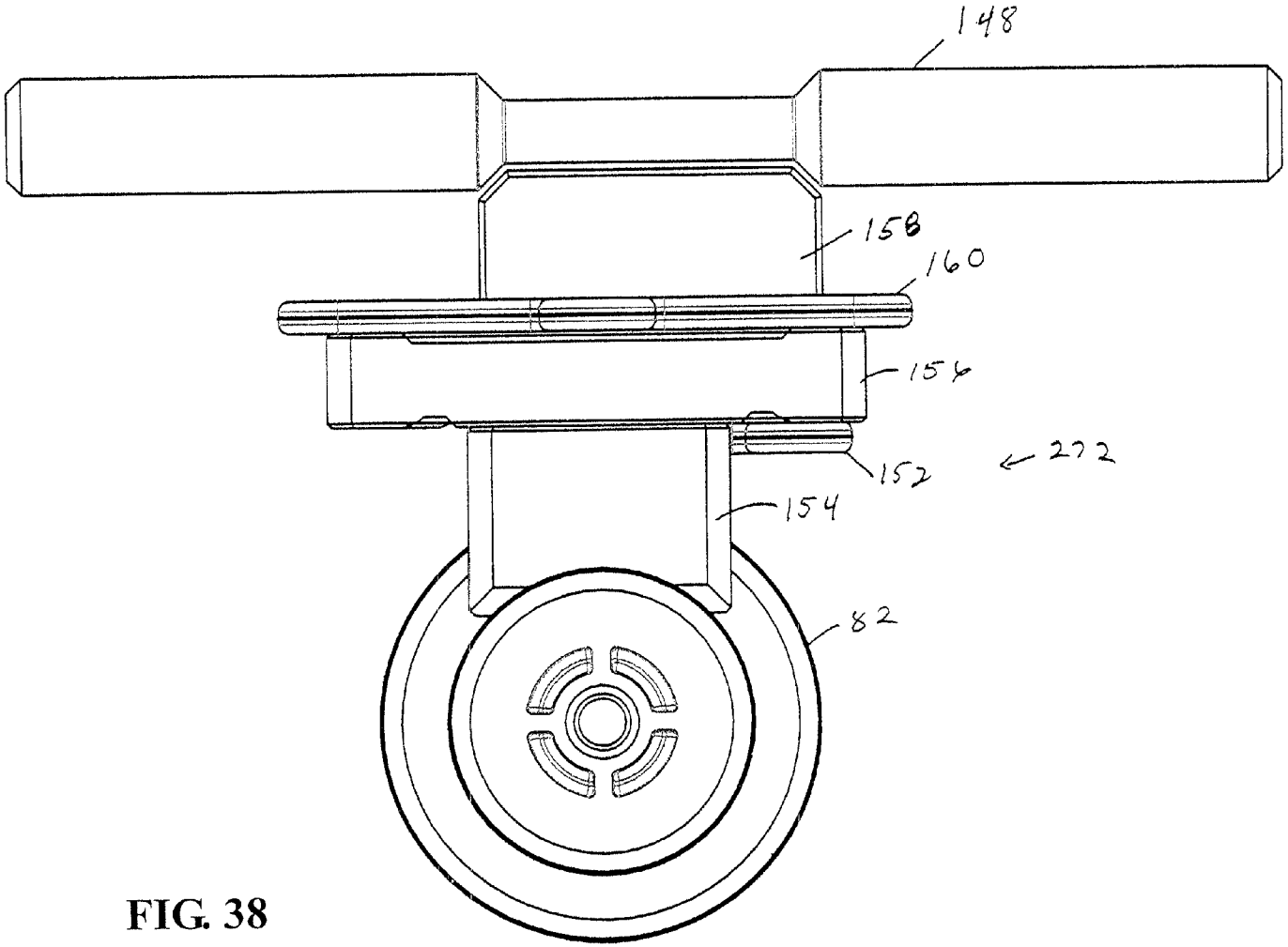
FIG. 38 is a top view of the valve assembly of FIG. 36.
Figure 39:
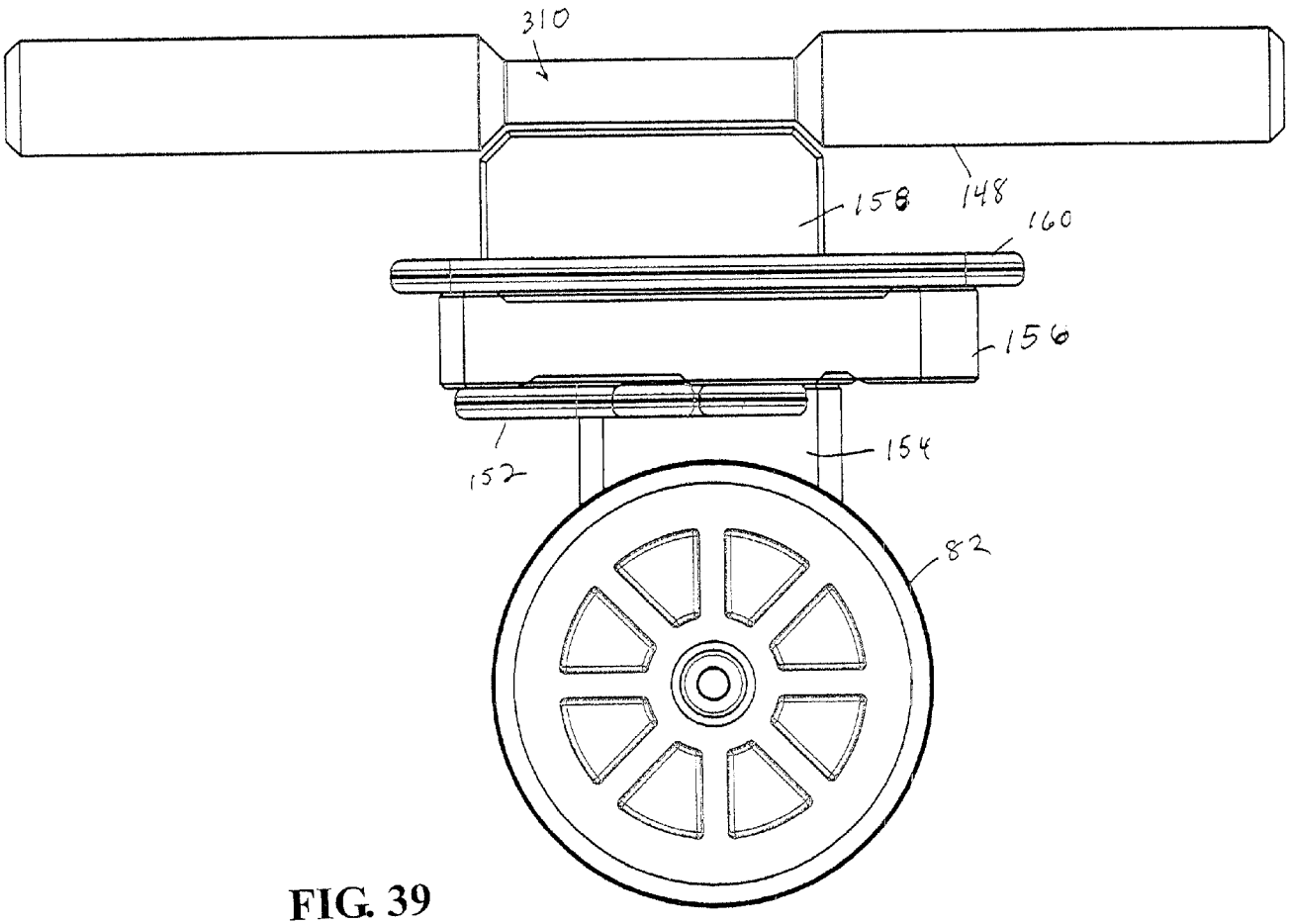
FIG. 39 is an underside upward-looking view of the valve assembly of FIG. 36.

A side view of valve assembly 272 is shown in FIG. 37. Like in FIG. 36, this view shows the relative positioning of these valve components but from the side. Major valve spool 82 is shown adjacent D-valve insert 154 which is sandwiches between the spool and D-valve plate 156. Gasket 152 is positioned on plate 156 as is major track gasket 160. Pilot D-valve 158 is positioned lower than D-valve insert 154 and trip rod 148 and on the opposite side of plate 156. It is appreciated that being located adjacent pilot D-valve 158 allows trip rod 148 to selectively move the same. A top view of valve assembly 272 is shown in FIG. 38. This shows the arrangements of the structures with respect to each other including spool 82, D-valve insert 154, plate 156, gaskets 152 and 160, pilot D-valve 158 and trip rod 148. Likewise, FIG. 39 depicts the underside, upwardly looking view of valve assembly 272. This view also shows spool 82, D-valve insert 154, plate 156, gaskets 152 and 160, pilot D-valve 158 and trip rod 148. Recess 310 is also shown. It is appreciated that recess 310 is sized and configured to engage pilot D-valve 158 when moving in either direction 182 or 184. In an illustrative embodiment, recess 310 may be sized so that trip rod 148 can be moved a desired distance in either directions 182 or 184 without yet moving pilot D-valve 158. This may prevent stalling.

Figure 40:
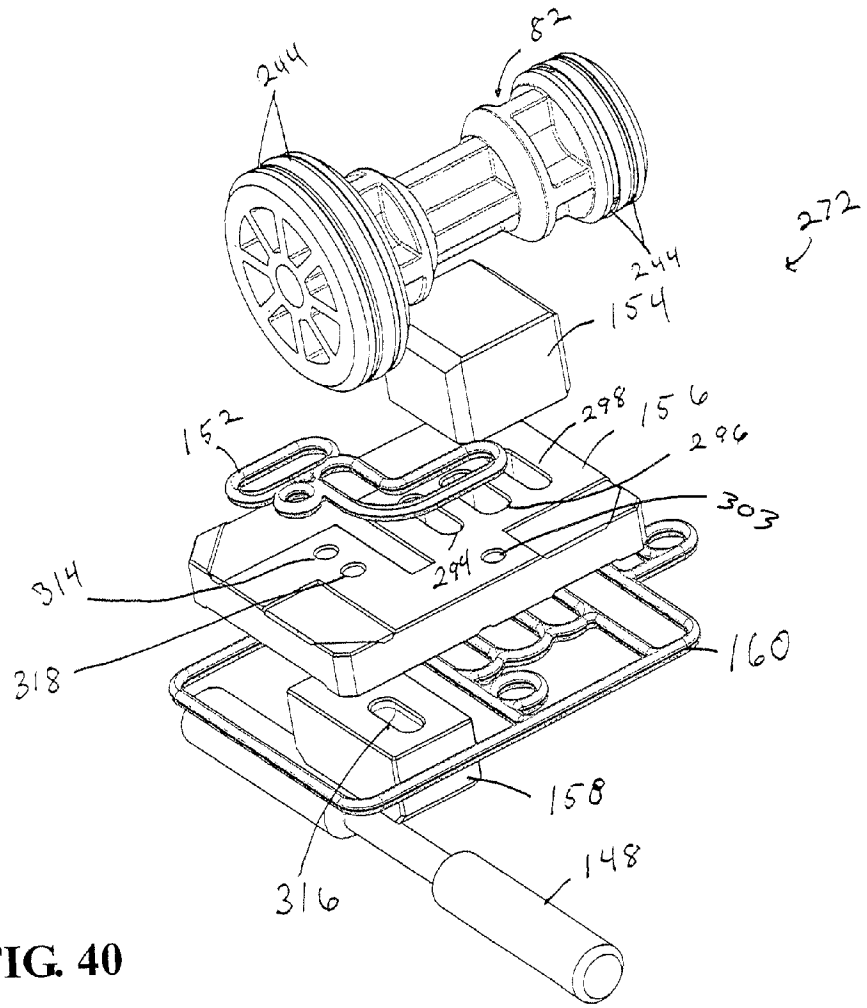
FIG. 40 is a side perspective exploded view of the valve assembly of FIG. 36.

A side perspective exploded view of valve assembly 272 is shown in FIG. 40. This view shows the illustrative configuration of spool 82 with seals 244, D-valve insert 154, gaskets 152 and 160, D-valve plate 156, pilot D-valve 158, and trip rod 148. This view also shows passageway 316 and pilot D-valve 158, and passageways 314 and 318 and plate 156. Also shown in plate 156 include passages 298, 296 and 294. It is appreciated with respect to gaskets 152 and 160 that they are so configured to be formed about the periphery of passage openings to provide a seal between adjacent structures.

Figure 42:
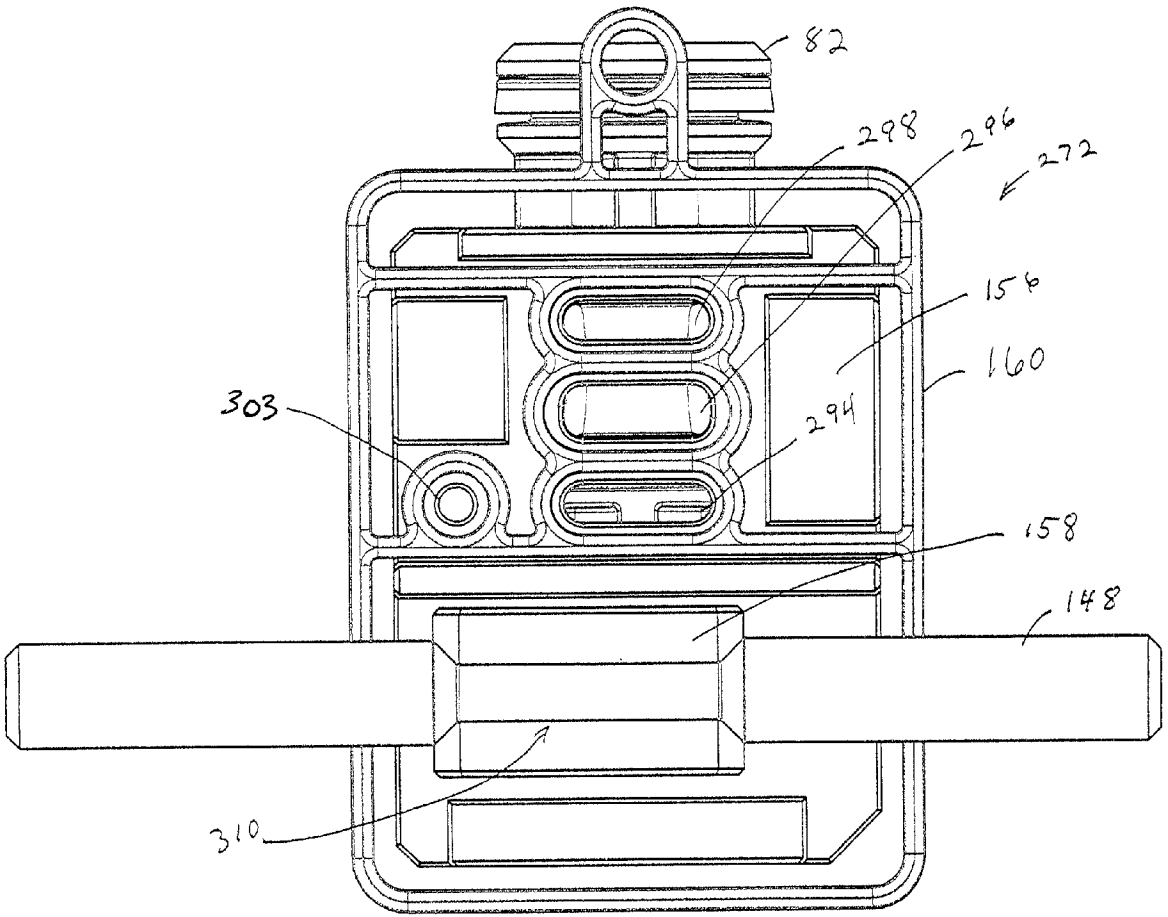
FIG. 42 is a rear elevational view of the valve assembly of FIG. 36.

A rear-elevational view of valve assembly 272 is shown in FIG. 42. Specifically shown are spool 156, pilot D-valve 158, gasket 160, and trip rod 148. It is appreciated from this view how gasket surrounds passages 298, 296 and 294, respectively. Gasket 160 also surrounds passage 303 which provides the exhaust exit path for passage 318. Pilot D-valve 158 is shown fitting into recess 310 of trip rod 148.

Figure 43:
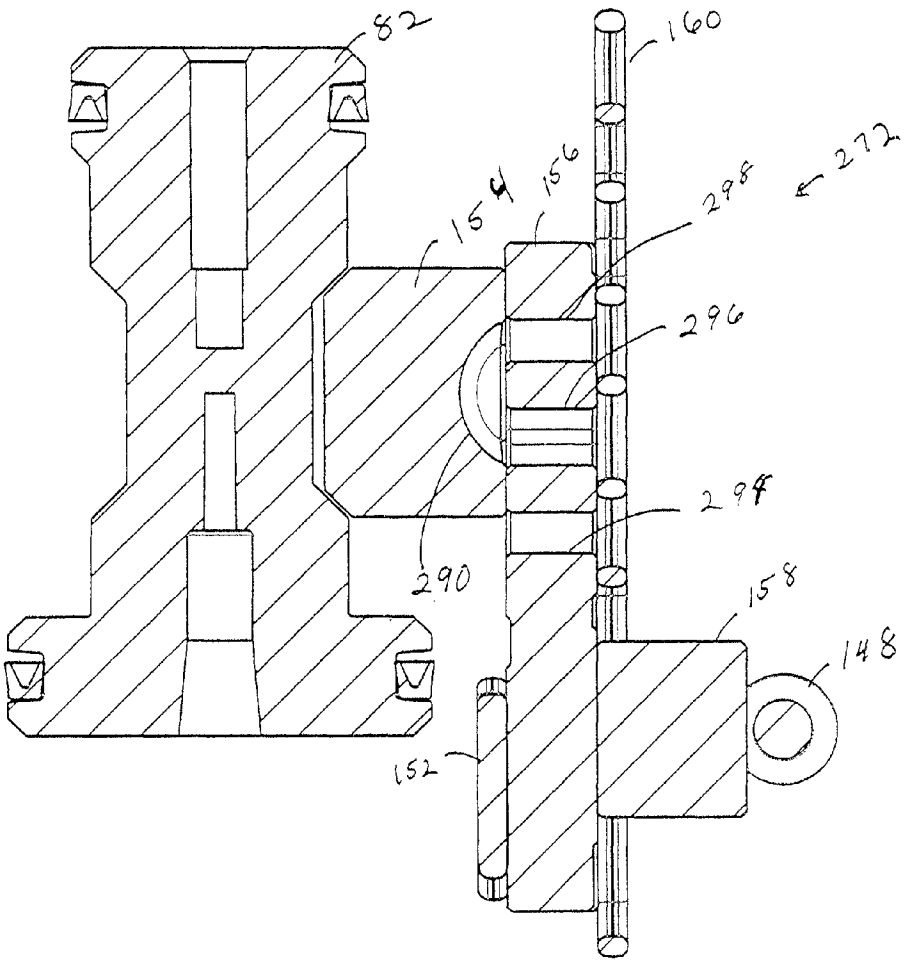
FIG. 43 is a side cross-sectional view of valve assembly taken along lines A-A of FIG. 36.

A side, cross-sectional view of valve assembly 272 taken along lines A-A of FIG. 36 is shown in FIG. 43. This view is otherwise is similar to the view of FIG. 37 showing spool 82, D-valve insert 154, plate 156, gaskets 152 and 160, pilot D-valve 158 and trip rod 148. This view, however, does show the internal passageway 290 in D-valve insert 154. This view nevertheless shows passageways 298, 296 and 294 positioned between openings in gasket 160.

Figure 44:
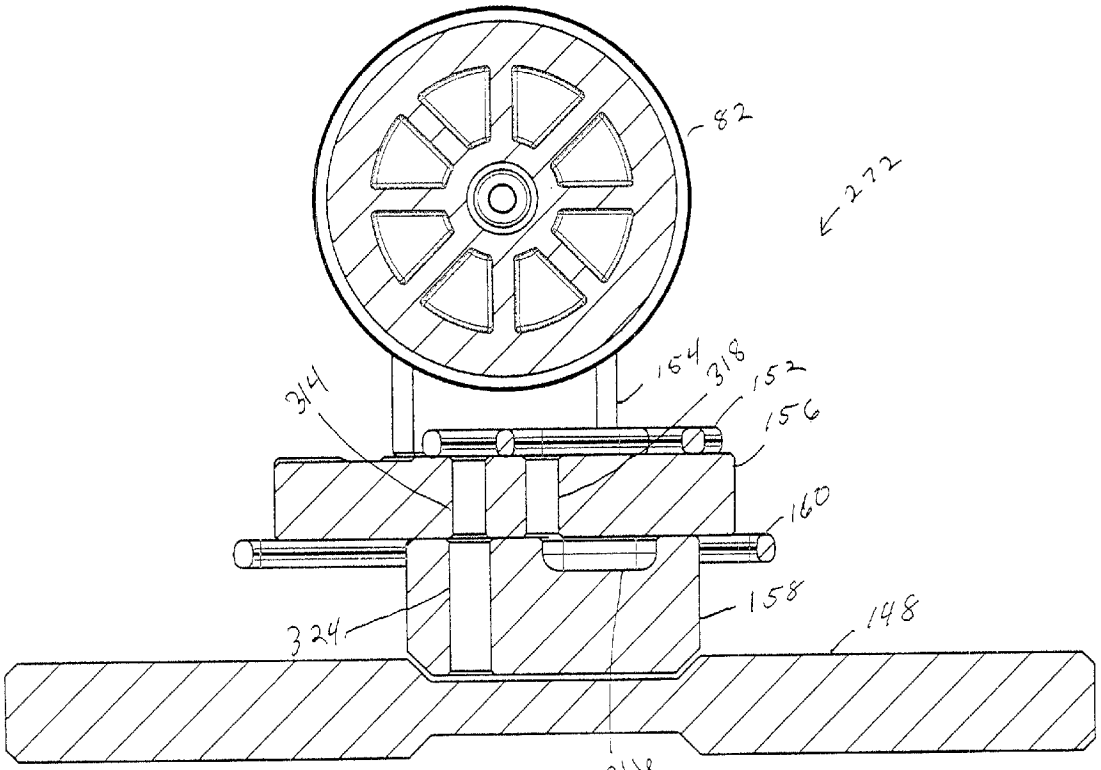
FIG. 44 is an underside cross-sectional view of the air valve assembly taken along lines B-B of FIG. 36.

Another cross-sectional view of valve assembly 272 taken along lines B-B of FIG. 36 is shown in FIG. 44. This view, similar to the view of FIG. 39, shows spool 82, D-valve insert 154, plate 156, gaskets 152 and 160, pilot D-valve 158 and trip rod 148. This view better shows passageway 316 and 324 in pilot D-valve 158, as well as passageways 314 and 318 in plate 156.

Figure 45:
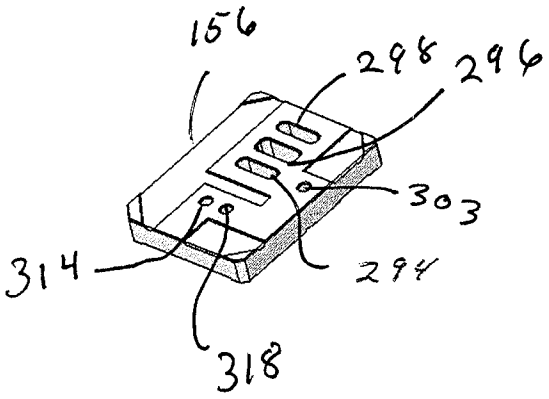
FIG. 45 is a perspective view of a D-valve plate.
Figure 46:
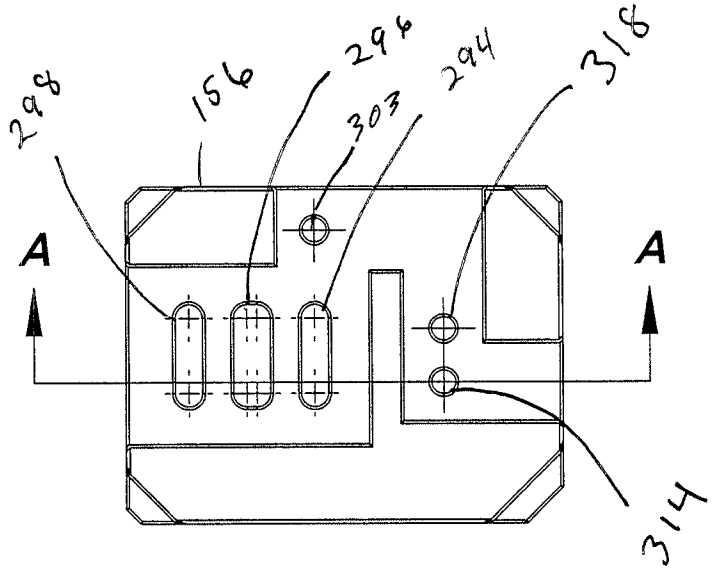
FIG. 46 is a top view of the D-valve plate of FIG. 45.
Figure 47:
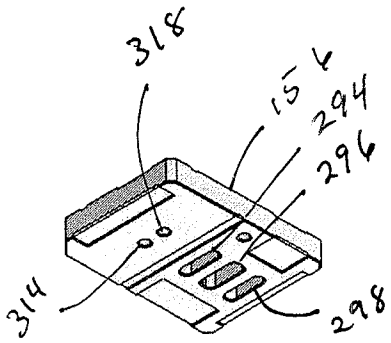
FIG. 47 is a perspective view of the reverse side of the D-valve plate of FIG. 45.
Figure 48:
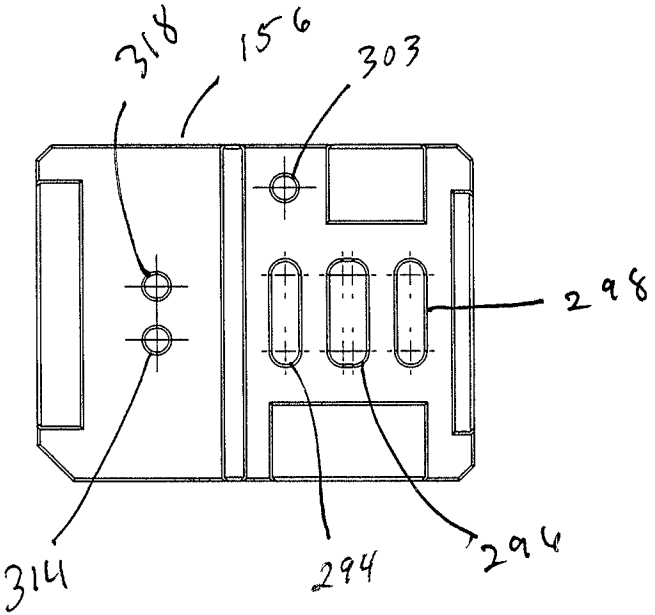
FIG. 48 is an underside view of the D-valve plate of FIG. 45.

A perspective view of D-valve plate 156 is shown in FIG. 45. This view shows passageways 298, 296 and 294. Also shown is passageways 314, and 318 that provide fluid communication to pilot D-valve 158 as previously discussed. The views in FIGS. 46-50 show D-valve plate from various views. For example, FIG. 46 showing a top view of plate 156 also shows passages 298, 296, 294, 314 and 318. The underside view of plate 156 shown in FIG. 47 depicts how passages 298, 296 and 294 are illustratively disposed through the entire plate as well as passages 314 and 318. An underside view of plate 156 further illustrates the positioning of passages 298, 296, 294 and passages 318, 314 as illustratively shown.

Figure 49:
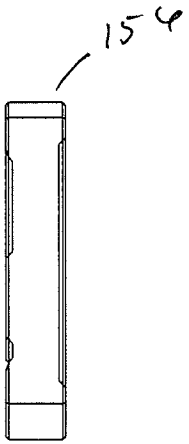
FIG. 49 is a side view of the D-valve plate of FIG. 45.
Figure 50:
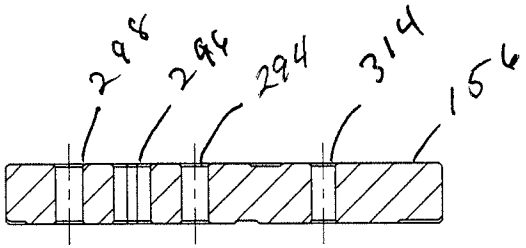
FIG. 50 is a side sectional view of the D-valve plate taken along lines A-A of FIG. 46.
Figure 51:
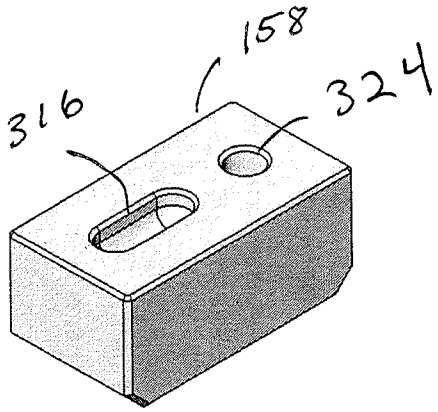
FIG. 51 is a perspective view of a pilot D-valve.
Figure 52:
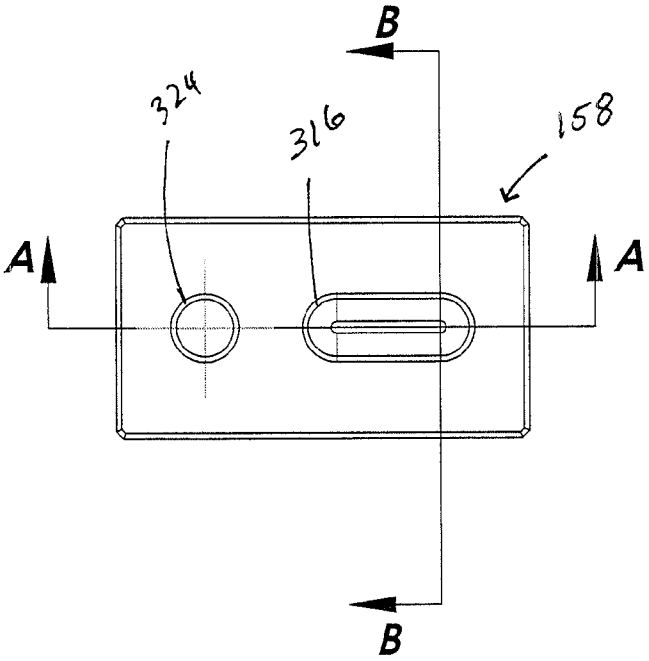
FIG. 52 is a top view of the pilot D-valve of FIG. 51.
Figure 53:
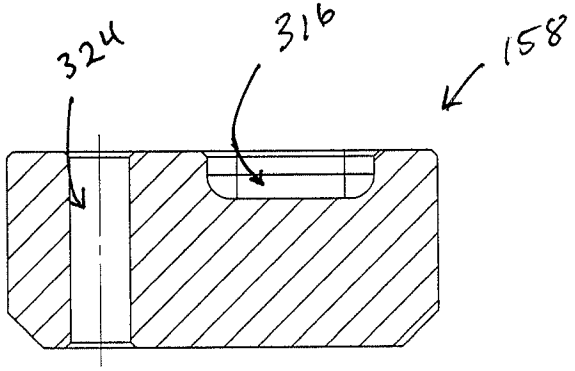
FIG. 53 is a side cross-sectional view of the pilot D-valve taken along lines A-A of FIG. 52.
Figure 54:
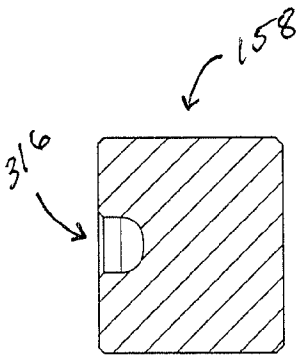
FIG. 54 is an end cross-sectional view of the pilot D-valve taken along lines B-B of FIG. 52.

FIGS. 49 and 50 show side and side cross-sectional views of plate 156. The view in FIG. 50 taken along lines A-A of FIG. 46 further depicts how passages 298, 296, 294, 303 and 314 extend through the plate. The various views of FIGS. 51-54 show pilot D-valve 158. The perspective view in FIG. 51 shows the illustrative configuration of this insert as well as passages 316 and 324. Illustrative configuration of passages 316 and 324 are also evident in the top and cross-sectional views shown in FIGS. 52-54.

Figure 55:
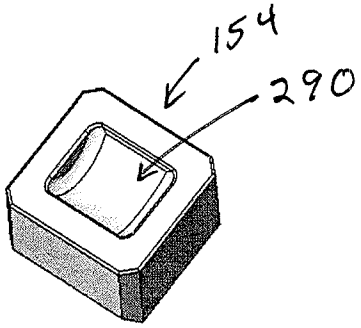
FIG. 55 is a perspective view of a D-valve insert.
Figure 56:
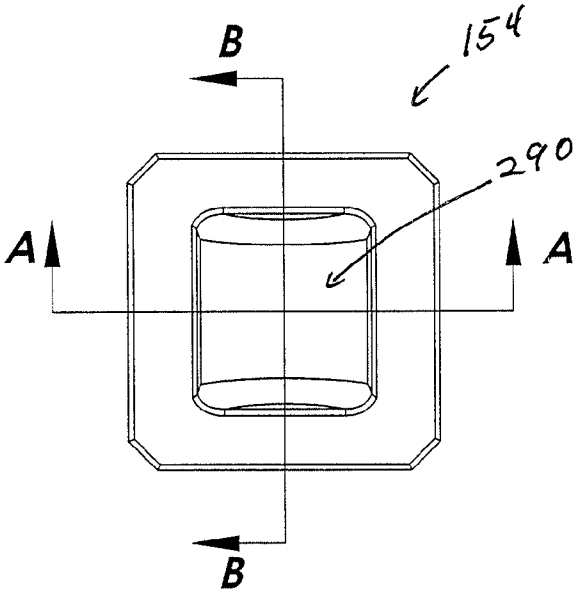
FIG. 56 is a top view of the D-valve insert of FIG. 55.
Figure 57:
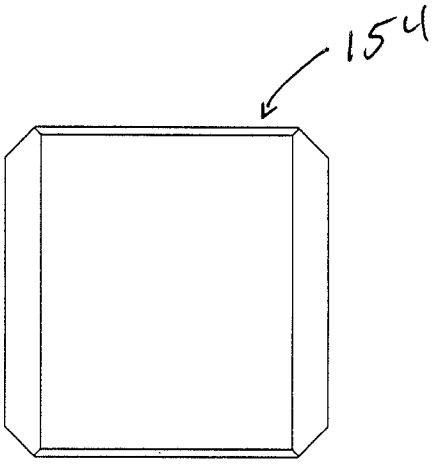
FIG. 57 is an underside view of the D-valve insert of FIG. 55.
Figure 58:
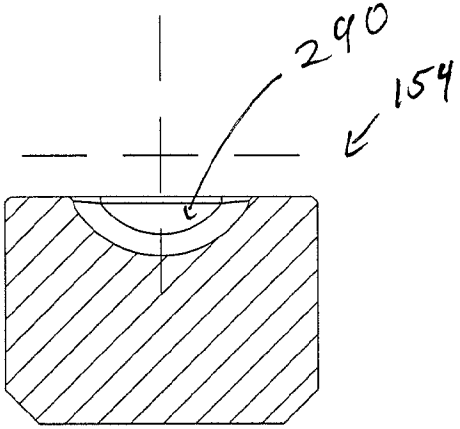
FIG. 58 is a side cross-sectional view of the D-valve insert of FIG. 55 taken along lines A-A of FIG. 56.
Figure 59:
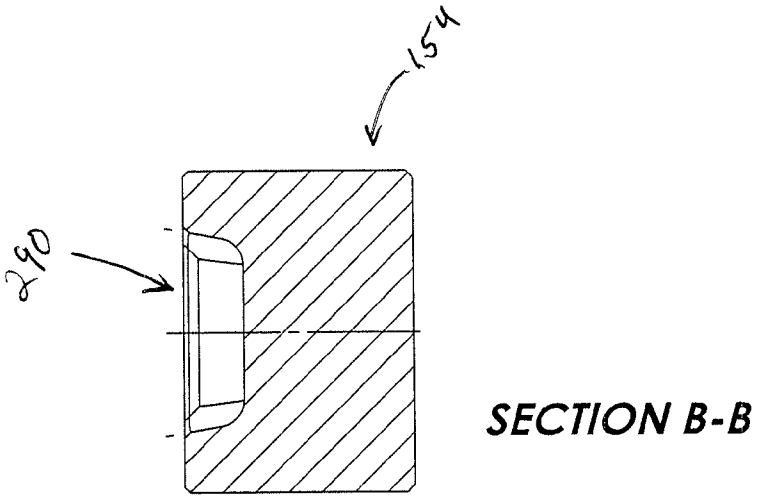
FIG. 59 is an end cross-sectional view of the D-valve insert of FIG. 55 taken along lines B-B of FIG. 56.

Various views of D-valve insert 154 are shown in FIGS. 55-59. The perspective view in FIG. 55 shows the illustrative configuration of insert 154 along with its cavity 290. The top view of D-valve insert 154 also shows cavity 290 as well as demonstrating the illustrative shape of this body. The same goes for the underside view of D-valve insert 154 shown in FIG. 57. And lastly, the sectional views shown in FIGS. 58 and 59 taken along lines A-A and B-B, respectively, of the view of FIG. 56, illustratively shows the configuration of cavity 290.

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

What is claimed is:

1. A double diaphragm pump comprising:

an inlet manifold with at least one passageway configured to direct fluid from an inlet port on the inlet manifold;

an outlet manifold with at least one passageway configured to direct fluid to an outlet port on the outlet manifold;

an air valve housing;

first and second diaphragm housings;

a first diaphragm located in a first diaphragm housing and a second diaphragm located in the second diaphragm housing;

wherein each of the first and second diaphragm housings are in selective fluid communication with the inlet and outlet manifolds;

wherein the first diaphragm separates the first diaphragm housing into first fluid and air chambers;

wherein the second diaphragm separates the second diaphragm housing into second fluid and air chambers;

an air management apparatus to move the first and second diaphragms in a reciprocally linear manner to draw and expel fluid into and from the double diaphragm pump, the air management apparatus comprises:

an air inlet configured to receive pressurized air;

a plate that includes first, second and third air passages wherein the first passage is in fluid communication with the first air chamber and configured such that as pressurized air fills the first air chamber in the first diaphragm housing the first diaphragm moves and expands the air chamber to push the fluid out of the first fluid chamber; and a first block that includes an air passage configured to selectively communicate with the second and third air passage in the plate to expel air from the second air chamber in the second diaphragm housing which are in fluid communication with each other to reduce the size of the second air chamber in the second diaphragm housing as the first air chamber expands.

2. The double diaphragm pump of claim 1, wherein the inlet manifold includes a second passageway that directs fluid from the inlet manifold to one of the diaphragm housings and wherein a collar is configured to be rotatably attached to a periphery of the second passageway on the inlet manifold and the pump.

3. The double diaphragm pump of claim 1, further comprising a collar that is configured to be rotatably attached to a periphery of the one passageway of the outlet manifold and the pump.

4. The double diaphragm pump of claim 1, wherein the first and second diaphragm housings each comprise first and second caps, respectively, wherein the first and second diaphragms are each located between their respective first and second caps of each of the first and second diaphragm housings, respectively, wherein first and second diaphragm collars each having a threaded surface rotatably attach to corresponding threaded surfaces on at least one of the first and second caps of each of the first and second diaphragm housings, respectively, to form the first and second diaphragm housings, respectively.

5. The double diaphragm pump of claim 1, further comprising a spool in communication with the air inlet wherein the spool is configured to move in a linearly reciprocal manner, in response to the pressurized air; and wherein the second block is configured to be moved such that the second passage in the second block selectively moves in fluid communication with the fourth passage in the plate to cause pressurized air to enter the second passage in the second block and the fourth passage in the plate and be directed to the spool to move the spool and first block to selectively cut off pressurized air to the first passage of the plate and selectively open the third passage in the plate to receive pressurized air, and configured such that the pressurized air is exhausted from the first air chamber and through the first and second passage in the plate configured to be in fluid communication with the passageway of the first block to expel that pressurized air, and configured such that the moved spool reveals the third passageway in the first block to supply pressurized air into the second air chamber of the second housing.

6. The double diaphragm pump of claim 1, further comprising a trip rod located in the air valve housing sized a length less than a distance between the first and second diaphragms so the first and second diaphragms are movable a second distance before either the first or second diaphragms cause engagement with the trip rod to move the trip rod;

wherein the trip rod is engageable with a second block having first and second passageways and is configured such that the first passageway of the second block is in selective fluid communication with fourth and fifth passageways in the plate to exhaust air from the second air chamber; and wherein the trip rod is configured to be movable itself a third distance before engaging and moving the second block.

7. The double diaphragm pump of claim 6, wherein the trip rod is configured to move the second block when engaged to cut off the exhaust air from the second air chamber;

wherein the trip rod is engageable with a second block having first and second passageways and is configured such that the first passageway of the second block is in selective fluid communication with fourth and fifth passageways in the plate to exhaust air from the second air chamber;

wherein the trip rod is configured to be movable itself a third distance before engaging and moving the second block; and wherein the trip rod is configured to move the second block when engaged to cut off the exhaust air from the second air chamber.

8. A double diaphragm pump comprising:

an inlet manifold;

an outlet manifold;

first and second diaphragm housings;

a first diaphragm located in the first diaphragm housing;

a second diaphragm located in the second diaphragm housing;

wherein the first diaphragm separates the first diaphragm housing into first fluid and air chambers;

wherein the second diaphragm separates the second diaphragm housing into second fluid and air chambers;

an air valve housing in selective fluid communication with each of the first and second air chambers;

an air management apparatus to move the first and second diaphragms in a reciprocally linear manner to draw and expel fluid into and from the double diaphragm pump, the air management apparatus comprises:

an air inlet configured to receive pressurized air;

a spool in communication with the air inlet wherein the spool is configured to move in a linearly reciprocal manner, in response to the pressurized air;

a plate that includes first, second and third air passages wherein the first passage is in fluid communication with the first air chamber and configured such that as pressurized air fills the first air chamber in the first diaphragm housing the first diaphragm moves and expands the air chamber to push the fluid out of the first fluid chamber;

a first block that includes an air passage configured to selectively communicate with the second and third air passages in the plate to expel air from the second air chamber in the second diaphragm housing which are in fluid communication with each other to reduce the size of the second air chamber in the second diaphragm housing as the first air chamber expands;

a trip rod located in the air valve housing sized a length less than a distance between the first and second diaphragms so the first and second diaphragms are movable a second distance before either the first or second diaphragms cause engagement with the trip rod to move the trip rod;

wherein the trip rod is engageable with a second block having first and second passageways and is configured such that the first passageway of the second block is in selective fluid communication with fourth and fifth passageways in the plate to exhaust air from the second air chamber;

wherein the trip rod is configured to be movable itself a third distance before engaging and moving the second block;

wherein the trip rod is configured to move the second block when engaged to cut off the exhaust air from the second air chamber; and wherein the second block is configured to be moved such that the second passageway in the second block selectively moves in fluid communication with the fourth passageway in the plate to cause pressurized air to enter the second passageway in the second block and the fourth passageway in the plate and be directed to the spool to move the spool and first block to selectively cut off pressurized air to the first passageway of the plate and selectively open the third passageway in the plate to receive pressurized air, and configured such that the pressurized air is exhausted from the first air chamber and through the first and second passageways in the plate configured to be in fluid communication with the passageway of the first block to expel that pressurized air, and configured such that the moved spool reveals the third passageway in the first block to supply pressurized air into the second air chamber of the second diaphragm housing.

9. A double diaphragm pump comprising:

an inlet manifold with at least one passageway configured to direct fluid from an inlet port on the inlet manifold;

an outlet manifold with at least one passageway configured to direct fluid to an outlet port on the outlet manifold;

an air valve housing;

first and second diaphragm housings;

a first diaphragm located in a first diaphragm housing and a second diaphragm located in the second diaphragm housing;

wherein each of the first and second diaphragm housings are in selective fluid communication with the inlet and outlet manifolds;

wherein the first diaphragm separates the first diaphragm housing into first fluid and air chambers;

wherein the second diaphragm separates the second diaphragm housing into second fluid and air chambers;

an air management apparatus to move the first and second diaphragms in a reciprocally linear manner to draw and expel fluid into and from the double diaphragm pump, the air management apparatus comprises:

an air inlet configured to receive pressurized air;

first, second and third air passages in the double diaphragm pump wherein the first passage is in fluid communication with the first air chamber and configured such that as pressurized air fills the first air chamber in the first diaphragm housing the first diaphragm moves and expands the air chamber to push the fluid out of the first fluid chamber;

a plate that includes first, second and third air passages wherein the first passage is in fluid communication with the first air chamber and configured such that as pressurized air fills the first air chamber in the first diaphragm housing the first diaphragm moves and expands the air chamber to push the fluid out of the first fluid chamber;

a first block that includes an air passage configured to selectively communicate with the second and third air passage in the plate to expel air from the second air chamber in the second diaphragm housing which are in fluid communication with each other to reduce the size of the second air chamber in the second diaphragm housing as the first air chamber expands; and wherein the second block is configured to be moved such that the second passageway in the second block selectively moves in fluid communication with the fourth passageway in the plate to cause pressurized air to enter the second passageway in the second block and the fourth passageway in the plate and be directed to the spool to move the spool and first block to selectively cut off pressurized air to the first passageway of the plate and selectively open the third passageway in the plate to receive pressurized air, and configured such that the pressurized air is exhausted from the first air chamber and through the first and second passageways in the plate configured to be in fluid communication with the passageway of the first block to expel that pressurized air, and configured such that the moved spool reveals the third passageway in the first block to supply pressurized air into the second air chamber of the second housing.

10. A double diaphragm pump comprising:

an inlet manifold with at least one passageway configured to direct fluid from an inlet port on the inlet manifold;

an outlet manifold with at least one passageway configured to direct fluid to an outlet port on the outlet manifold;

an air valve housing;

first and second diaphragm housings;

a first diaphragm located in a first diaphragm housing and a second diaphragm located in the second diaphragm housing;

wherein each of the first and second diaphragm housings are in selective fluid communication with the inlet and outlet manifolds;

wherein the first diaphragm separates the first diaphragm housing into first fluid and air chambers;

wherein the second diaphragm separates the second diaphragm housing into second fluid and air chambers;

an air management apparatus to move the first and second diaphragms in a reciprocally linear manner to draw and expel fluid into and from the double diaphragm pump, the air management apparatus comprises:

an air inlet configured to receive pressurized air;

first, second and third air passages in the double diaphragm pump wherein the first passage is in fluid communication with the first air chamber and configured such that as pressurized air fills the first air chamber in the first diaphragm housing the first diaphragm moves and expands the air chamber to push the fluid out of the first fluid chamber;

a plate that includes first, second and third air passages wherein the first passage is in fluid communication with the first air chamber and configured such that as pressurized air fills the first air chamber in the first diaphragm housing the first diaphragm moves and expands the air chamber to push the fluid out of the first fluid chamber;

a first block that includes an air passage configured to selectively communicate with the second and third air passage in the plate to expel air from the second air chamber in the second diaphragm housing which are in fluid communication with each other to reduce the size of the second air chamber in the second diaphragm housing as the first air chamber expands;

wherein the trip rod is engageable with a second block having first and second passageways and is configured such that the first passageway of the second block is in selective fluid communication with fourth and fifth passageways in the plate to exhaust air from the second air chamber; and wherein the trip rod is configured to be movable itself a third distance before engaging and moving the second block.

* * * * *